US006563766B1

(12) United States Patent
Nakamiya

(10) Patent No.: US 6,563,766 B1
(45) Date of Patent: May 13, 2003

(54) VOLTAGE DETECTING DEVICE, BATTERY REMAINING VOLTAGE DETECTING DEVICE, VOLTAGE DETECTING METHOD, BATTERY REMAINING VOLTAGE DETECTING METHOD, ELECTRONIC TIMEPIECE AND ELECTRONIC DEVICE

(75) Inventor: Shinji Nakamiya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 133 days.

(21) Appl. No.: 09/718,750

(22) Filed: Nov. 22, 2000

(30) Foreign Application Priority Data

Nov. 24, 1999 (JP) ..... 11-375879
Jun. 22, 2000 (JP) ..... 2000-188170

(51) Int. Cl.[7] ..... G04B 1/00; G04B 9/00
(52) U.S. Cl. ..... 368/64; 368/66; 320/162
(58) Field of Search ..... 368/64, 66, 204; 320/137, 161, 162

(56) References Cited

U.S. PATENT DOCUMENTS 5,654,622 A * 8/1997 Toya et al. ..... 320/21
5,698,963 A * 12/1997 Seong et al. ..... 320/20
6,111,389 A * 8/2000 Aranovich et al. ..... 320/150

FOREIGN PATENT DOCUMENTS

| | | |
|---|---|---|
| EP | 0 685 777 | 12/1995 |
| JP | 7-306275 | 11/1995 |
| JP | 10-26675 | 1/1998 |
| JP | 11-64548 | 3/1999 |
| WO | WO 98/06013 | 2/1998 |

* cited by examiner

*Primary Examiner*—Vit Miska
(74) *Attorney, Agent, or Firm*—Mark P. Watson

(57) ABSTRACT

A voltage detection and a remaining battery voltage display for a secondary power source so as to notify the user of the remaining battery voltage of the secondary power source at the optimal timing and in an accurate manner. A voltage correlated to the power source capacity of the secondary power source is detected as a detection voltage. The detection voltage is directly output if a rapid charging is not being detected. If the rapid charging is being detected, the detection voltage is output after being corrected for an amount of the apparent voltage boost which occurs in the secondary power source due to the rapid charging. The detection voltage thus obtained is compared with a predetermined reference voltage so as to discriminate the remaining capacity of the secondary power source.

41 Claims, 29 Drawing Sheets

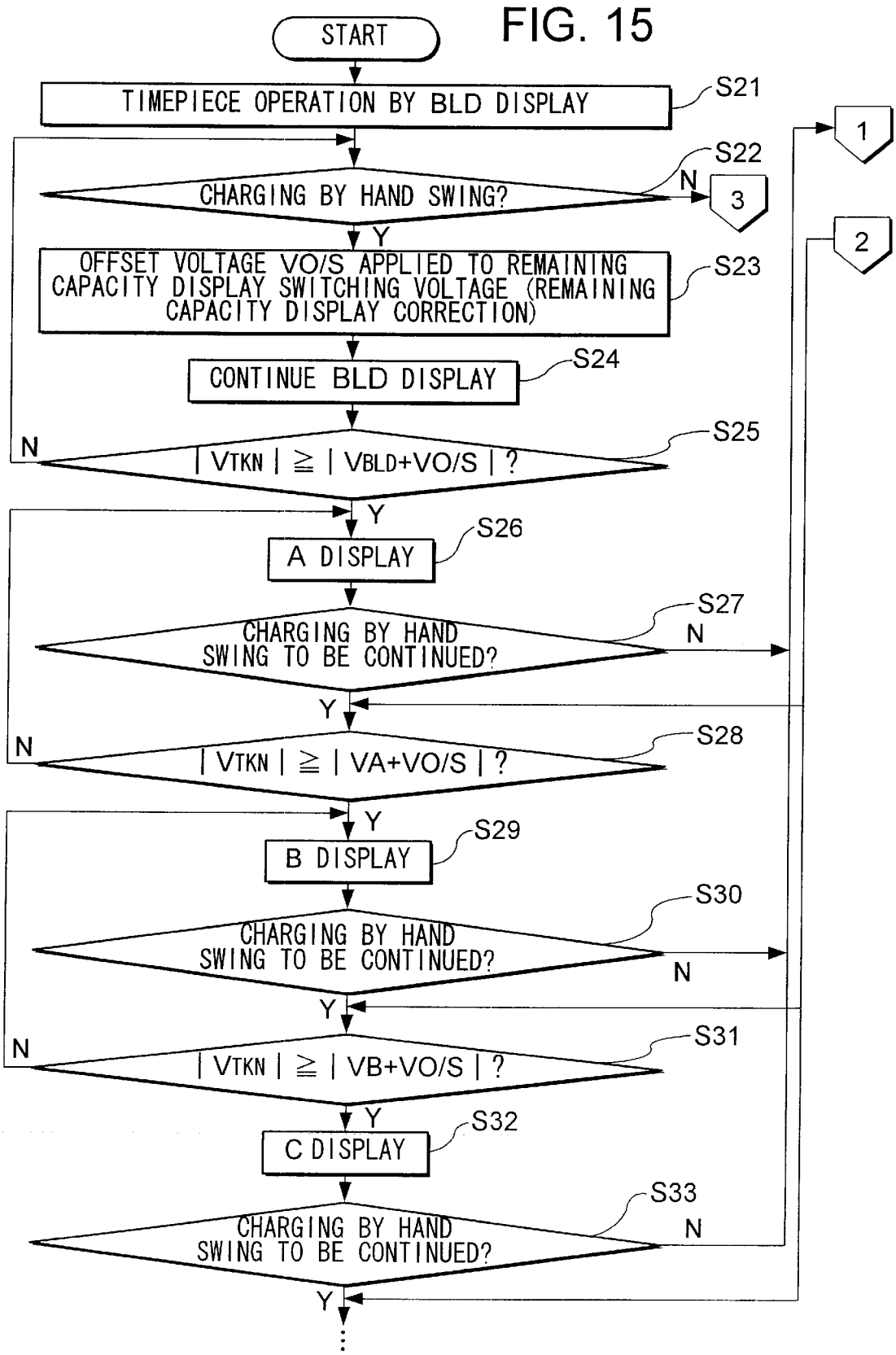
FIG. 15
START
TIMEPIECE OPERATION BY BLD DISPLAY
S21
CHARGING BY HAND SWING?
S22
N
3
Y
OFFSET VOLTAGE VO/S APPLIED TO REMAINING CAPACITY DISPLAY SWITCHING VOLTAGE (REMAINING CAPACITY DISPLAY CORRECTION)
S23
CONTINUE BLD DISPLAY
S24
| VTKN | ≧ | VBLD+VO/S | ?
S25
N
Y
A DISPLAY
S26
CHARGING BY HAND SWING TO BE CONTINUED?
S27
N
Y
| VTKN | ≧ | VA+VO/S | ?
S28
N
Y
B DISPLAY
S29
CHARGING BY HAND SWING TO BE CONTINUED?
S30
N
Y
| VTKN | ≧ | VB+VO/S | ?
S31
N
Y
C DISPLAY
S32
CHARGING BY HAND SWING TO BE CONTINUED?
S33
N
Y
1
2

Tc
SX0
SX1
SX2
SX3
SX4
SX

DETECTION: High
SX1
SS
CK3
YP1

NON-DETECTION: Low
SX1
SS
CK3
YN1

VOLTAGE DETECTING DEVICE, BATTERY REMAINING VOLTAGE DETECTING DEVICE, VOLTAGE DETECTING METHOD, BATTERY REMAINING VOLTAGE DETECTING METHOD, ELECTRONIC TIMEPIECE AND ELECTRONIC DEVICE

BACKGROUND OF THE INVENTION

1. Field of the Invention

The present invention relates to a voltage detecting device, a battery remaining voltage detecting device, a voltage detecting method, a battery remaining voltage detecting method, an electronic timepiece, in particular relates to a technologies of voltage detection of a secondary battery and of a detection of a battery remaining voltage.

2. Prior Art

Lately, there is realized a small-sized electronic timepiece such a type as a wrist watch in which a power generating device such as a solar battery is contained therein to operate without replacing the batter. The above-mentioned electronic timepiece includes a function which charges an electric power generated from the power generating device first to a large capacity capacitor, and then when the electric power is not generated, the time is displayed by the electronic power discharged from the capacitor. Accordingly, it is possible that the timepiece is steadily operated for a long period of time without using a battery. It is then expected that the power generating device is to be contained in many electronic timepieces, considering a time required to replace the battery or a problem caused to trash the battery.

On the other hand, it is obvious that the management of the battery remaining voltage becomes an important issue in the electronic timepiece containing the above-mentioned power generating device.

Then, there is described a technology to manage the battery remaining voltage in the conventional device containing the secondary battery.

[1] The First Conventional Device

As the first conventional device, there is disclosed an electronic device in Japanese Patent Provisional Publication No. 11-64,548.

In the electronic device including the power generating device disclosed in Japanese Patent Provisional Publication No. 11-64548, when the voltage of the secondary power source drops, and the voltage thereof becomes lower than the first detected voltage, a remaining voltage of the power is displayed. Then, when the voltage of the secondary power source further drops and the voltage thereof becomes lower than the second detected voltage, the operations of buzzer and the EL (Electro Luminescence) are inhibited. Then, when the voltage of the secondary power source further drops and the voltage thereof becomes lower than the third detected voltage, a display is inhibited.

As described above, there is disclosed a structure in which a degree of the consumption of the secondary power source is informed to the user, thus preventing a sudden stoppage of the circuit without an advance notice.

[2] The Second Conventional Device

As the second conventional device, there is disclosed an electronic timepiece in Japanese Patent Provisional Publication No. 7-306,275.

In the electronic timepiece disclosed in Japanese Patent Provisional Publication No. 7-306,275, a remaining capacity detecting unit of the secondary battery employs a structure in which when the voltage of the secondary battery successively exceeds a reference voltage corresponding to a prescribed remaining capacity, a battery remaining voltage detecting signal is output so as to renew the battery remaining voltage.

In the electronic device with the power generating device of the first conventional device, since a voltage-capacity property of the secondary power source varied by a rapid charging, a time to practically drive the electronic device varied accordingly, and it was probable that the remaining voltage of the secondary power source was not informed precisely to the user.

In particular, it was probable that in the final stage of the discharging of the secondary power source, i.e., in a region immediate before the drive of the electronic device stopped, the electronic device stopped operating without user's acknowledgement thereof in spite of the fact that a precise remaining time to enable operation was expected to be informed to the user.

Furthermore, in the electronic timepiece of the second conventional device, although there was no problem even when the battery remaining voltage was renewed according to the reference voltage in case that a charging except a rapid charging was implemented, it was probable that a display of the remaining voltage was hardly renewed, thus causing the user to sense that the charging was not effected well.

Furthermore, when a secondary power source in which an apparent voltage boost generated in a rapid charging operation continued for a long period of time, it was probable that a remaining voltage display was hardly switched.

In addition, it was necessary to provide a timer to set a battery remaining voltage renewal timing which probably enlarged a circuit size.

The object of the present invention is therefore to provide a voltage detecting device and the method thereof for precisely detecting a voltage of a secondary power source in order to precisely and most-timely inform the user of a battery remaining voltage of the secondary power source, a battery remaining voltage detecting device and the method thereof for enabling a precise display of the battery remaining voltage, based on the detected voltage, and an electronic timepiece and electronic device using same.

SUMMARY OF THE INVENTION

In accordance with an aspect of the present invention, the present invention provides a voltage detecting device for detecting a voltage of a secondary power source including a detected voltage output unit for outputting a voltage having a correlation to an amount of a stored electricity of said secondary power source as a detected voltage; a rapid charging detecting unit for detecting whether rapid charging to said secondary power source is performed or not; a voltage correction unit for implementing, when said rapid charging is detected, a voltage correction in which a correction voltage corresponding to an apparent boosted voltage generated in said secondary power source due to said rapid charging is superimposed on said detected voltage; and a voltage detection result output unit for outputting a voltage detection result signal, based on said detected voltage or said corrected detected voltage.

Preferably, in the voltage detecting device, said voltage detection result output unit compares said detected voltage or said corrected detected voltage with a predetermined reference voltage to obtain a comparative result and output said result as said voltage detection result signal.

Preferably, in the voltage detecting device, said rapid charging detecting unit includes a charging condition detecting unit for detecting charging to said secondary power source; and a rapid charging condition discrimination unit for discriminating a transition to a rapid charging condition in which said rapid charging is performed, upon detecting that said charging to said secondary power source is remained during a time longer than a predetermined charging reference time.

Preferably, in the voltage detection device, said secondary power source is charged by a power generating device; and said charging condition detecting unit includes a power generation current discriminating unit for discriminating whether a power generation current volume output from said power generating device exceeds a predetermined power generation current volume or not.

Preferably, in the voltage detection device, said secondary power source to is charged by a power generating device; and said charging condition detecting unit includes a stored power voltage discriminating unit for calculating a stored power voltage of said secondary power source based on a power generation current output from said power generating device to discriminates whether said stored power voltage exceeds a predetermined reference stored power voltage or not.

Preferably, in the voltage detection device, said secondary power source is charged by a power generating device; and said charging condition detecting unit includes a comparing unit for comparing a voltage of an output terminal in said power generating device with a prescribed voltage corresponding to a terminal voltage in said secondary power source; and a charging condition discriminating unit for discriminating as being in a charging condition a case in which the voltage of said output terminal exceeds the terminal voltage of said secondary power source, based on a comparative result of said comparing unit.

Preferably, in the voltage detection device, said charging condition detecting unit discriminates whether or not charging to said secondary power source is performed by monitoring a route different from a charging route of said charging. Preferably, in the voltage detection device, said secondary power source is charged by a power generating device; and said rapid charging detecting unit includes a power generating condition detecting unit for detecting a power generating condition in said power generating device; and a rapid charging no condition discriminating unit for discriminating as being in a rapid charging condition upon detecting that said power generating condition is remained during a time longer than a predetermined power generating reference time.

Preferably, in the voltage detection device, said power generating condition detecting unit includes a output voltage comparing unit for comparing an output voltage of said power generating device with a predetermined reference power generating voltage; and a power generating condition discriminating unit for discriminating based on a comparative result of said output voltage comparing unit whether being in a power generating condition or not.

Preferably, in the voltage detection device, said secondary power source is charged by a power generating device; said rapid charging detecting unit includes a charging condition detecting unit for detecting a condition of charging to said secondary power source; a power generating condition detecting unit for detecting a power generating condition of said power generating device; and a rapid charging condition discriminating unit for discriminating as being in a rapid charging condition a case in which detection of said charging is continuously repeated during a time longer than a predetermined charging reference time, or a case in which detection of said power generating condition is continuously repeated during a time longer than a predetermined power generating reference time; and said power generating reference time is set longer than said charging reference time.

Preferably, in the voltage detection device, said power generating condition detecting unit discriminates whether or not a power generation is implemented by monitoring a route a different route from a charging route of said secondary power source.

Preferably, in the voltage detection device, said detected voltage output unit produces a plurality of different detected voltages.

Preferably, in the voltage detection device, said correction voltage is a predetermined offset voltage.

Preferably, in the voltage detection device, said voltage correction unit produces said correction voltage in a manner to correspond to respective said plurality of different detected voltages Preferably, in the voltage detection device, said voltage detection device further includes a power source kind discriminating unit for discriminating a kind of said secondary power source; and a discriminating result selecting unit for selecting anyone of plurality of voltage detecting result signal corresponding to said plurality of detected voltages, based on a discriminating result of said power source kind discriminating unit to output same.

Preferably, in the voltage detection device, said voltage detection result output unit discriminates a voltage of said secondary power source into a plurality of stages having predetermined voltage ranges; and any one of said correction voltage or said detected voltage output from said detected voltage output unit is set in respective said stages.

Preferably, in the voltage detection device, at least said correction voltage in a group of said correction voltage and said detected voltage output from said detected voltage output unit is set in a manner to correspond to a kind of said secondary power source; said voltage correction unit includes a correction voltage producing unit for producing a plurality of correction voltage corresponding to a kind of said secondary power source; and a correction voltage selecting unit for selecting a correction voltage corresponding to a discriminating result in said power source kind discriminating unit to output same.

Preferably, in the voltage detection device, said correction voltage and said detected voltage output from said detected voltage output unit are respectively set in a manner to correspond to a kind of said secondary power source; said detected voltage output unit includes a detected voltage producing unit for producing a plurality of detected voltages corresponding to a kind of said secondary power source; a detected voltage selecting unit for selecting a detected voltage corresponding to a discriminating result in said power source kind discriminating unit to output same; and said voltage correction unit includes a correction voltage producing unit for producing a plurality of correction voltage corresponding to a kind of said secondary power source; and a correction voltage selecting unit for selecting a correction voltage corresponding to a discriminating result in said power source kind discriminating unit to output same.

Preferably, in the voltage detection device, said power source kind discriminating unit discriminates a kind of said secondary power source, based on a kind designating signal from outside. Preferably, in the voltage detection device, said kind designating signal is input through an external input terminal or input from a memory.

Preferably, in the voltage detection device, said rapid charging condition discriminating unit discriminates a period of time when said rapid charging is kept detected by said rapid charging detecting unit and a period of time when a prescribed waiting time is passed after said rapid charging is not continuously detected as said rapid charging condition.

Preferably, in the voltage detection device, said rapid charging condition discriminating unit discriminates a period of time when said rapid charging is kept detected by said rapid charging detecting unit and a period of time when a prescribed waiting time is passed after said rapid charging stops being detected, as said rapid charging condition.

Preferably, in the voltage detection device, said waiting time is set as a period of time when an apparent voltage boost generated in a rapid charging in said secondary power source becomes almost zero and stable.

Preferably, in the voltage detection device, said voltage detection device further includes: a waiting time storage unit for storing a plurality of waiting times; and a waiting time selecting unit for selecting anyone of waiting times stored in said waiting time storage unit, based on a discriminating result in said power source kind discriminating unit to output same.

Preferably, in the voltage detection device, a measurement of said waiting time is initialized when said rapid charging is detected again before said waiting time is passed.

Preferably, in the voltage detection device, said detected voltage is a voltage after a voltage boost and drop is implemented at a prescribed voltage boost and drop multiplying factor; and said voltage detection device further includes: a discriminating result selecting unit for selecting anyone of a plurality of voltage detection results corresponding to a plurality of said detected voltages, based on said voltage boost and drop multiplying factor to output same.

Preferably, in the voltage detection device, said voltage detection device further includes: a discriminating result selecting unit for selecting anyone of a plurality of voltage detection results corresponding to a plurality of said detected voltages, based on said stage to output same.

Furthermore, the present invention provides a battery remaining capacity detecting device including a voltage detection device described above; and a remaining capacity discriminating unit for discriminating a remaining capacity which is an amount of an electricity which can be output from said secondary power source, based on a voltage detecting result output from said voltage detection device.

The present invention further provides a battery remaining capacity detecting device including a voltage detection device described above; and a remaining capacity discriminating unit for discriminating a remaining capacity which is an amount of an electricity which can be output from said secondary power source, based on a voltage detecting result output from said voltage detection device; and said remaining capacity discriminating unit discriminates a remaining capacity of said secondary power source in such manner that when a predetermined condition is satisfied during a period of time when said waiting time is passed after said rapid charging is not continuously detected as said rapid charging condition, a transition to other conditions except said rapid charging condition is effected.

Preferably, in the battery remaining capacity detecting device, said predetermined condition is a case in which a voltage of said secondary power source is bellow a predetermined lower limit voltage.

Preferably, in the battery remaining capacity detecting device, said predetermined condition is a case in which a remaining capacity of said secondary power source discriminated by said remaining capacity discriminating unit becomes a predetermined remaining capacity.

Preferably, in the battery remaining capacity detecting, said battery remaining capacity detecting device includes a remaining capacity comparing unit for comparing a remaining capacity of said secondary power source immediately before said rapid charging condition is over with a remaining capacity of said secondary power source immediately after transitioning to said non-rapid charging condition, when a transition from said rapid charging condition to said non-rapid charging condition is effected; and said voltage detection result output unit discriminates a voltage of said secondary power source into a plurality of stages having predetermined voltage ranges based on a comparative result in said remaining capacity comparing unit, and when a stage corresponding to a remaining capacity of said secondary power source immediately after transition to said non-rapid charging condition is lower than a stage corresponding to a remaining capacity of said secondary power source immediately before said rapid charging is over, said voltage detection result output unit discriminates said stage corresponding to said remaining capacity of said secondary power source immediately after transition to said non-rapid charging condition as a stage corresponding to a present remaining capacity.

Preferably, in the battery remaining capacity detecting device, said voltage detection result output unit discriminates a voltage of said secondary power source into a plurality of stages having predetermined voltage ranges and said battery remaining capacity detecting device further includes a remaining capacity comparing unit for comparing a stage of a remaining capacity of said secondary power source immediately before said rapid charging condition is over with a stage of a remaining capacity of said secondary power source immediately after transitioning to said non-rapid charging condition, when a transition from said rapid charging condition to said non-rapid charging condition is effected; and a rank-up inhibiting control unit for inhibiting rank-up of said stage based on a comparative result in said remaining capacity comparing unit in a way that until a predetermined rank-up inhibiting cancellation condition is satisfied, a rank-up of stage is inhibited when a stage corresponding to a remaining capacity of said secondary power source immediately after transition to said non-rapid charging condition is higher than a stage corresponding to a remaining capacity of said secondary power source immediately before said rapid charging is over.

Preferably, in the battery remaining capacity detecting device, said rapid charging detecting unit includes a charging condition detecting unit for detecting a charging condition to said secondary power source; and said rank-up inhibiting cancellation condition is a case in which a charging condition is detected by said charging detecting unit.

Preferably, in the battery remaining capacity detecting, said battery remaining capacity detecting device includes a charging cut-off unit for forcefully cutting off a charging of said secondary power source, when detecting a voltage having a correlation to a remaining capacity of said secondary power source.

The present invention further provides a method for detecting a voltage of a secondary power source comprising steps of outputting a voltage having correlation to a remaining capacity of said secondary power source as a detected voltage; detecting whether a rapid charging is effected in said secondary power source or not; implementing, when said rapid charging is detected, a voltage correction in which a correction voltage corresponding to an apparent boosted voltage generated in said secondary power source due to said rapid charging is superimposed on said detected voltage; and outputting a voltage detection resultant signal, based on said detected voltage or said corrected detected voltage.

Preferably, in the method, said method further comprises a step of comparing the detection object voltage obtained according to the method described above with a predetermined reference voltage to discriminate a remaining capacity of said secondary power source.

The present invention further provides an electronic timepiece including a secondary power source supplying a power source for driving; a time keeping unit driven by said secondary power source; and a voltage detecting device described above.

The present invention further provides an electronic timepiece including a secondary power source supplying a power source for driving; a time keeping unit driven by said secondary power source; and a battery remaining amount detecting device described above.

The present invention further provides an electronic device including a secondary power source supplying a power source for driving; a driven unit driven by said secondary power source; and a voltage detecting device described above.

The present invention further provides an electronic device including a secondary power source supplying a power source for driving; a driven unit driven by said secondary power source; and a battery remaining amount detecting device described above.

BRIEF DESCRIPTION OF THE DRAWINGS

FIG. 15 is a flow chart (part 1) illustrating the operation during a rapid charging mode;

PREFERRED EMBODIMENTS OF THE INVENTION

Preferred embodiments of the present invention are described with reference to the drawings.

1 First Embodiment

The first embodiment of the invention is described with reference to the drawings.

[1.1] General Description

Figure 1:
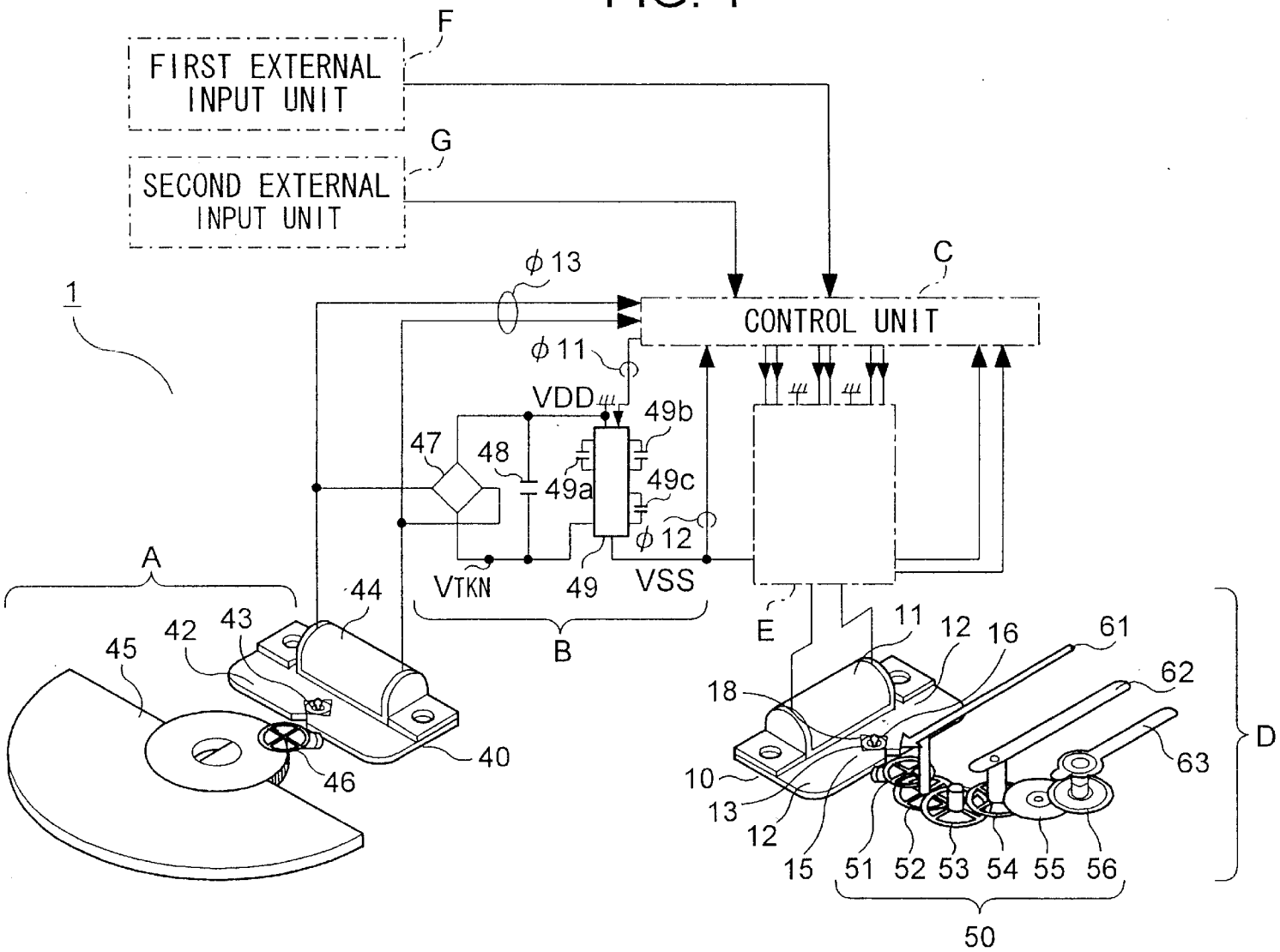
FIG. 1 is a diagram illustrating the general configuration of a time-keeping device 1 according to the first embodiment of the present invention.

FIG. 1 is a schematic construction of the time keeping device 1 of the embodiment of the present invention.

The time keeping device 1 is an electronic wristwatch which is used by a user in such manner that a belt connected to the main body of the device is tied around the wrist of the user.

The time keeping device 1 comprises a power generation unit A for generating an alternating current, a power source unit B for rectifying the alternating current from the power generation unit A to store a power and supplying the power to each of the components by means of boosting or dropping the voltage of the stored power, a control unit C for controlling a whole device, hands moving mechanism D for driving hands by the use of a stepping motor 10, a driving unit E for driving the hands moving mechanism D in accordance with a control signal from the control unit C, a first external input unit F such as an input terminal, and a second external input unit G such as a button.

In this case, the control unit C is constructed so as to be switched in either a display mode for displaying time by driving the hands moving mechanism D in accordance with a generating condition of the generation unit A, or a power saving mode for saving power to stop supplying power to the hands moving mechanism D. In addition, the transition from the power saving mode to the display mode is forcibly executed by the user by means of swinging the time keeping device 1 with hands.

Each of the components of the time keeping device is described hereunder. The control unit C is described later with the use of functional blocks.

The power generation unit A includes a power generating device 40, a revolving weight 45, and an accelerating gear 46. As the power generating device 40, there is introduced an electromagnetic induction-type alternating current power generating device in which a power generating rotor 43 revolves within a power generating stator 42 so as to output a power induced in a power generating coil connected to the power generating stator 42. The revolving weight 45 functions as the unit for transferring the kinetic energy to the power generating rotor 43. The movement of the above-mentioned revolving weight 45 is transferred through the accelerating gear 46 to the power generating rotor 43. The revolving weight 45 can rotate within the wrist electronic watch-type time keeping device 1 by the movement of the user's arm. As a result, a power is generated by the use of energies related to the user's activities, and the thus generated power drives the time keeping device 1.

The power source unit B includes a rectifying circuit 47 for converting the alternating power generated in the power generation unit A to a direct power, a high-capacity capacitor 48 as a power storage device, and a voltage boost and drop circuit 49. The voltage boost and drop circuit 49 performs a multistage voltage boost and drop by the use of a plurality of capacitors 49*a*, 49*b* and 49*c*, and the voltage supplied to the driving unit E may be adjusted by a control signal Ø11 from the control unit C. The output voltage of the voltage boost and drop circuit 49 is also supplied to the control unit C by a monitor signal Ø12 and the output voltage is monitored thereby. The power source unit B produces VSS (the low potential side) as a power source voltage, where VDD (the high potential side) is used as the ground (reference) voltage (GND).

Then, the hands moving mechanism is described hereunder.

A stepping motor 10 used in the hands moving mechanism D is called as a pulse motor, stepping motor, stepped motor or digital motor, and is a motor driven in accordance with a pulse signal, which is largely used as an actuator in a digital control device. Lately, a small-sized and light weighted stepping motor is largely employed as an actuator for small-sized electronic devices or information devices suitable for mobile type devices. The typical examples of the above-mentioned electronic devices are the time keeping device such as an electronic timepiece, time switch, or chronograph.

The stepping motor 10 in this embodiment includes a drive coil 11 for generating a magnetic force in accordance with a drive pulse supplied by the driving unit E, a stator 12 exited by the drive coil 11, and a rotor 13 rotated by means of the magnetic field exited within the stator 12. In addition, the stepping motor 10 is a PM type (Permanent Magnet rotating type) stepping motor in which the rotor 13 is constructed by the disc type double pole permanent magnet. In the stator 12, there is provided a magnetic saturating portion 17 such that a different magnetic pole is generated in the respective pole 15 and 16 by the magnetic force generated in the drive coil 11. Furthermore, an inner notch 18 is provided in an appropriate position in the inner peripheral of the stator 12 to specify the rotating direction of the rotor 13 so as to cause a coging torque to be generated so that the rotor 13 halts at an appropriate position. The rotation of the rotor 13 in the stepping motor 10 is transferred to the respective hands of second, minute, and hour through a specific metal part by means of a toothed gear train 50 comprising a fifth gear 51 engaged in the rotor 13, a fourth gear 52, a third gear 53, a second gear 54, a minute wheel 55 and a hour wheel 56. The fifth gear 51 includes a center wheel and pinion. The fourth gear 52 includes a sweep second wheel and pinion. The third gear 53 includes a third wheel and pinion. The second gear 54 includes a center wheel and pinion. The shaft of the fourth gear is connected to the second hand 61. The shaft of the second gear 54 is connected to the minute hand 62, and the shaft of the another specific gear 56 is connected to the hour hand 63. The movement of the hands is interlocked with the rotation of the rotor 13 so as to display the time. It is possible to further connect a transmission system (not shown) for displaying year, month, and date to the toothed gear train 50.

The driving unit E supplies various kinds of drive pulse to the stepping motor 10 on the basis of the control of the control unit C. The driving unit E includes a bridge circuit comprising two p-channel MOS transistors and two n-channel MOS transistors. Furthermore, the driving unit E includes two resistors for detecting the rotation connected in parallel with the respective p-channel MOS transistors, and two p-channel MOS transistors for sampling for supplying a chopper pulse to the respective two resistors. As a result, when a control pulse with a different polarity and pulse width is applied at the respective timing from the control unit C to each of the circuit electric poles of the MOS transistors, the drive pulse with a different polarity is supplied to the drive coil, or a pulse for detecting the rotation of the rotor 13 or a detecting pulse for exiting an induced voltage to detect magnetic field is supplied to the drive coil.

[1.2] Structure of the Control Unit

Figure 2:
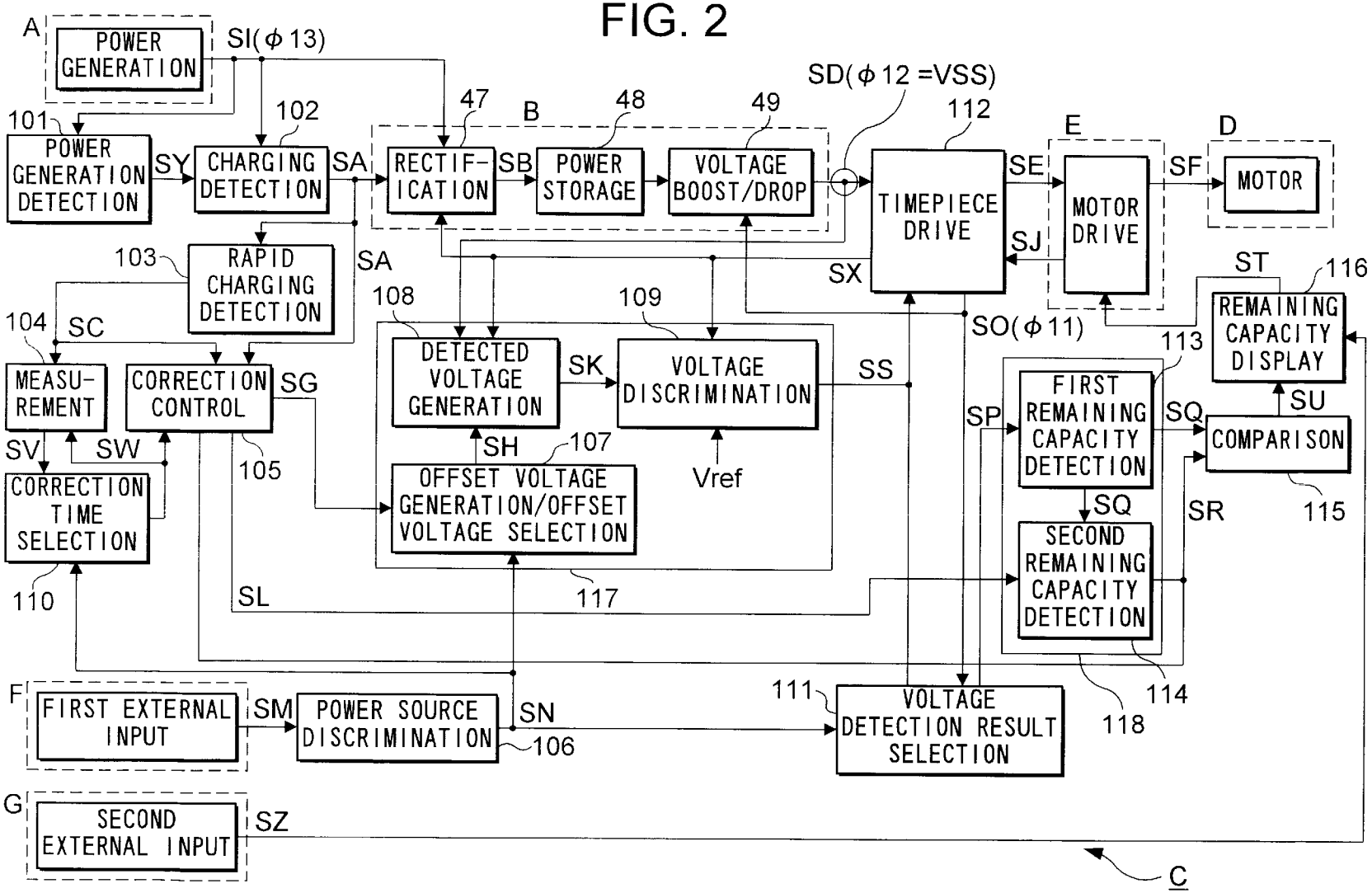
FIG. 2 is a functional block diagram illustrating a control unit and periphery components thereof according to the first embodiment.

The structure of the control unit C is described with reference to FIG. 2. FIG. 2 is a functional block of the control unit C and the peripheral thereof.

The control unit C, which detects a power generation based on a power generation voltage SI in the power generation unit A, includes: a power generation detection unit 101 for outputting a power generation detection signal SY; a charging detection unit 102 for implementing the charging detection based on the power generation voltage SI and the power generation detection signal SY to output a charging detection signal SA; a rapid charging detection unit 103 for implementing the rapid charging detection based on the charging detection signal SA to output a rapid charging detection signal SC; a measuring unit 104 for producing a correction time signal SV based on the rapid charging detection signal SC and a non-rapid charging time measurement completion signal SW mentioned later to output same; a correction control unit 105 for outputting a voltage detection correction signal SG and a remaining voltage display rank-up inhibition signal SL based on the charging detection signal SA, the rapid charging detection signal SC, the non-rapid charging time measurement completion signal SW, and a second remaining amount display detection signal SR mentioned later; a power source discrimination unit 106 for outputting a power source discrimination signal SN based on an external input signal SM input from the first external input unit F; and an offset voltage generation/offset voltage selection unit 107 for generating an offset voltage based on the voltage detection correction signal SG and the power source discrimination signal SN, and selecting the offset voltage SH to output same.

Furthermore, the control unit C includes: a detected voltage generation unit 108 for generating a detected voltage SK based on a stored power voltage boost and drop resultant voltage SD output from the power source unit B, a voltage detection timing signal SX and the offset voltage SH to output same; a power discrimination unit 109 for generating a voltage detection result signal SS based on the detected voltage SK, the voltage detection timing signal SX and a reference voltage Vref to output same; a correction time selection unit 110 for outputting the non-rapid charging time measurement completion signal SW based on the correction time signal SV and the power source discrimination signal SN; a voltage detection resultant selection unit 111 for outputting a voltage detection result selection signal SP based on a voltage detection result signal SS, a voltage boost and drop control signal SO mentioned later and the power source discrimination signal SN; a timepiece driving unit 112 for outputting the voltage boost and drop control signal SO, the voltage detection timing signal SX and a motor drive control signal SE based on a motor drive generating induced voltage SJ from the driving unit E, the stored power voltage boost and drop result voltage SD and the voltage detection result signal SS; a first remaining voltage detection unit 113 for outputting a first remaining voltage display detection signal SQ based on the voltage detection result selection signal SP; a second remaining voltage detection unit 114 for outputting a second remaining voltage display detection signal SR based on the first remaining voltage display detection signal SQ and the remaining voltage display rank-up inhibition signal SL; a comparison unit 115 for outputting a remaining voltage display comparison result signal SU based on the first remaining voltage display detection signal SQ and the second remaining voltage display detection signal SR; and a remaining voltage display unit 116 for outputting a remaining voltage display signal ST based on the remaining voltage display comparison result signal SU and an external input signal SZ input from the second external input unit G.

In this case, the detected voltage generation unit 108, the power discrimination unit 109 and the offset voltage generation/offset voltage selection unit 107 function as a voltage detection unit 117, and the first remaining voltage detection unit 113 and the second remaining voltage detection unit 114 function as a remaining voltage detection unit 118.

Figure 3:
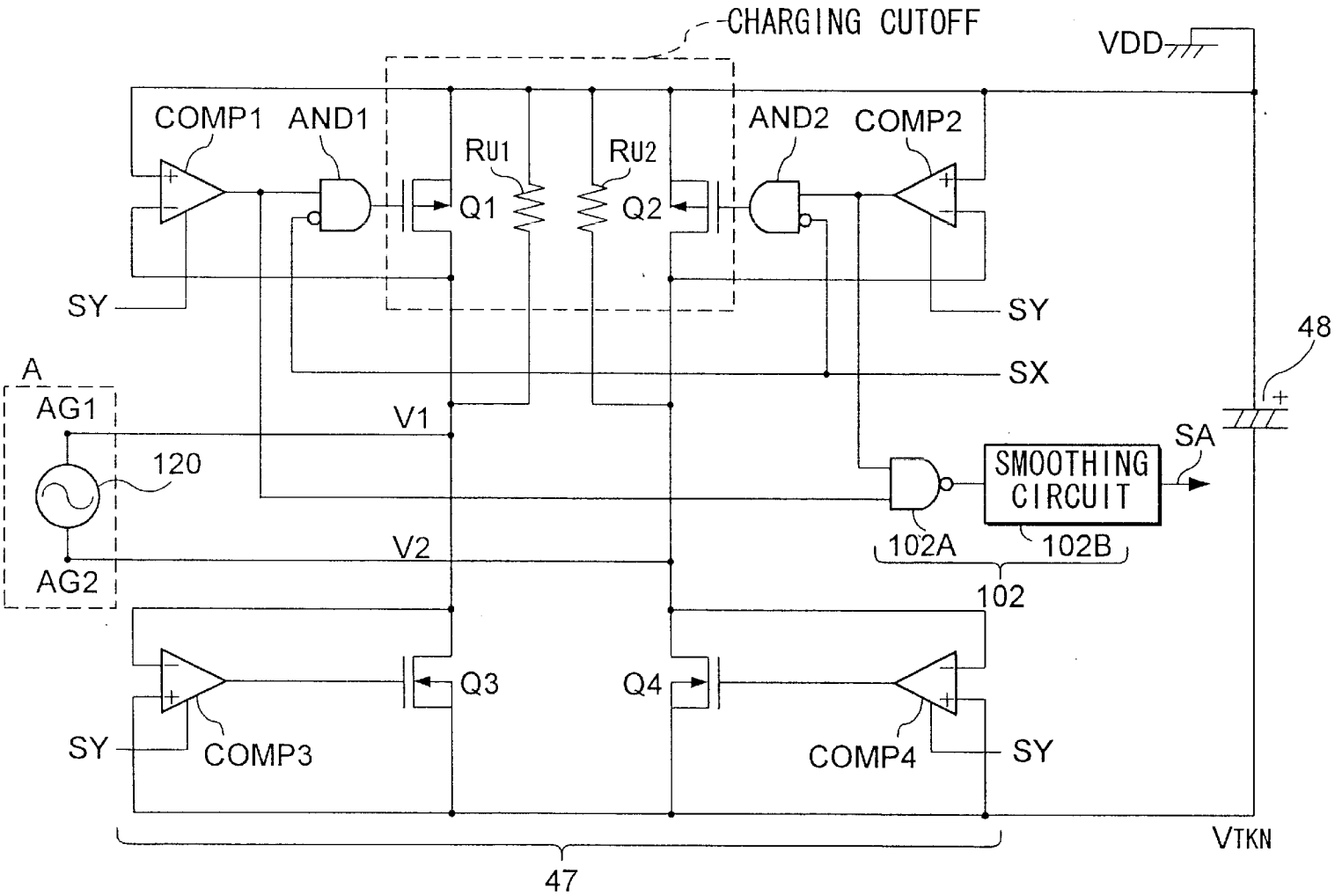
FIG. 3 is a detailed diagram illustrating a rectification circuit and a charging detection unit with periphery components thereof.

FIG. 3 shows a detailed construction of the rectifying circuit and the peripheral of the charging detection unit.

The rectifying circuit 47 includes: a comparator COMP1 in which a high potential side power source VDD is input into one input terminal thereof, while a voltage V1 in one out put terminal AG1 of a power generator 120 constructing the power generation unit A is applied to the other input terminal thereof, to be in a operative condition based on a power generation detection signal SY only when the power is generated so as to output a compared result; a AND circuit AND1 in which an output signal of the comparator COM1 is input into one input terminal thereof, and an inversion signal of the voltage detection timing signal SX is input into the other input terminal thereof; a p-channel MOS transistor Q1 which is turned ON/OFF based on an output signal of the AND circuit AND1; a comparator COMP2 in which a high potential side power source VDD is input into one input terminal thereof, while a voltage V2 in the other output terminal AG2 of a power generator 120 constructing the power generation unit A is applied to the other input terminal thereof, to be in a operative condition based on a power generation detection signal SY only when the power is generated so as to output a compared result; a AND circuit AND2 in which an output signal of the comparator COM2 is input into one input terminal thereof, and an inversion signal of the voltage detection timing signal SX is input into the other input terminal thereof; a p-channel MOS transistor Q2 which is turned ON/OFF based on an output signal of the AND circuit AND2; a pull-up resistor RU1 which is connected between the output terminal AG1 of the power generator 120 and the high potential side power source Vdd; and a pull-up resistor RU2 which is connected between the output terminal AG2 of the power generator 120 and the high potential side power source Vdd.

Furthermore, the rectifying circuit 47 includes: a comparator COMP3 in to which a low voltage side power source VTKN is input into one input terminal thereof, while a voltage V1 in one out put terminal AG1 of a power generator 120 constructing the power generation unit A is applied to the other input terminal thereof, to be in a operative condition based on a power generation detection signal SY only when the power is generated so as to output a compared result; a n-channel MOS transistor Q3 which is turned ON/OFF based on an output signal of the comparator COMP3; a comparator COMP4 in which a low potential side power source VTKN is input into one input terminal thereof, while a voltage V2 in the other output terminal AG2 of a power generator 120 constructing the power generation unit A is applied to the other input terminal thereof, to be in a operative condition based on a power generation detection signal SY only when the power is generated so as to output a compared result; and a n-channel MOS transistor Q4 which is turned ON/OFF based on an output signal of the comparator COMP4.

In this case, p-channel MOS transistors Q1, Q2 function as a charge-breaking means.

The charging detection unit 102 includes: a NAND circuit 102A in which the output signal of the comparator COMP1 is input into one input terminal thereof and the output signal of the comparator COMP2 is input into the other input terminal thereof, to output a NOT of AND of both output signals; and a smoothing circuit 10 for smoothing the output signal of the NAND circuit 102A to output as the charging detection signal SA.

Then, the operation of the rectifying circuit and the peripheral of the charging detection unit are described hereunder.

(1) The Case of V1>VDD>VTKN

When the power generation unit A starts generating power, the generated power is supplied to both of the output terminals AG1, AG2. In this case, the phase is inverted between the terminal voltage V1 of the output terminal AG1 and the terminal voltage V2 of the output terminal AG2.

The comparator COMP1 of the rectifying circuit 47 is to be in a operative condition based on the power generation detection signal SY only when the power is generated, to compare the voltage of the high potential side power source VDD and the voltage V1 of the output terminal AG1, thus outputting the comparative result of the "L" level when the voltage V1 of the output terminal AG1 becomes higher than the voltage of the high potential side power source VDD. On this occasion, the AND circuit AND1 outputs the signal in the "L" level to the p-channel MOS transistor Q1, and the p-channel MOS transister Q1 becomes to be in a state of ON.

The comparator COMP2 is to be in a operative condition based on the power generation detection signal SY only when the power is generated, to compare the voltage of the high potential side power source VDD and the voltage V2 of the output terminal AG2, thus outputting the comparative result of the "H" level, since the voltage V2 of the output terminal AG2 is lower than the voltage of the high potential side power source VDD.

On this occasion, when the voltage detection timing signal SX input into the AND circuit AND2 becomes "L" level (i.e., corresponding to non-voltage detection timing), the AND circuit AND2 outputs the signal in the "H" level to the p-channel MOS transistor Q2, and the p-channel MOS transistor Q2 becomes to be in a state of OFF.

On the other hand, the comparator COMP3 is to be in a operative condition based on the power generation detection signal SY only when the power is generated, to compare the voltage of the low potential side power source VTKN and the voltage V1 of the output terminal AG1, thus outputting the comparative result of the "L" level, when the voltage V1 of the output terminal AG1 becomes higher than the voltage of the low potential side power source VTKN, and the n-channel MOS transistor Q3 becomes to be in a state of OFF.

Furthermore, the comparator COMP4 is to be in a operative condition based on the power generation detection signal SY only when the power is generated, to compare the voltage of the low potential side power source VTKN and the voltage V2 of the output terminal AG2, thus outputting the comparative result of the "H" level, when the voltage V2 of the output terminal AG2 becomes lower than the voltage of the low potential side power source VTKN, and the n-channel MOS transistor Q4 becomes to be in a state of ON.

As a result, the charging current by means of generation flows along the route of the terminal AG1-the first transistor Q1-the high potential side power Rho source VDD-the power storage device 48-the low potential side power source VTKN-the fourth transistor Q4-the terminal AG2 to charge the power storage device 48.

(2) The Case of V2>VDD>VTKN>V1

When the power generation unit A starts generating power, the generated power is supplied to both of the output terminals AG1, AG2. In this case, the phase is inverted between the terminal voltage V1 of the output terminal AG1 and the terminal voltage V2 of the output terminal AG2.

The comparator COMP1 of the rectifying circuit 47 is to be in a operative condition based on the power generation detection signal SY only when the power is generated, to compare the voltage of the high potential side power source VDD and the voltage V1 of the output terminal AG1, thus outputting the comparative result of the "H" level when the voltage V1 of the output terminal AG1 becomes lower than the voltage of the high potential side power source VDD.

On this occasion, when the voltage detection timing signal SX input into the AND circuit AND1 becomes "L" level (i.e., corresponding to non-voltage detection timing), the AND circuit AND1 outputs the signal in the "H" level to the p-channel MOS transistor Q1, and the p-channel MOS transistor Q1 becomes to be in a state of OFF Furthermore, the comparator COMP2 is to be in a operative condition based on the power generation detection signal SY only when the power is generated, to compare the voltage of the high potential side power source VDD and the voltage V2 of the output terminal AG2, thus outputting the comparative result of the "L" level, when the voltage V2 of the output terminal AG2 is higher than the voltage of the high potential side power source VDD.

On this occasion, the AND circuit AND2 outputs the signal in the "L" level to the p-channel MOS transistor Q2, and the p-channel MOS transistor Q2 becomes to be in a state of ON.

On the other hand, the comparator COMP3 is to be in a operative condition based on the power generation detection signal SY only when the power is generated, to compare the voltage of the low potential side power source VTKN and the voltage V1 of the output terminal AG1, thus outputting the comparative result of the "H" level, when the voltage V1 of the output terminal AG1 becomes lower than the voltage of the low potential side power source VTKN, and the n-channel MOS transistor Q3 becomes to be in a state of ON.

Furthermore, the comparator COMP4 is to be in a operative condition based on the power generation detection signal SY only when the power is generated, to compare the voltage of the low potential side power source VTKN and the voltage V2 of the output terminal AG2, thus outputting the comparative result of the "L" level, when the voltage V2 of the output terminal AG2 becomes higher than the voltage of the low potential side power source VTKN, and the n-channel MOS transistor Q4 becomes to be in a state of OFF.

As a result, the charging current by means of generation flows along the route of the terminal AG2-the second transistor Q2-the high potential side power source VDD-the power storage device 48-the low potential side power source VTKN-the third transistor Q3-the terminal AG1 to charge the power storage device 48.

(3) The Case of SX="H" Level

When the voltage detection timing signal SX becomes the "H" level, namely, when detecting the voltage of the power storage device 48, the AND circuit AND1 and the AND circuit AND2 output the signal in the "L" level. Accordingly, p-channel MOS transistor Q1 and the p-channel MOS transistor Q2 function as a charge-breaking means, thus both of the transistors are in the state of ON so that the output terminal AG1 of the power generator 120 and the output terminal AG2 become in a state of the short-circuit. Therefore, it is possible to implement the voltage detection without being affected by the power generating condition of the generator 120 when the voltage of the power storage device 48 is detected.

(4) Operation of the Charging Detecting Unit

As described above, when the generated current flows, either the output of the comparator COM1 or the output of the comparator COM2 is "L" level.

The NAND circuit 102A of the charging detection unit 102, by means of effecting NOT of AND of the output of the comparator COM1 and the output of the comparator COM2, outputs a "H" level original charging detection signal to the smoothing circuit 102B under the condition that the charging current by the generation flows.

In this case, since the output of the NAND circuit 102A contains a switching noise, the smoothing circuit smoothes the output of the NAND circuit 102A by the use of a R-C integrating circuit to the charging detecting signal SA.

It is possible, in place of effecting NOT of AND of the output of the comparator COM1 and the output of the comparator COM2, to effect OR of the output of the comparator COMP3 and the output of the comparator COMP4, or to effect OR of NOT of the output of the comparator COMP1 and NOT of the output of the comparator COMP2 so as to produce the original charging detection signal.

Figure 4:
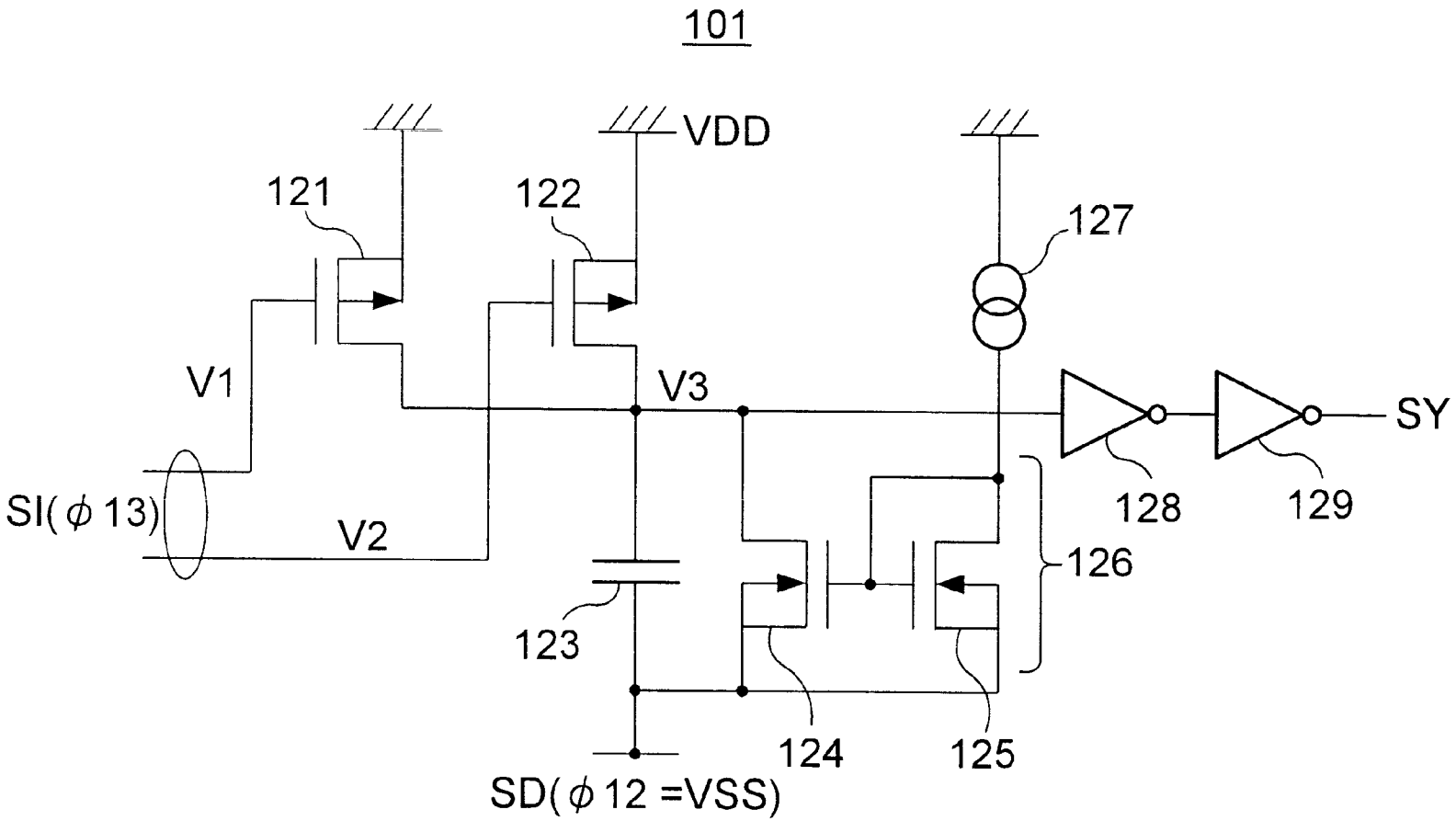
FIG. 4 is a detailed diagram illustrating a power generation detection unit.

FIG. 4 shows a detailed construction of the power generation detection unit.

The power generation detection unit 101 includes a p-channel MOS transistor 121 in which the source is connected to the high potential side power source VDD, and the voltage V1 of one of the output terminal AG1 of the power generator 120 constructing the power generation unit A is applied to the circuit; a p-channel MOS transistor 122 in which the source is connected to the high potential side power source VDD, the voltage V2 of the other output terminal AG2 of the power generator 120 constructing the power generating unit A is applied to the circuit, and the drain terminal thereof is connected to the drain terminal of the p-channel MOS transistor 121; a capacitor 123 in which one end thereof is connected to the drain terminal of the p-channel MOS transistor 121 and the other end thereof is connected to the drain terminal of the p-channel MOS transistor 122; a current mirror circuit 126 constructed by two n-channel MOS transistors 124, 125; a constant current source 127 in which one end thereof is connected to the high potential side power source VDD, and the other end thereof is connected to the drain terminal of the n-channel MOS transistor 125 constructing the current mirror circuit; a inverter 128 in which the input terminal thereof is commonly connected to the drain terminal of the p-channel MOS transistor 121, the drain terminal of the p-channel MOS transistor 122, one end of the capacitor 123 and the drain terminal of the n-channel MOS transistor 124, and a inverter 129 in which the output signal of the inverter 128 is inverted to output the power generation detection signal SY Then, the operation of the charging detection unit is described hereunder.

(1) The Time of Power Generation

When the power is generated, either the output terminal AG1 or the output terminal AG2 of the power generator 120 becomes the "L" level.

Accordingly, either the p-channel MOS transistor 121 or the p-channel MOS transistor 122 becomes the state of ON.

As a result, the charging current flows along the route of the high potential side power source VDD-the p-channel MOS transistor 121 or the p-channel MOS transistor 122-the capacitor 123-the low potential side power source VSS, thus the capacitor becomes the charging state.

When the charging voltage V3 exceeds a threshold voltage of the inverter 128, the inverter 128 outputs the signal in "L" level to the inverter 129.

The inverter 129 then outputs the power generation detection signal SY in "H" level.

The excess current after the capacitor comes to the state of fully charged is flowed to the low potential side power source VSS in the same amount as the amount of the constant current which flows in the n-channel MOS transistor 125 by the constant current source 127, through the n-channel MOS transistor 124 constructing the current mirror circuit.

(2) The Time of Non-power Generation

When the power is not generated, both of the output terminal AG1 and the output terminal AG2 of the power generator 120 become the "H" level.

Accordingly, both of the p-channel MOS transistor 121 and the p-channel MOS transistor 122 become the state of OFF.

As a result, when the capacitor 123 is in the state of charging, the discharging current flows along the route of one of the terminals of the capacitor 123-the n-channel MOS transistor 124-the low potential side power source VSS-the other terminal of the capacitor 123. Then, the charging voltage V3 of the capacitor becomes below the threshold voltage of the inverter 128, and the inverter 128 outputs the signal in "H" level to the inverter 129.

The inverter 129 then outputs the power generation detection signal SY in "L" level.

Figure 5A:
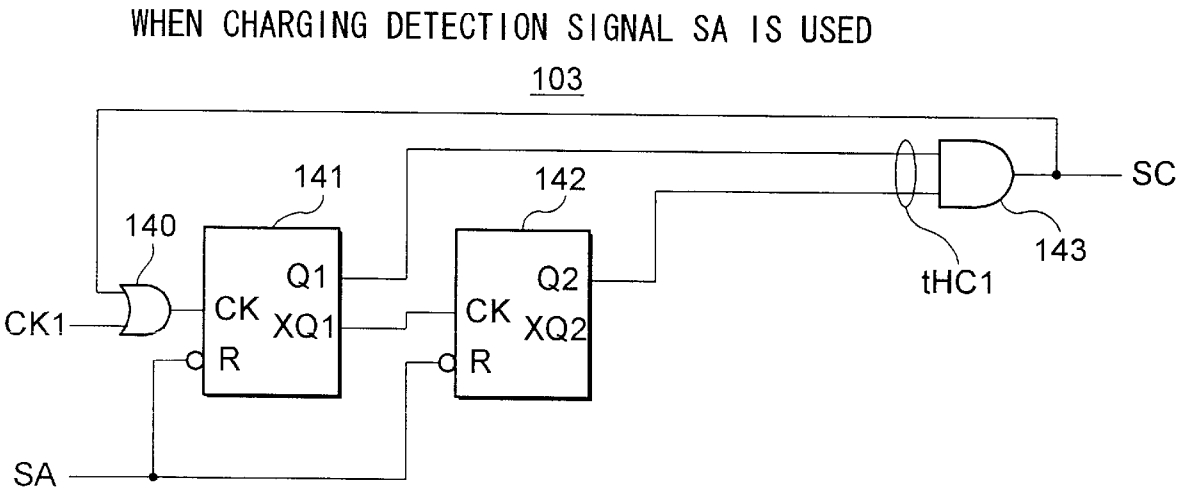
FIGS. 5*a* and 5*b* are detailed diagrams each illustrating a rapid charging detection unit.
Figure 5B:
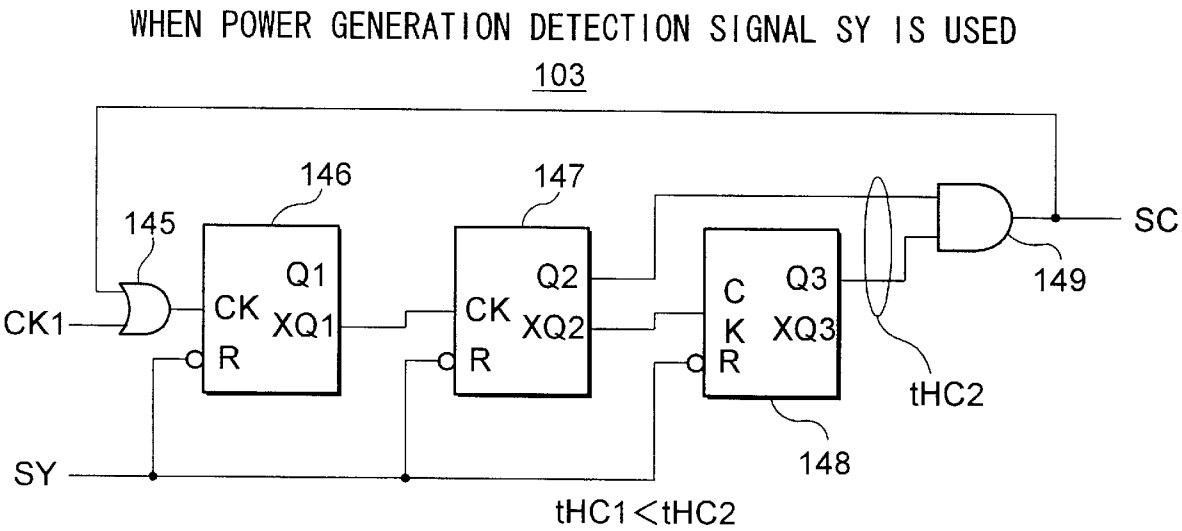

FIG. 5 shows a detailed construction of the rapid charging detection unit. The case in which the rapid charging detection signal SC is produced by the use of the charging detection signal SA, and the case in which the rapid charging detection signal SC is produced by the use of the power generation detection signal SY are described hereunder.

FIG. 5(*a*) shows a detailed construction of the rapid charging detection unit 103 in the case in which the rapid charging detection signal SC is produced by the use of the charging detection signal SA.

The rapid charging detection unit 103 includes a OR circuit in which the first clock signal XCK1 from the time piece drive unit 112 is input to one input terminal thereof, the rapid charging detection signal SC is input to the other input terminal thereof, and OR of both input signals is effected so as to output the result; a flip-flop circuit 141 in which the output signal of the OR circuit 140 is input to the clock terminal CK, and the inverse signal of the charging detection signal SA is input to the reset terminal R; a flip-flop circuit 142 in which an inverse output terminal XQ1 of the flip-flop circuit 141 is connected to the clock terminal CK, and the inverse signal of the charging detection signal SA is input to the reset terminal R; and the AND circuit 143 in which the output terminal Q1 of the flip-flop circuit 141 is connected to one of the input terminals thereof, the output terminal Q2 of the flip-flop circuit 142 is connected to the other input terminal thereof, and AND of both input signals is effected so as to output the result as the rapid charging detection signal SC.

Here, the flip-flop circuits 141, 142 form a counter. In this case, it is established that the rapid charging detecting signal SC becomes the state of detecting the rapid charging (="H" level), in case that the period in which the charging detection signal becomes "H" level continuously exceeds the time tHC1. The reason thereof is that even if the charging is detected, that does not immediately mean the transition to the rapid charging state.

Figure 24A:
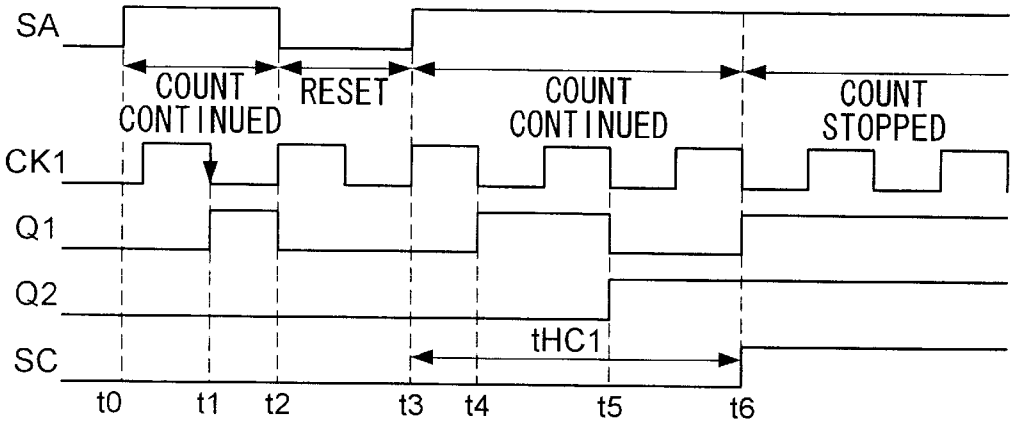
FIGS. 24*a* and 24*b* are diagrams each illustrating a rapid charging detection signal generation operation.
Figure 24B:
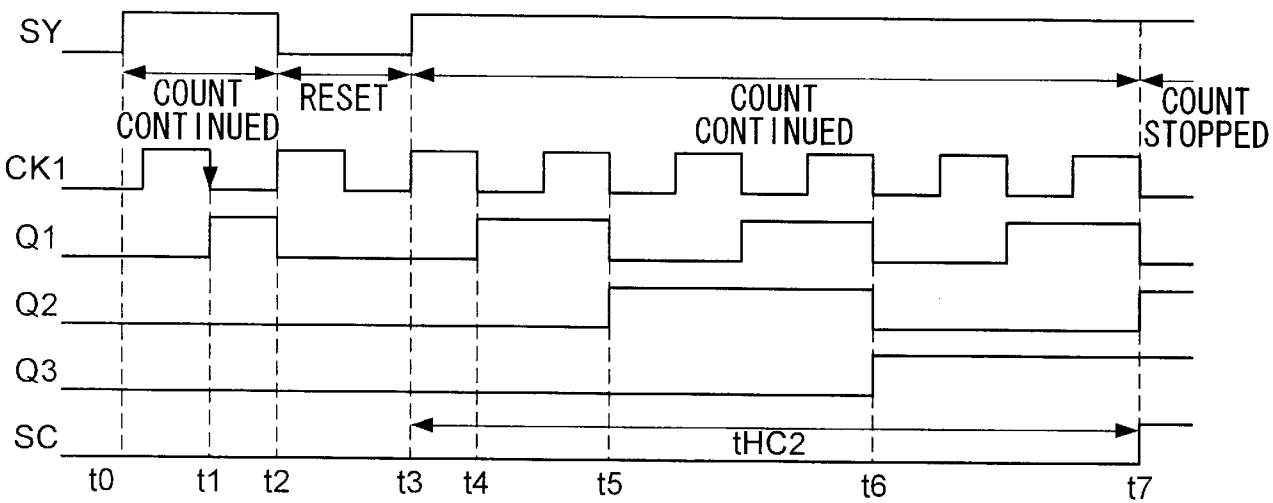

Then, the operation in the case in which the rapid charging detection signal SC is produced by the use of the charging detection signal SA is described with reference to FIG. 24(*a*).

When the charging detection signal SA becomes "H" level at the time t0, the output terminal Q1 becomes "H" level, detecting the fall of the first clock signal CK1 at the time t1. However, since the charging detection signal SA becomes "L" level at the time t2, the output terminal Q1 becomes "L" level again, being the state of reset.

Later, when the charging detection signal SA becomes "H" level again at the time t3, the flip-flop circuit 141 detects the fall of the first clock signal CK1 at the time t4, to cause the output terminal Q1 of the flip-flop circuit 141 to be "H" level.

Then, when the fall of the first clock signal CK1 is detected at the time t5, the signal level of the output terminal Q1 of the flip-flop circuit 141 is incorporated into the flip-flop circuit 142 to cause the output terminal Q2 of the flip-flop circuit 142 to be "H" level.

Furthermore, when the fall of the first clock signal is detected again at the time t6, the signal level of both of the output terminal Q1 and the output terminal Q" becomes "H" level, and the rapid charging detection signal SC which is the output of the AND circuit 143 becomes "H" level which corresponds to the case in which the rapid charging is detected. Here, the time required from time t3 to t6 is equal to the time tHC1.

FIG. 5(*b*) shows a detailed construction of the rapid charging detection unit 103 in the case in which the rapid charging detection signal SC is produced by the use of the power generation detection signal SY.

The rapid charging detection unit 103 includes a OR circuit 145 in which the first clock signal XCK1 from the time piece drive unit 112 is input to one input terminal thereof, the rapid charging detection signal SC is input to the other input terminal thereof, and OR of both input signals is effected so as to output the result; a flip-flop circuit 146 in which the output signal of the OR circuit 145 is input to the clock terminal CK, and the inverse signal of the power generation detection signal SY is input to the reset terminal R; a flip-flop circuit 147 in which an inverse output terminal XQ1 of the flip-flop circuit 146 is connected to the clock terminal CK, and the inverse signal of the power generation detection signal SY is input to the reset terminal R; a flip-flop circuit 148 in which an inverse output terminal XQ2 of the flip-flop circuit 147 is connected to the clock terminal CK, and the inverse signal of the power generation detection signal SY is input to the reset terminal R; and the AND circuit 149 in which the output terminal Q2 of the flip-flop circuit 147 is connected to one of the input terminals thereof, the output terminal Q3 of the flip-flop circuit 148 is connected to the other input terminal thereof, and AND of both input signals is effected so as to output the result as the rapid charging detection signal SC.

Here, the flip-flop circuits 146 to 148 form a counter. In this case, the rapid charging detection unit shown in FIG. 5(*b*) has one more stage of flip-flop circuit than the rapid charging detection unit shown in FIG. 5(*a*). The reason thereof is that even if the power generation is detected, that does not necessarily mean that the rapid charging is to be implemented. More specifically, the detection state is shown more easily in the detection of the power generation than in the detection of the charging.

Accordingly, under the same condition as the detection of the rapid charging with the use of the charging detection (i.e., the same circuit construction), it is probable that the rapid charging detection state is frequently shown in spite of the condition that the rapid charging is not implemented. In order to avoid the above problem, one more stage of flip-flop circuit is provided so as to establish a severe condition to detect the rapid charging.

Then, the operation in the case in which the rapid charging detection signal SC is produced by the use of the power generation detection signal SY is described with reference to FIG. 24(*b*).

When the power generation detection signal SY becomes "H" level at the time t0, the output terminal Q1 of the flip-flop circuit 146 becomes "H" level, detecting the fall of the first clock signal CK1 at the time t1. However, since the power generation detection signal SY becomes "L" level at the time t2, the output terminal Q1 becomes "L" level again, being the state of reset.

Later, when the power generation detection signal SY becomes "H" level again at the time t3, the flip-flop circuit 146 detects the fall of the first clock signal CK1 at the time t4, to cause the output terminal Q1 of the flip-flop circuit 146 to be "H" level.

Then, when the fall of the first clock signal CK1 is detected at the time t5, the signal level of the output terminal Q1 of the flip-flop circuit 146 is incorporated into the flip-flop circuit 147 to cause the output terminal Q2 of the flip-flop circuit 147 to be "H" level.

In the same manner, when the fall of the first clock signal CK1 is detected at the time t6, the signal level of the output terminal Q1 of the flip-flop circuit 146 is incorporated into the flip-flop circuit 147, and the signal level of the output terminal Q2 of the flip-flop circuit 147 is incorporated into the flip-flop circuit 148, to cause the output terminal Q3 of the flip-flop circuit 148 to be "H" level.

The count is further continued, and when the fall of the first clock signal is detected again at the time t7, the signal level of both of the output terminal Q2 and the output terminal Q3 becomes "H" level, and the rapid charging detection signal SC which is the output of the AND circuit 149 becomes "H" level which corresponds to the case in which the rapid charging is detected.

Here, the time required from time t3 to t7 is equal to the time tHC2(>tHC1).

Figure 6:
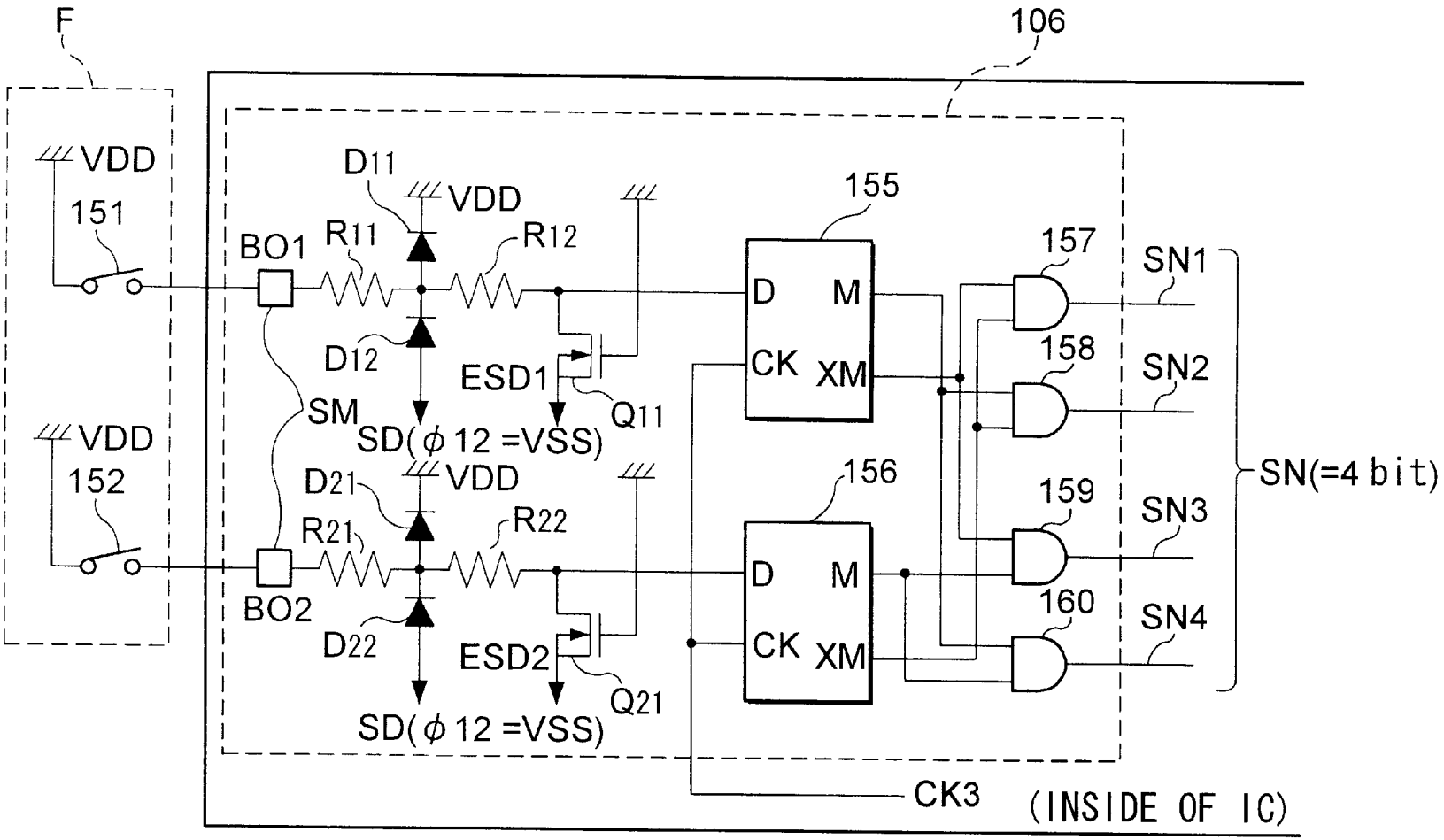
FIG. 6 is a detailed diagram illustrating a first external input unit and a power source discrimination unit.

FIG. 6 is a detailed diagram illustrating the first external input unit and the power source discrimination unit.

The first external input unit F includes: a switch 151 one end of which is connected to the high potential side power source VDD, with the other end thereof connected to a first external input terminal BO1 of the power source discrimination unit 106; and a switch 152 one end of which is connected to the high potential side power source VDD, with the other end thereof connected to a second external input terminal BO2 of the power source discrimination unit 106. Therefore, by the various combinations of the ON/OFF states of the switch 151 and the switch 152, four different inputs can be set.

The power source discrimination unit 106 includes: a resistor R11 one end of which is connected to the first external input terminal; a resistor R12 which is connected in series with the resistor R11; a diode D11 whose cathode is connected to the high potential side power source VDD, with the anode thereof connected to the node between the resistor R11 and the resistor R12; a diode D12 whose anode is connected to the low potential side power source VSS with the cathode thereof connected to the node between the resistor R11 and the resistor R12; an N-channel MOS transistor Q11 whose gate is connected to the high potential side power source with the drain thereof connected to one end of the resistor R12 and the source thereof connected to the low potential side power source VSS; a first flip-flop circuit 155 whose data terminal D is connected to the drain terminal of the N-channel MOS transistor Q11, with the clock terminal CK thereof receiving as its input the third clock signal CK3 from the timepiece driving unit 112; a resistor R21 one end of which is connected to the second external input terminal; a resistor R22 which is connected in series with the resistor R21; a diode D21 whose cathode is connected to the high potential side power source VDD, with the anode thereof connected to the node between the resistor R21 and the resistor R22; a diode D22 whose anode is connected to the low potential side power source VSS with the cathode thereof connected to the node between the resistor R21 and the resistor R22; an N-channel MOS transistor Q21 whose gate is connected to the high potential side power source with the drain thereof connected to one end of the resistor R22 and the source thereof connected to the low potential side power source VSS; and a second flip-flop circuit 156 whose data terminal D is connected to the drain terminal of the N-channel MOS transistor Q21, with the clock terminal CK thereof receiving as its input the third clock signal CK3 from the timepiece driving unit 112. The power source discrimination unit 106 further includes: an AND circuit 157 one input terminal of which is connected to the inverted output terminal XM of the first flip-flop circuit 155, with the other input terminal thereof connected to the inverted output terminal XM of the second flip-flop circuit 156, so as to obtain the logical product (AND) of the input signals and to output the obtained logical product as a 1-bit signal SN1 which forms a part of a 4-bit power source discrimination signal SN; an AND circuit 158 one input terminal of which is connected to the output terminal M of the first flip-flop circuit 155, with the other input terminal thereof connected to the inverted output terminal XM of the second flip-flop circuit 156, so as to obtain the logical product (AND) of the input signals and output the obtained logical product as a 1-bit signal SN2 which forms a part of the 4-bit power source discrimination signal SN; an AND circuit 159 one input terminal of which is connected to the inverted output terminal XM of the first flip-flop circuit 155, with the other input terminal thereof connected to the output terminal M of the second flip-flop circuit 156, so as to obtain the logical product (AND) of the input signals and output the obtained logical product as a 1-bit signal SN3 which forms a part of the 4-bit power source discrimination signal SN; and an AND circuit 160 one input terminal of which is connected to the output terminal M of the first flip-flop circuit 155, with the other input terminal thereof connected to the output terminal M of the second flip-flop circuit 156, so as to obtain the logical product (AND) of the input signals and output the obtained logical product as a 1-bit signal SN4 which forms a part of the 4-bit power source discrimination signal SN.

In such a configuration, the resistor R11 , the resistor R12, the diode D11 and the diode D12 together form a first surge current protection circuit ESD1 for providing a protection from a surge current, whereas the resistor R21, the resistor R22, the diode D21 and the diode D22 together form a second surge current protection circuit ESD2 for providing a protection from a surge current.

The power source discrimination unit 106 is integrated within an IC.

The operation of the power source discrimination unit will now be described. In the following description, the function of the surge current protection circuits ESD1 and ESD2 will be ignored for the sake of simplicity.

(1) Case Where Switch 151=OFF and Switch 152=OFF

Where the switch 151=OFF and the switch 152=OFF, the data terminal D of the first flip-flop circuit 155 of the power source discrimination unit 106 is at an "L" level (=the level of the low potential side power source VSS) and the data terminal D of the second flip-flop circuit 156 is at the "L" level (=the level of the low potential side power source VSS).

As a result, at a data reception timing corresponding to the third clock signal CK3 from the timepiece driving unit 112 received at the clock terminal CK, the output terminal M and the inverted output terminal XM of the first flip-flop circuit 155 are at the "L" level and an "H" level, respectively.

Similarly, at a data reception timing corresponding to the third clock signal CK3 from the timepiece driving unit 112 received at the clock terminal CK, the output terminal M and the inverted output terminal XM of the second flip-flop circuit 156 are at the "L" level and the "H" level, respectively.

Therefore, the signal SN1 output from the AND circuit 157 is at the "H" level while the signals SN2 to SN4 respectively output from the AND circuits 158 to 160 are all at the "L" level, whereby the output power source discrimination signal SN="1000", corresponding to the signal SN1="H" level.

(2) Case Where Switch 151=ON and Switch 152=OFF

Where the switch 151=ON and the switch 152=OFF, the data terminal D of the first flip-flop circuit 155 of the power source discrimination unit 106 is at the "H" level (=the level of the high potential side power source VDD) and the data terminal D of the second flip-flop circuit 156 is at the "L" level (=the level of the low potential side power source VSS).

As a result, at a data reception timing corresponding to the third clock signal CK3 from the timepiece driving unit 112 received at the clock terminal CK, the output terminal M and the inverted output terminal XM of the first flip-flop circuit 155 are at the "H" level and the "L" level, respectively.

On the other hand, at a data reception timing corresponding to the third clock signal CK3 from the timepiece driving unit 112 received at the clock terminal CK, the output terminal M and the inverted output terminal XM of the second flip-flop circuit 156 are at the "L" level and the "H" level, respectively.

Therefore, the signal SN2 output from the AND circuit 158 is at the "H" level while the signals SN1, SN3 and SN4 respectively output from the AND circuits 157, 159 and 160 are all at the "L" level, whereby the output power source discrimination signal SN="0100", corresponding to the signal SN2="H" level.

(3) Case Where Switch 151=OFF and Switch 152=ON

Where the switch 151=OFF and the switch 152=ON, the data terminal D of the first flip-flop circuit 155 of the power source discrimination unit 106 is at the "L" level (=the level of the low potential side power source VSS) and the data terminal D of the second flip-flop circuit 156 is at the "H" level (=the level of the high potential side power source VDD).

As a result, at a data reception timing corresponding to the third clock signal CK3 from the timepiece driving unit 112 received at the clock terminal CK, the output terminal M and the inverted output terminal XM of the first flip-flop circuit 155 are at the "L" level and the "H" level, respectively.

On the other hand, at a data reception timing corresponding to the third clock signal CK3 from the timepiece driving unit 112 received at the clock terminal CK, the output terminal M and the inverted output terminal XM of the second flip-flop circuit 156 are at the "H" level and the "L" level, respectively.

Therefore, the signal SN3 output from the AND circuit 159 is at the "H" level while the signals SN1, SN2 and SN4 respectively output from the AND circuits 157, 158 and 160 are all at the "L" level, whereby the output power source discrimination signal SN="0010", corresponding to the signal SN3="H" level.

(4) Case Where Switch 151=ON and Switch 152=ON

Where the switch 151=ON and the switch 152=ON, the data terminal D of the first flip-flop circuit 155 of the power source discrimination unit 106 is at the "H" level (=the level of the high potential side power source VDD) and the data terminal D of the second flip-flop circuit 156 is at the "H" level (=the level of the high potential side power source VDD).

As a result, at a data reception timing corresponding to the third clock signal CK3 from the timepiece driving unit 112 received at the clock terminal CK, the output terminal M and the inverted output terminal XM of the first flip-flop circuit 155 are at the "H" level and the "L" level, respectively.

Similarly, at a data reception timing corresponding to the third clock signal CK3 from the timepiece driving unit 112 received at the clock terminal CK, the output terminal M and the inverted output terminal XM of the second flip-flop circuit 156 are at the "H" level and the "L" level, respectively.

Therefore, the signal SN4 output from the AND circuit 160 is at the "H" level while the signals SN1 to SN3 respectively output from the AND circuits 157 to 159 are all at the "L" level, whereby the output power source discrimination signal SN="0001", corresponding to the signal SN4= "H" level.

Figure 7:
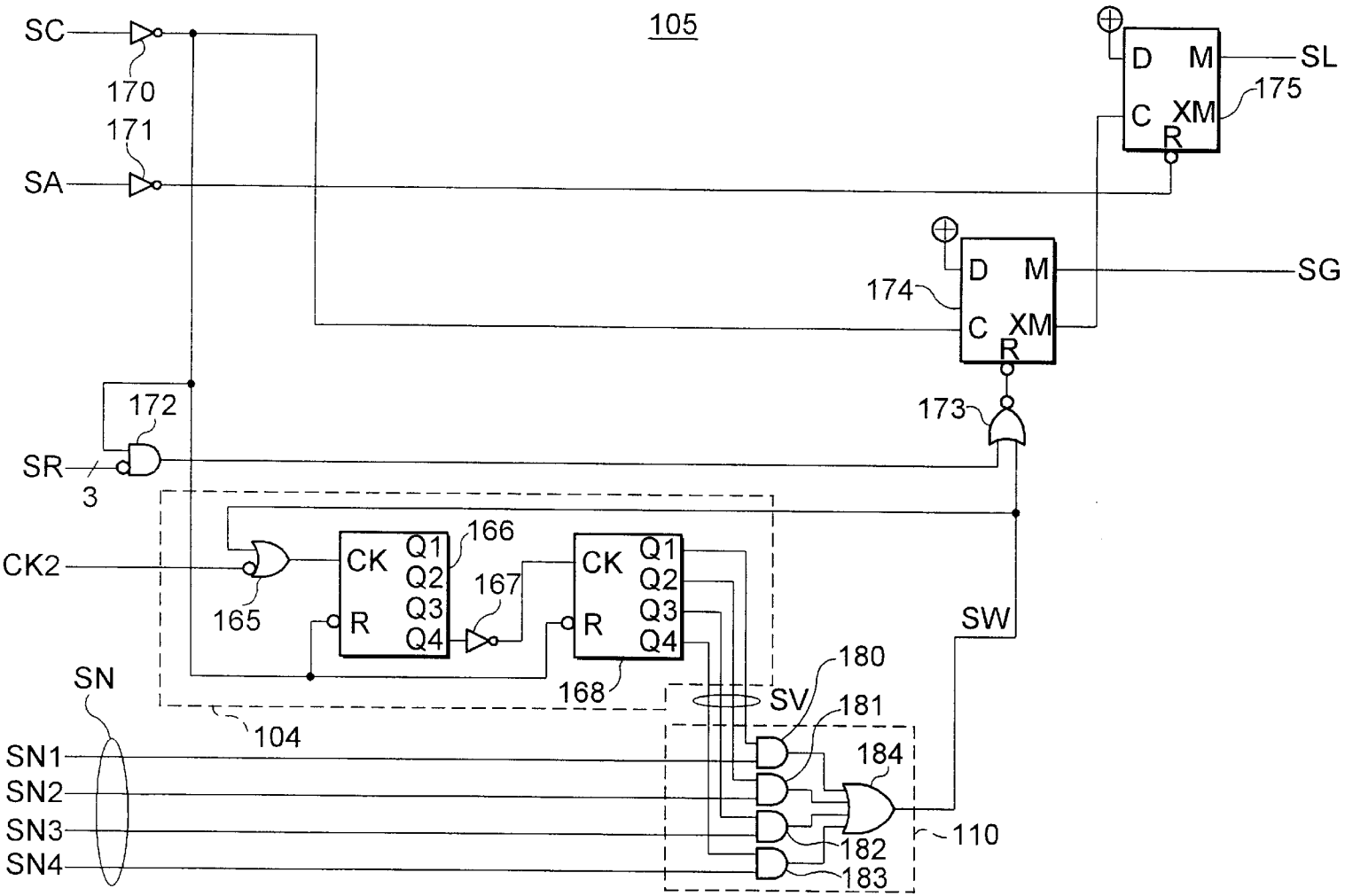
FIG. 7 is a detailed diagram illustrating a measurement unit, a correction control unit and a correction time selection unit.

FIG. 7 is a detailed diagram illustrating the measurement unit, the correction control unit and the correction time selection unit.

The measurement unit 104 includes: an OR circuit 165 one input terminal of which receives as its input the inverted version of the second clock signal CK2 from the timepiece driving unit 112, with the other input terminal thereof receiving as its input a non-rapid charging time measurement completion signal SW, which is to be described later is, so as to obtain and output the logical sum of the input signals; a first counter 166 whose clock terminal CK receives as its input the output signal from the OR circuit 165, with the reset terminal thereof receiving as its input a rapid charging detection signal SC; an inverter 167 for receiving as its input the output signal from a count output terminal Q4 (MSB) among the count output terminals Q1 to Q4 of the first counter 166 and inverting and outputting the input signal; and a second counter 168 whose clock terminal CK receives as its input the output signal from the inverter 167, with the reset terminal thereof receiving as its input the rapid charging detection signal SC, so as to output a 4-bit correction time signal SV from the count output terminals Q1 to Q4 thereof.

The correction control unit 105 includes: an inverter 170 whose input terminal receives as its input the rapid charging detection signal SC, so as to invert the rapid charging detection signal SC and output the inverted signal; an inverter 171 whose input terminal receives as its input a charging detection signal SA, so as to invert the charging detection signal SA and output the inverted signal; an AND circuit 172 one input terminal of which receives as its input the inverted version of the rapid charging detection signal SC with the other input terminal thereof receiving as its input the inverted version of a second remaining voltage display detection signal SR, so as to obtain the logical product of the input signals and output the obtained logical product; a NOR circuit 173 one input terminal of which receives as its input the output signal from the AND circuit 172, with the other input terminal thereof receiving as its input the non-rapid charging time measurement completion signal SW, so as to obtain the negated logical sum of the input signals and output the obtained negated logical sum; a flip-flop circuit 174 whose data terminal D is connected to the high potential side power source VDD, with the clock terminal C thereof receiving as its input the inverted version of the rapid charging detection signal SC and the reset terminal thereof receiving as its input the inverted version of the output signal from the NOR circuit 173, so as to output a voltage detection correction signal SG from the output terminal M thereof; and a flip-flop circuit 175 whose data terminal D is connected to the high potential side power source VDD, with the clock terminal C thereof connected to the inverted output terminal XM of the flip-flop circuit 174 and the reset terminal R thereof receiving as its input the inverted version of the charging detection signal SA, so as to output a remaining voltage display rank-up inhibition signal SL from the output terminal M thereof.

The correction time selection unit 110 includes: an AND circuit 180 one input terminal of which is connected to the count output terminal Q1 of the second counter 168, with the other input terminal thereof receiving as its input the 1-bit signal SN1 which forms a part of the power source discrimination signal SN, so as to obtain the logical product of the input terminals and output the obtained logical product; an AND circuit 181 one input terminal of which is connected to the count output terminal Q2 of the second counter 168, with the other input terminal receiving as its input the 1-bit signal SN2 which forms a part of the power source discrimination signal SN, so as to obtain the logical product of the input terminals and output the obtained logical product; an AND circuit 182 one input terminal of which is connected to the count output terminal Q3 of the second counter 168, with the other input terminal thereof receiving as its input the 1-bit signal SN3 which forms a part of the power source discrimination signal SN, so as to obtain the logical product of the input terminals and output the obtained logical product; an AND circuit 183 one input terminal of which is connected to the count output terminal Q4 of the second counter 168, with the other input terminal receiving as its input the 1-bit signal SN4 which forms a part of the power source discrimination signal SN, so as to obtain the logical product of the input terminals and output the obtained logical product; and an OR circuit 184 for obtaining the logical sum of the respective output signals from the AND circuits 180 to 183 and outputting the obtained logical sum as the non-rapid charging time measurement completion signal SW.

The general operation of the measurement unit, the correction control unit and the correction time selection unit will be described.

First, the operation of the measurement unit 104 will be described.

The OR circuit 165 of the measurement unit 104 outputs an "H" level signal to the first counter 166 in a period during which the inverted version of the second clock signal CK2 from the timepiece driving unit 112 is at the "H" level or in a period during which the non-rapid charging time measurement completion signal SW output from the correction time selection unit 110 is at the "H" level.

Therefore, until the rapid charging detection signal SC is reset by being brought to the "H" level, the first counter 166 counts up based on the inverted version of the second clock signal CK2 from the timepiece driving unit 112 or the non-rapid charging time measurement completion signal SW, and outputs the output signal of the count output terminal Q4 (MSB) (initially at the "L" level) to the inverter 167. Thus, the first counter 166 outputs a signal whose cycle is 16 times the clock cycle (8 times the clock cycle in terms of the correction time).

The inverter 167 inverts the output signal of the count output terminal Q4 (MSB) (initially at the "H" level) and outputs the inverted signal to the second counter 168.

Therefore, the second counter 168 counts up based on the output signal of the count output terminal Q4 (MSB) and outputs the correction time signal SV, which is the output signal from the count output terminals Q1 to Q4, to the correction time selection unit 110.

Specifically, the second counter 168 outputs a signal corresponding to the correction time having a length 16 (=16 1) times the clock cycle of the first counter 166 through the output terminal Q1, a signal corresponding to the correction time having a length 32 (=16 2) times the clock cycle through the output terminal Q2, a signal corresponding to the correction time having a length 64 (=16 4) times the clock cycle through the output terminal Q3, and a signal corresponding to the correction time having a length 128 (=16 8) times the clock cycle through the output terminal Q4.

Next, the operation of the correction time selection unit 110 will be described.

The AND circuit 180 of the correction time selection unit 110 outputs the output signal of the output terminal Q1 of the second counter 168, i.e., a signal corresponding to the correction time having a length 16 times the cycle of the clock CK2 of the first counter 166, when the signal SN1 which forms a part of the power source discrimination signal SN is at the "H" level.

The AND circuit 181 outputs a signal which is synchronized with the output signal of the output terminal Q2 of the second counter 168, i.e., a signal corresponding to the correction time having a length 32 times the cycle of the clock CK2 of the first counter 166, when the signal SN2 which forms a part of the power source discrimination signal SN is at the "H" level.

The AND circuit 182 outputs a signal which is synchronized with the output signal of the output terminal Q3 of the second counter 168, i.e., a signal corresponding to the correction time having a length 64 times the cycle of the clock CK2 of the first counter 166, when the signal SN3 which forms a part of the power source discrimination signal SN is at the "H" level.

The AND circuit 183 outputs a signal which is synchronized with the output signal of the output terminal Q4 of the second counter 168, i.e., a signal corresponding to the correction time having a length 128 times the cycle of the clock CK2 of the first counter 166, when the signal SN4 which forms a part of the power source discrimination signal SN is at the "H" level.

Thus, when any one of the signals SN1 to SN4 which together form the power source discrimination signal SN is at the "H" level, the OR circuit 184 outputs the output signal from the corresponding one of the AND circuits 180 to 183 as the non-rapid charging time measurement completion signal SW.

Next, the operation of the correction control unit 105 will be described.

The inverter 170 of the correction control unit 105 inverts the rapid charging detection signal SC which has been received as an input thereto, and outputs the inverted signal to the measurement unit 104, the AND circuit 172 and the clock terminal C of the flip-flop circuit 174.

In response, the flip-flop circuit 174 outputs an "H" level signal as the voltage detection correction signal SG through the output terminal M, thereby effecting the voltage detection correction during rapid charging, when the inverted version of the rapid charging detection signal SC received at the clock terminal C is at the "L" level, i.e., when in rapid charging.

The AND circuit 172 outputs an "H" level signal to the NOR circuit 173 when the inverted version of the rapid charging detection signal SC is at the "H" level while all of the bits of the 3-bit second remaining voltage display detection signal SR are at the "L" level, i.e., when in a non-rapid charging period and in a period during which a predetermined display (a BLD display operation, which is to be described later) should be performed as the second remaining voltage display (i.e., a period in which the secondary power source voltage is below a predetermined lower limit voltage).

When the output of the AND circuit 172 is at the "H" level or the non-rapid charging time measurement completion signal SW is at the "H" level, the NOR circuit 173 outputs an "L" level signal, thereby resetting the flip-flop circuit 174 and thus outputting an "L" level as the voltage detection correction signal SG, so that the voltage correction is not performed.

The flip-flop circuit 174 outputs an "L" level signal through the output terminal XM when the inverted version of the rapid charging detection signal SC received at the clock terminal C is at the "L" level, i.e., when in rapid charging. Thereafter, when the flip-flop circuit 174 is reset based on the above-described condition, the output terminal XM transitions from the "L" level to the "H" level, which is input to the clock terminal C of the flip-flop circuit 175.

Thus, the clock terminal C of the flip-flop circuit 175 receives as its input an "L" level signal when rapid charging is being detected and an "H" level signal when the voltage correction is terminated.

The transition from the "L" level to the "H" level (the rising edge of the signal) is detected at the clock terminal C, thereby outputting an "H" level signal as the remaining voltage display rank-up inhibition signal SL through the output terminal M in synchronism with the timing at which the voltage correction is terminated. Thus, once the voltage correction is terminated, the remaining voltage display rank-up operation is inhibited.

Such an operation is performed so as to prevent the remaining voltage display rank from being moved up even through no charging is being performed after the voltage correction is terminated, i.e., to prevent the display rank from being moved to the next rank of greater remaining voltage even though the remaining battery voltage is not being increasing, thereby avoiding an irregular or odd transition in the display from being viewed by the user.

Therefore, if charging is detected thereafter, the flip-flop circuit 175 is reset by the "H" level charging detection signal SA which is input to the reset terminal R of the flip-flop circuit 175, whereby the remaining voltage display rank-up inhibition signal SL is brought to the "L" level to remove the rank-up inhibition.

Figure 8:
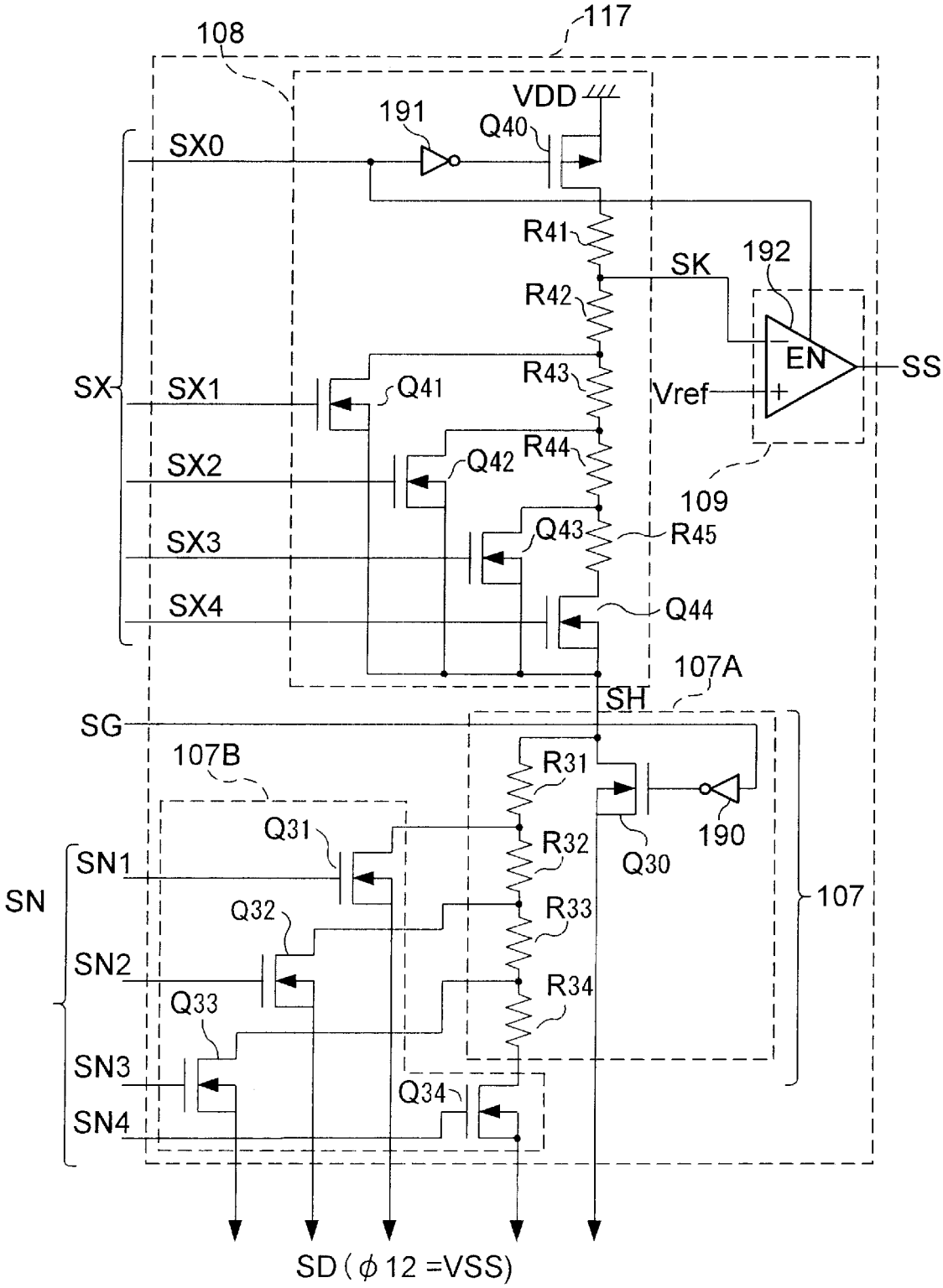
FIG. 8 is a detailed diagram illustrating a voltage detection unit of the first embodiment.

FIG. 8 is a detailed diagram illustrating the voltage detection unit including the offset voltage generation/offset voltage selection unit, the detected voltage generation unit (as used herein, a "detected voltage" is a voltage to be detected) and the voltage discrimination unit.

The offset voltage generation/offset voltage selection unit 107 of the voltage detection unit 117 is generally divided into an offset voltage generation unit 107A for generating the offset voltage SH and an offset voltage selection unit 107B for selectively discriminating the offset voltage SH to be actually generated.

The offset voltage generation unit 107A includes: an inverter 190 whose input terminal receives as its input the voltage detection correction signal SG, so as to invert the voltage detection correction signal SG and output the inverted signal; an N-channel MOS transistor Q30 which is turned ON in the absence of the offset voltage application based on the output signal from the inverter 190; and resistors R31 to R34 which are connected in parallel to the N-channel MOS transistor Q30 and in series with one another.

The offset voltage selection unit 107B includes: an N-channel MOS transistor Q31 whose drain is connected to the node between the resistor R31 and the resistor R32 of the offset voltage generation unit 107A, with the source thereof connected to the low potential side power source VSS and the gate thereof receiving as its input the 1-bit signal SN1 which forms a part of the power source discrimination signal SN so as to turn ON/OFF the N-channel MOS transistor Q31; an N-channel MOS transistor Q32 whose drain is connected to the node between the resistor R32 and the resistor R33 of the offset voltage generation unit 107A, with the source thereof connected to the low potential side power source VSS and the gate thereof receiving as its input the 1-bit signal SN2 which forms a part of the power source discrimination signal SN so as to turn ON/OFF the N-channel MOS transistor Q32; an N-channel MOS transistor Q33 whose drain is connected to the node between the resistor R33 and the resistor R34 of the offset voltage generation unit 107A, with the source thereof connected to the low potential side power source VSS and the gate thereof receiving as its input the 1-bit signal SN3 which forms a part of the power source discrimination signal SN so as to turn ON/OFF the N-channel MOS transistor Q33; and an N-channel MOS transistor Q34 whose drain is to connected to the resistor R34 of the offset voltage generation unit 107A, with the source thereof connected to the low potential side power source VSS and the gate thereof receiving as its input the 1-bit signal SN4 which forms a part of the power source discrimination signal SN so as to turn ON/OFF the N-channel MOS transistor Q34.

Thus, in the offset voltage selection unit 107B, one of the resistors R31 to R34 is inserted between the high potential side power source VDD and the low potential side power source VSS based on the power source corresponding to the power source discrimination signal SN so as to change the voltage division ratio, whereby the offset voltage SH is effectively superimposed on (or added to) a detected voltage SK.

The detected voltage generation unit 108 includes: an inverter 191 whose input terminal receives as its input a 1-bit signal SX0 which forms a part of a 5-bit voltage detection timing signal SX for inverting the signal SX0 and outputting the inverted signal; a P-channel MOS transistor Q40 which is turned ON/OFF based on the output signal from the inverter 191; resistors R41 to R45 which are connected in series with the P-channel MOS transistor Q40; an N-channel MOS transistor Q41 whose drain is connected to the node between the resistor R42 and the resistor R43, with the source thereof connected to the drain of the N-channel MOS transistor Q30 of the offset voltage generation unit 107A and the gate thereof receiving as its input a 1-bit signal SX1 which forms a part of the voltage detection timing signal SX; an N-channel MOS transistor Q42 whose drain is connected to the node between the resistor R43 and the resistor R44, with the source thereof connected to the drain of the N-channel MOS transistor Q30 of the offset voltage generation unit 107A and the gate thereof receiving as its input a 1-bit signal SX2 which forms a part of the voltage detection timing signal SX; an N-channel MOS transistor Q43 whose drain is connected to the node between the resistor R44 and the resistor R45, with the source thereof connected to the drain of the N-channel MOS transistor Q30 of the offset voltage generation unit 107A and the gate thereof receiving as its input a 1-bit signal SX3 which forms a part of the voltage detection timing signal SX; and an N-channel MOS transistor Q44 whose drain is connected to the resistor R45, with the source thereof connected to the drain of the N-channel MOS transistor Q30 of the offset voltage generation unit 107A and the gate thereof receiving as its input a 1-bit signal SX4 which forms a part of the voltage detection timing signal SX.

The voltage discrimination unit 109 includes a comparator 192 one input terminal of which is connected to the node between the resistor R41 and the resistor R42 of the detected voltage generation unit 108 for receiving the detected voltage SK therethrough, with the other input terminal thereof receiving as its input a reference voltage Vref and the enable terminal EN thereof receiving as its input the signal SX0, so as to output a voltage detection result signal SS when the received signal SX0 is at the "H" level.

In this configuration, the P-channel MOS transistor Q40 and the enable terminal EN of the comparator 192 are provided so that the detected voltage generation unit 108, the offset voltage generation unit 107A and the comparator 192 operate only during the voltage detection mode so as to further reduce the power consumption.

Figure 9:
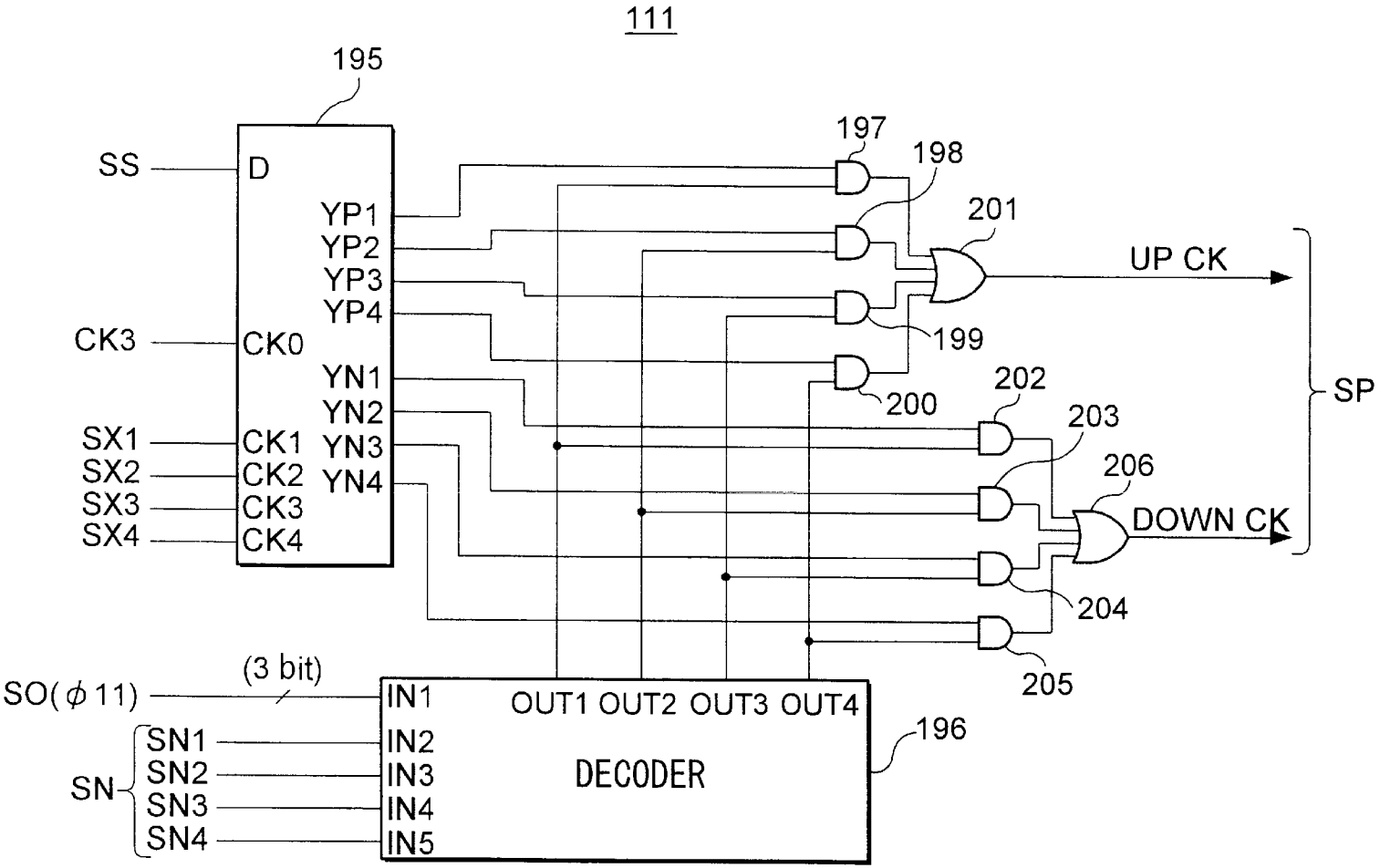
FIG. 9 is a detailed diagram illustrating a voltage detection result selection unit.

FIG. 9 is a detailed diagram illustrating the voltage detection result selection unit.

The voltage detection result selection unit 111 includes: a differential pulse generation circuit 195 whose data terminal D receives as its input the voltage detection result signal SS, with the clock terminal CK0 thereof receiving as its input the third clock signal CK3 from the timepiece driving unit 112, the clock terminal CK1 thereof receiving as its input the 1-bit signal SX1 which forms a part of the voltage detection timing signal SX, the clock terminal CK2 thereof receiving as its input the 1-bit signal SX2 which forms a part of the voltage detection timing signal SX, the clock terminal CK3 thereof receiving as its input the 1-bit signal SX3 which forms a part of the voltage detection timing signal SX, and the clock terminal CK4 thereof receiving as its input the 1-bit signal SX4 which forms a part of the voltage detection timing signal SX, so as to output 4-bit detection data from first output terminals YP1 to YP4 thereof and 4-bit non-detection data from second output terminals YN1 to YN4 thereof; and a decoder 196 whose 3-bit input terminal IN1 receives as its input a voltage boost/drop control signal SO, with the input terminals IN2 to IN5 thereof receiving as their input a 4-bit power source discrimination signal SN (=SN1 to SN4), so as to perform a decoding operation based on the states of the input signals and output 4-bit decoding result data through output terminals OUT1 to OUT4 thereof.

The voltage detection result selection unit 111 further includes: an AND circuit 197 one input terminal of which is connected to the first output terminal YP1, with the other input terminal connected to the output terminal OUT1 of the decoder 196, so as to obtain the logical product of the input signals received at the respective terminals and output the obtained logical product; an AND circuit 198 one input terminal of which is connected to the first output terminal YP2, with the other input terminal thereof connected to the output terminal OUT2 of the decoder 196, so as to obtain the logical product of the input signals received at the respective terminals and output the obtained logical product; an AND circuit 199 one input terminal of which is connected to the first output terminal YP3, with the other input terminal thereof connected to the output terminal OUT3 of the decoder 196, so as to obtain the logical product of the input signals received at the respective terminals and output the obtained logical product; an AND circuit 200 one input terminal of which is connected to the first output terminal YP4, with the other input terminal thereof connected to the output terminal OUT4 of the decoder 196, so as to obtain the logical product of the input signals received at the respective terminals and output the obtained logical product; an OR circuit 201 to which the respective output terminals of the AND circuits 197 to 200 are connected so as to obtain the logical sum of all of the input signals and output the obtained logical sum as a 1-bit signal UPCK which forms a part of a voltage detection result selection signal SP; and an AND circuit 202 one input terminal of which is connected to the second output terminal YN1, with the other input terminal thereof connected to the output terminal OUT1 of the decoder 196, so as to obtain the logical product of the input signals received at the respective terminals and output the obtained logical product.

The voltage detection result selection unit 111 further includes: an AND circuit 203 one input terminal of which is connected to the second output terminal YN2, with the other input terminal thereof connected to the output terminal OUT2 of the decoder 196, so as to obtain the logical product of the input signals received at the respective terminals and output the obtained logical product; an AND circuit 204 one input terminal of which is connected to the second output terminal YN3, with the other input terminal thereof connected to the output terminal OUT3 of the decoder 196, so as to obtain the logical product of the input signals received at the respective terminals and output the obtained logical product; and an AND circuit 205 one input terminal of which is connected to the second output terminal YN4, with the other input terminal thereof connected to the output terminal OUT4 of the decoder 196, so as to obtain the logical product of the input signals received at the respective terminals and output the obtained logical product; and an OR circuit 206 to which the respective output terminals of the AND circuits 202 to 205 are connected so as to obtain the logical sum of all of the input signals and output the obtained logical sum as a 1-bit signal DOWNCK which forms a part of the voltage detection result selection signal SP.

Now, referring to FIG. 25, the operation of the voltage detection result selection unit 111 will be described.

First, the voltage detection timing signal SX will be described with reference to FIG. 25*a*.

The voltage detection timing signal SX is actually comprised of five signals SX0 to SX4, and the detection cycle, which is equal to the output cycle of the voltage detection timing signal SX, is a cycle TC. The signal SX0 is a signal which is at the "H" level at a timing when any of the other four signals SX1 to SX4 is at the "H" level.

Next, the operation of the voltage detection result selection unit 111 will be described in connection with the operation of the voltage detection unit 117, using the signal SX1 as an example.

When the signal SX1 transitions to the "H" level, the signal SX0 also transitions to the "H" level at the same timing, thereby turning ON the P-channel MOS transistor Q40, and thus supplying an electric power to the detected voltage generation unit 108 and the offset voltage generation unit 107A. The N-channel MOS transistor 041 is also turned ON, whereby in the detected voltage generation unit 108, only the resistor R42 is connected in series with the resistor R41. Thus, without the offset voltage SH being superimposed thereon, the detected voltage SK is equal to a voltage obtained by dividing the voltage between the high potential side power source VDD and the low potential side power source VSS by the resistor R41 and the resistor R42.

Figures 25A, 25B, 25C:
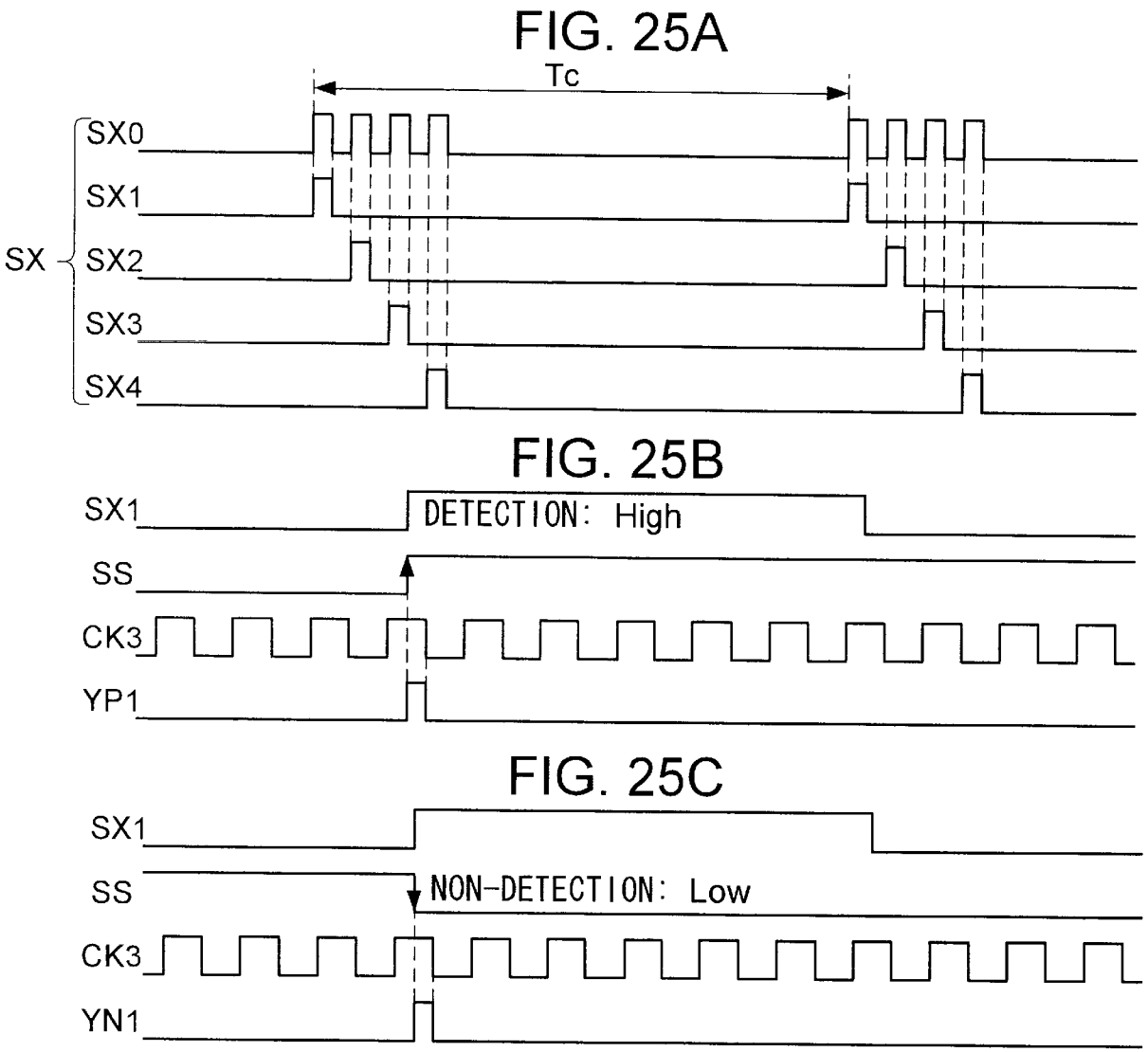
FIGS. 25*a*, 25*b* and 25*c* are diagrams each illustrating the operation of a voltage detection result selection unit.

On the other hand, as illustrated in FIG. 25*b*, at the timing when the signal SX1 is at the "H" level, the signal SX0 is also at the "H" level, whereby the comparator 192 which forms the voltage discrimination unit 109 is activated to compare the detected voltage SK with the reference voltage Vref and output the comparison result as the voltage detection result signal SS.

Thus, with the detected voltage generation unit 108 having the above-described configuration, the voltage between the high potential side power source VDD and the low potential side power source VSS is divided while changing the voltage division ratio by the voltage detection timing signal SX so that the detected voltage SK is within a predetermined voltage range. Therefore, it is possible to measure the detected voltage SK with various voltage ranges while the constant reference voltage Vref is always applied to the input terminal of the comparator 192 of the voltage discrimination unit 109, and thus to provide a plurality of remaining voltage displays based on a single comparator output.

More specifically, when the reference voltage Vref becomes higher than the detected voltage SK, the voltage detection result signal SS transitions from the "L" level to the "H" level. As a result, the first output terminal YP1 generates and outputs a differential pulse which transitions to the "H" level in synchronism with the rising edge of the voltage detection result signal SS.

Therefore, if a power source such that the output terminal OUT1 of the decoder 196 is at the "H" level at the timing when the first output terminal YP1 is at the "H" level is used, and if the voltage boost/drop control signal SO is set so that the output terminal OUT1 of the decoder 196 is at the "H" level, then the output from the AND circuit 197 is directly output as the 1-bit signal UPCK which forms a part of the voltage detection result selection signal SP.

On the other hand, when the reference voltage Vref becomes lower than the detected voltage SK, the voltage detection result signal SS transitions from the "H" level to the "L" level, as illustrated in FIG. 25*c*. As a result, the first output terminal YN1 generates and outputs a differential pulse which transitions to the "H" level in synchronism with the falling edge of the voltage detection result signal SS.

Therefore, if a power source such that the output terminal OUT1 of the decoder 196 is at the "H" level at the timing when the first output terminal YP1 is at the "H" level is used, and if the voltage boost/drop control signal SO is set so that the output terminal OUT1 of the decoder 196 is at the "H" level, then the output from the AND circuit 202 is directly output as the 1-bit signal DOWNCK which forms a part of the voltage detection result selection signal SP.

Figure 10:
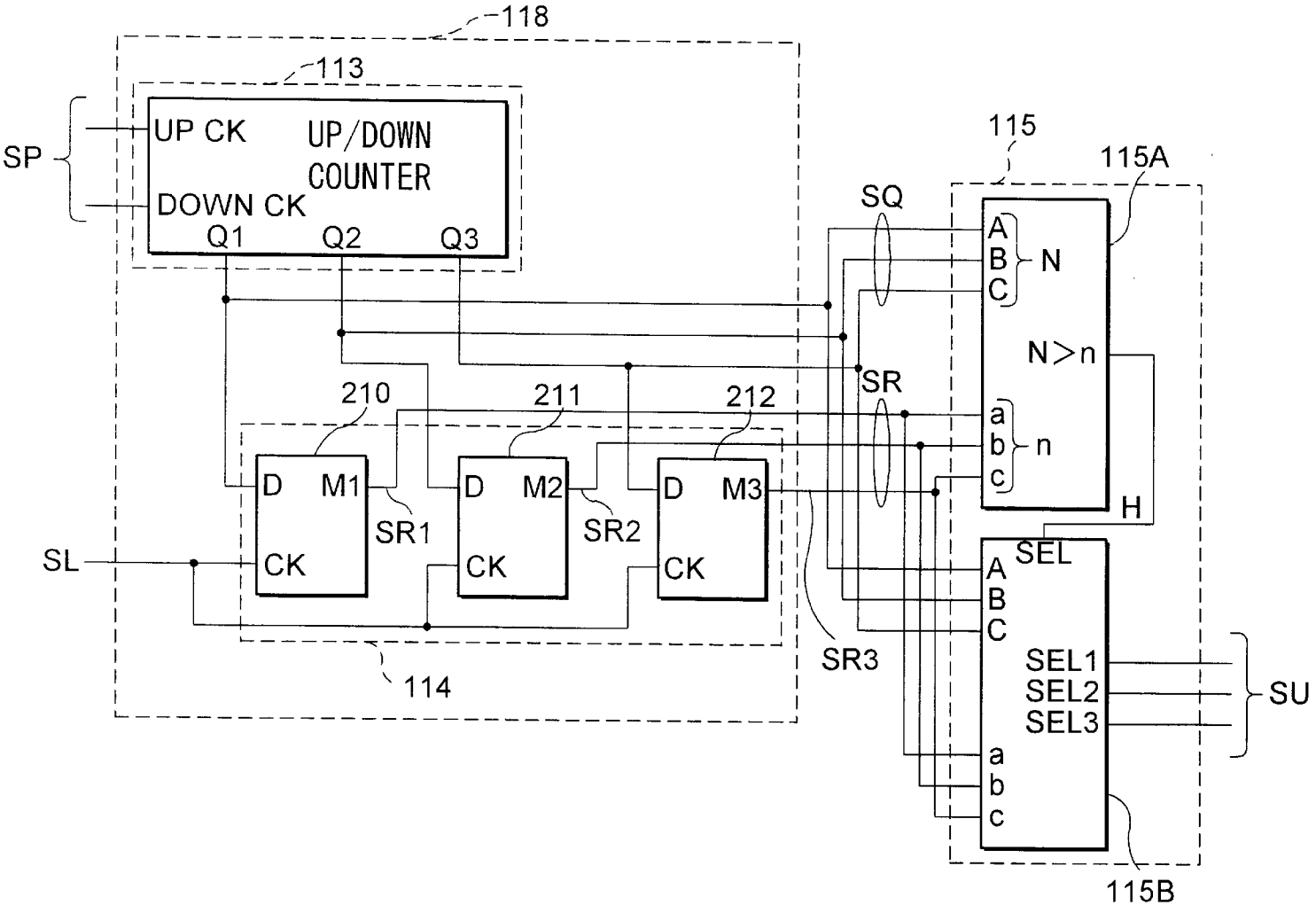
FIG. 10 is a detailed diagram illustrating a remaining voltage detection unit and a comparison unit.

FIG. 10 is a detailed diagram illustrating the remaining voltage detection unit and the comparison unit.

The remaining voltage detection unit 118 is generally divided into a first remaining voltage detection unit 113 and a second remaining voltage detection unit 114.

The first remaining voltage detection unit 113 includes an up/down counter whose up-clock terminal UPCK receives as its input the 1-bit signal UPCK which forms a part of the voltage detection result selection signal SP, with the down-clock terminal DOWNCK thereof receiving as its input the 1-bit signal DOWNCK which forms a part of the voltage detection result selection signal SP, so as to output a first remaining voltage display detection signal SQ from the count output terminals Q1 to Q3.

The second remaining voltage detection unit 114 includes: a flip-flop circuit 210 whose data terminal D is connected to the count output terminal Q1 of the first remaining voltage detection unit 113, with the clock terminal CK thereof receiving as its input the remaining voltage display rank-up inhibition signal SL, so as to output through an output terminal M1 thereof a 1-bit signal SR1 which forms a part of the second remaining voltage display detection signal SR; a flip-flop circuit 211 whose data terminal D is connected to the count output terminal Q2 of the first remaining voltage detection unit 113, with the clock terminal CK thereof receiving as its input the remaining voltage display rank-up inhibition signal SL, so as to output through an output terminal M2 thereof a 1-bit signal SR2 which forms a part of the second remaining voltage display detection signal SR; and a flip-flop circuit 212 whose data terminal D is connected to the count output terminal Q3 of the first remaining voltage detection unit 113, with the clock terminal CK thereof receiving as its input the remaining voltage display rank-up inhibition signal SL, so as to output through an output terminal M3 thereof a 1-bit signal SR3 which forms a part of the second remaining voltage display detection signal SR.

The general operation of the remaining voltage detection unit 118 will be described after describing the configuration of the comparison unit below.

The comparison unit 115 is generally divided into a comparison circuit 115A and a selection circuit 115B.

The comparison circuit 115A includes: first input terminals A to C to which the 3-bit first remaining voltage display detection signal SQ corresponding to a value N is input; second input terminals a to c to which the 3-bit second remaining voltage display detection signal SR corresponding to a value n is input; and an output terminal through which a signal at the "H" level is output if the value N is greater than the value n, i.e., when N>n.

The selection circuit 115B includes: first input terminals A to C to which the 3-bit first remaining voltage display detection signal SQ corresponding to the value N is input; second input terminals a to c to which the 3-bit second remaining voltage display detection signal SR corresponding to the value n is input; and output terminals SEL1 to SEL3 through which the input signal from the second input terminals a to c is directly output as a remaining voltage display result signal SU if the signal level of the output terminal of the comparison circuit 115A is the "H" level, i.e., N>n, and through which the input signal from the first input terminals A to C is directly output as the remaining voltage display result signal SU if the signal level of the output terminal of the comparison circuit 115A is the "L" level, i.e., N n.

Now, the general operation of the remaining voltage detection unit 118 and the comparison unit 115 will be described.

The remaining voltage detection unit 118 is constantly detecting the remaining voltage, and during a normal operation mode, where the remaining voltage display rank-up inhibition signal SL is at the "L" level, the output of the first remaining voltage detection unit 113 (N: A, B, C) and the output of the second remaining voltage detection unit 114 (n: a, b, c) are equal to each other (N=n).

Therefore, the output terminal of the comparison circuit 115A of the comparison unit 115 is at the "L" level, and the selection circuit 115B outputs the output of the first remaining voltage detection unit 113 (N: A, B, C) as the remaining voltage display result signal SU.

However, when the remaining voltage display rank-up inhibition signal SL transitions to the "H" level as the application of the correction voltage is terminated, the flip-flop circuits 210, 211 and 212 of the second remaining voltage detection unit 114 enter a latch state, thereby holding the previous output (n: a, b, c).

Therefore, when the remaining voltage display rank-up operation is inhibited and when the output of the first remaining voltage detection unit 113 (N: A, B, C) indicates a rank-up operation, i.e., when the output of the first remaining voltage detection unit 113 (N: A, B, C) is greater than the output of the second remaining voltage detection unit 114 (n: a, b, c) (N>n), the output terminal of the comparison circuit 115A of the comparison unit 115 is at the "H" level, and the selection circuit 115B outputs the output of the second remaining voltage detection unit 114 (n: a, b, c) as the remaining voltage display result signal SU, thereby inhibiting the rank-up operation.

1.3 Operation of the First Embodiment

Next, the operation of the first embodiment will be described.

[1.3.1] Operation During Non-charging Mode and Normal Charging Mode

First, the operation of displaying the remaining voltage of a large-capacity capacitor (=secondary power source) during a non-charging mode and a normal charging mode (in which the battery is being charged from carrying around the timepiece) will be described.

In the following description, four remaining voltage display switching voltages VA, VB, VC and VBLD are used, which have the following relationship:

|VC|>VB|>|VA|>|VBLD|

The four voltages VA, VB, VC and VBLD are each an actual voltage of the large-capacity capacitor, and in the case where the voltage detection is performed after a voltage boost/drop operation by a voltage boost/drop factor N, as in the present embodiment, it is equal to a voltage obtained by dividing the voltage VXn, i.e., a voltage value after the voltage boost/drop operation, by the voltage boost/drop factor N (see FIGS. 12, 18, 20 and 22).

[1.3.1.1] Operation During Non-charging Mode

Figure 11A:
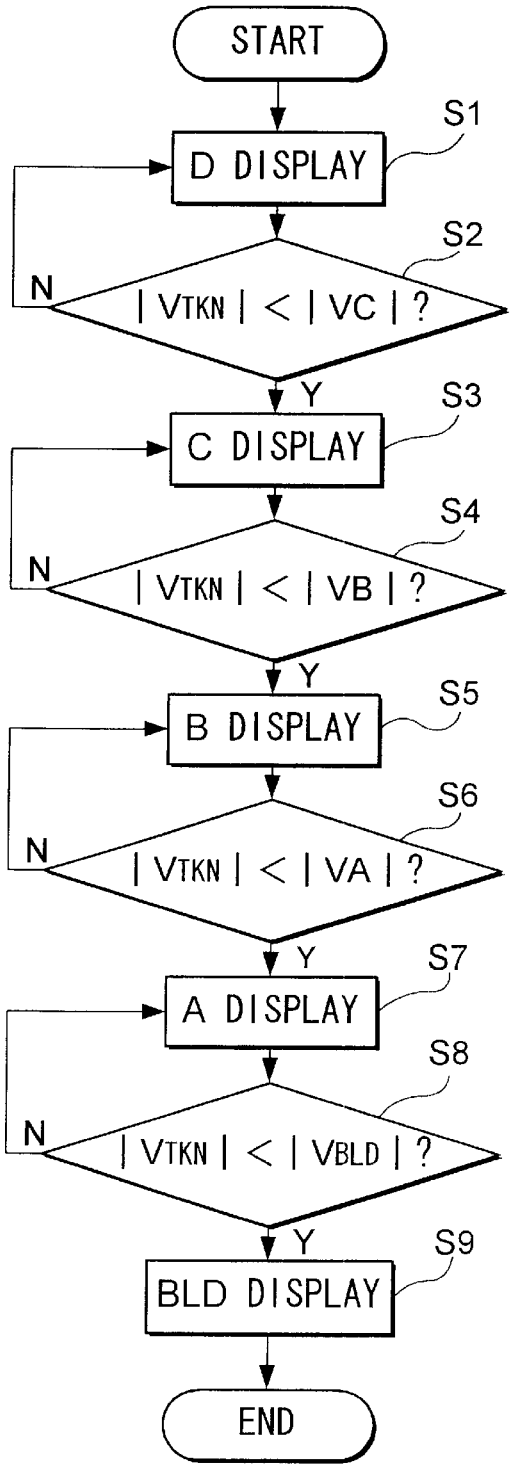
FIG. 11*a* is a flow chart illustrating the operation during a noncharging mode.

First, the operation in a mode during which the voltage of the large-capacity capacitor 48 decreases, i.e., a non-charging mode, will be described with reference to FIG. 11*a*. In this case, the remaining voltage display is performed based on the output of the first remaining voltage detection unit 113 of the remaining voltage detection unit 118 (N: A, B, C).

Assuming that the battery is fully charged in the initial state, the battery voltage VTKN is as follows:

|VTKN| |VC|

This state is discriminated to be a state in which a D display operation, where the second hand is advanced from the current display position by 30 seconds in 16 [Hz] hand moving steps, should be performed (step S1).

Therefore, in this state where the D display operation should be performed, if the second external input unit G is operated, thereby inputting a remaining voltage display input signal to the remaining voltage display unit 116 and instructing a transition to a remaining battery voltage display mode, then a remaining voltage display signal ST is output from the remaining voltage display unit 116 to the motor driving unit E, and the motor driving unit E drives the stepping motor by a motor driving signal SF, so as to advance the second lo hand from the current display position by 30 seconds in 16 [Hz] hand moving steps (=D display operation).

Figure 12:
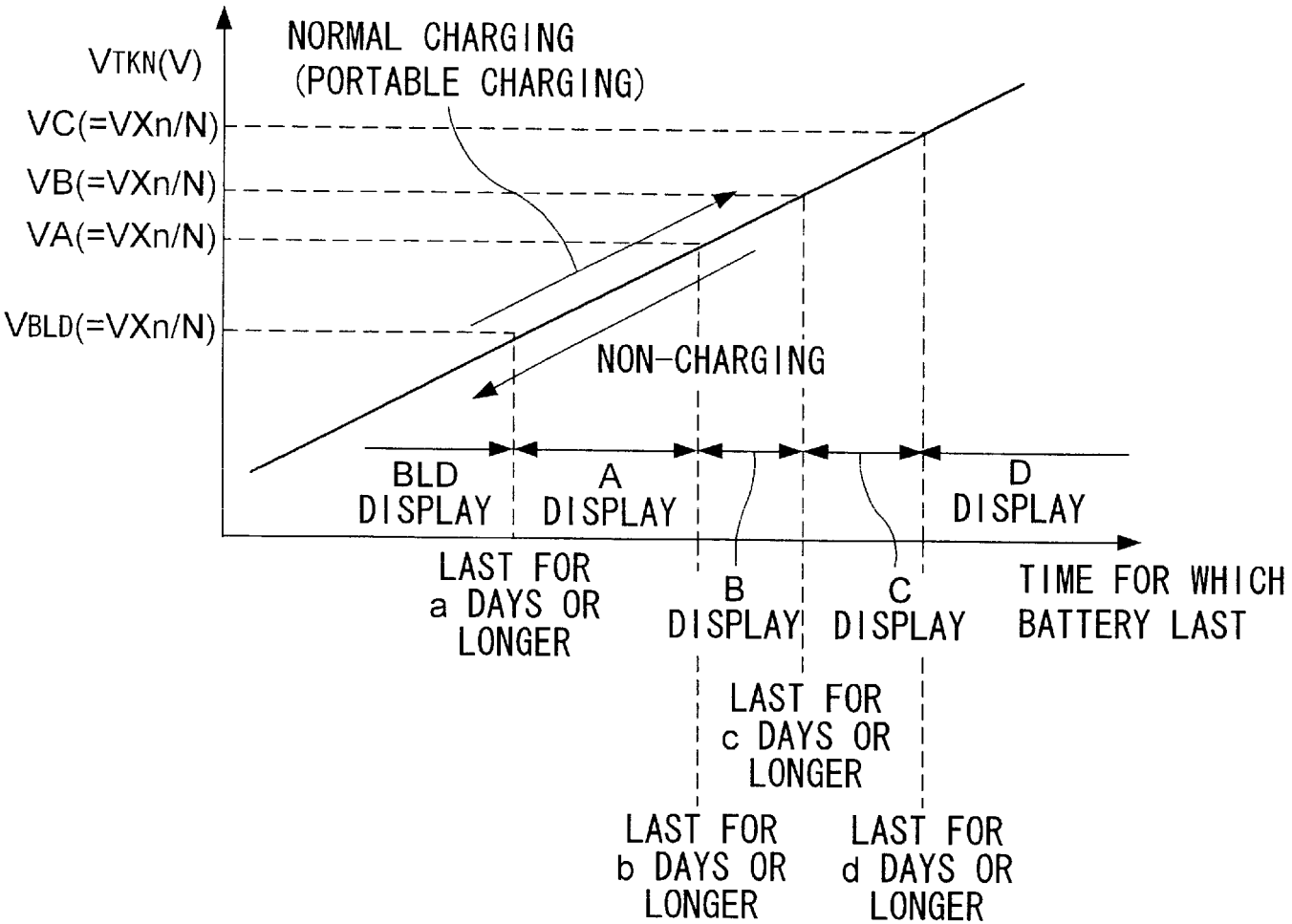
FIG. 12 is a diagram illustrating the operation during the noncharging mode.

As illustrated in FIG. 12, the D display operation is performed when it is discriminated that the battery voltage VTKN is sufficient to drive the time-keeping device 1 for a duration which is equal to or greater than d days (e.g., 180 days).

After the D display operation is performed, the resulting position is retained, and the hand moving operation is resumed when the actual time coincides with the displayed time which has resulted from the D display operation.

When the result of the comparison (step S2) between the absolute value of the battery voltage VTKN corresponding to the output of the first remaining voltage detection unit 113 of the remaining voltage detection unit 118 (N: A, B, C) and the absolute value of the voltage=VC is

|VTKN| |VC|

(No at step S2), it is discriminated that this state is a state in which the D display operation as described above should be performed (step S1).

In the discrimination at step S2, if

|VTKN| |VC|

(Yes at step S2), it is discriminated that this state is a state in which a C display operation, where the second hand is advanced from the current display position by 20 seconds in 16 [Hz] hand moving steps, should be performed (step S3).

Therefore, in this state where the C display operation should be performed, if the second external input unit G is operated, thereby inputting a remaining voltage display input signal to the remaining voltage display unit 116 and instructing a transition to a remaining battery voltage display mode, then the remaining voltage display signal ST is output from the remaining voltage display unit 116 to the motor driving unit E, and the motor driving unit E drives the stepping motor by the motor driving signal SF, so as to advance the second hand from the current display position by 20 seconds in 16 [Hz] hand moving steps (=C display operation).

As illustrated in FIG. 12, the C display operation is performed when it is discriminated that the battery voltage VTKN is sufficient to drive the time-keeping device 1 for a duration which is equal to or greater than c days (e.g., 30 days) and less than d days (e.g., 180 days).

When the result of the comparison (step S4) between the absolute value of the battery voltage VTKN corresponding to the output of the first remaining voltage detection unit 113 of the remaining voltage detection unit 118 (N: A, B, C) and the absolute value of the voltage=VB is

|VTKN| |VB|

(No at step S4), it is discriminated that this state is a state in which the C display operation as described above should be performed (step S3).

In the discrimination at step S4, if

|VTKN| |VB|

(Yes at step S4), it is discriminated that this state is a state in which a B display operation, where the second hand is advanced from the current display position by 10 seconds in 8 [Hz] hand moving steps, should be performed (step S5).

Therefore, in this state where the B display operation should be performed, if the second external input unit G is operated, thereby inputting a remaining voltage display input signal to the remaining voltage display unit 116 and instructing a transition to a remaining battery voltage display mode, then the remaining voltage display signal ST is output from the remaining voltage display unit 116 to the motor driving unit E, and the motor driving unit E drives the stepping motor by the motor driving signal SF, so as to advance the second hand from the current display position by 10 seconds in 8 [Hz] hand moving steps (=B display operation).

As illustrated in FIG. 12, the B display operation is performed when it is discriminated that the battery voltage VTKN is sufficient to drive the time-keeping device 1 for a duration which is equal to or greater than b days (e.g., 7 days) and less than c days (e.g., 30 days).

When the result of the comparison (step S6) between the absolute value of the battery voltage VTKN corresponding to the output of the first remaining voltage detection unit 113 of the remaining voltage detection unit 118 (N: A, B, C) and the absolute value of the voltage=VA is

|VTKN| |VA|

(No at step S6), it is discriminated that this state is a state in which the B display operation as described above should be performed (step S5).

In the discrimination at step S6, if

|VTKN| |VA|

(Yes at step S6), it is discriminated that this state is a state in which an A display operation, where the second hand is advanced from the current display position by 5 seconds in 8 [Hz] hand moving steps, should be performed (step S7).

Therefore, in this state where the A display operation should be performed, if the second external input unit G is operated, thereby inputting a remaining voltage display input signal to the remaining voltage display unit 116 and instructing a transition to a remaining battery voltage display mode, then the remaining voltage display signal ST is output from the remaining voltage display unit 116 to the motor driving unit E, and the motor driving unit E drives the stepping motor by the motor driving signal SF, so as to advance the second hand from the current display position by 5 seconds in 8 [Hz] hand moving steps (=A display operation).

As illustrated in FIG. 12, the A display operation is performed when it is discriminated that the battery voltage VTKN is sufficient to drive the time-keeping device 1 for a duration which is equal to or greater than a days (e.g., 1 day) and less than b days (e.g., 7 days).

When the result of the comparison (step S8) between the absolute value of the battery voltage VTKN corresponding to the output of the first remaining voltage detection unit 113 of the remaining voltage detection unit 118 (N: A, B, C) and the absolute value of the voltage=VBLD is

|VTKN| |VBLD|

(No at step S8), it is discriminated that this state is a state in which the A display operation as described above should be performed (step S7).

In the discrimination at step S8, if

|VTKN| |VBLD|

(Yes at step S8), it is discriminated that this state is a state in which a BLD display operation, where the second hand is advanced by two steps (by two seconds) at once for every two seconds, rather than advancing the second hand by one step for every second, should be performed (step S9).

Therefore, in this state where the BLD display operation should be performed, the remaining voltage display signal ST is output from the remaining voltage display unit 116 to the motor driving unit E, and the motor driving unit E drives the stepping motor by the motor driving signal SF, so as to advance the second hand by two steps (by two seconds) at once for every two seconds, rather than advancing the second hand by one step for every second (=BLD display operation).

As illustrated in FIG. 12, the BLD display operation is performed when it is discriminated that the battery voltage VTKN is sufficient to drive the time-keeping device 1 for a duration which is less than a days (e.g., 1 day).

[1.3.1.2] Operation During Normal Charging Mode

Figure 11B:
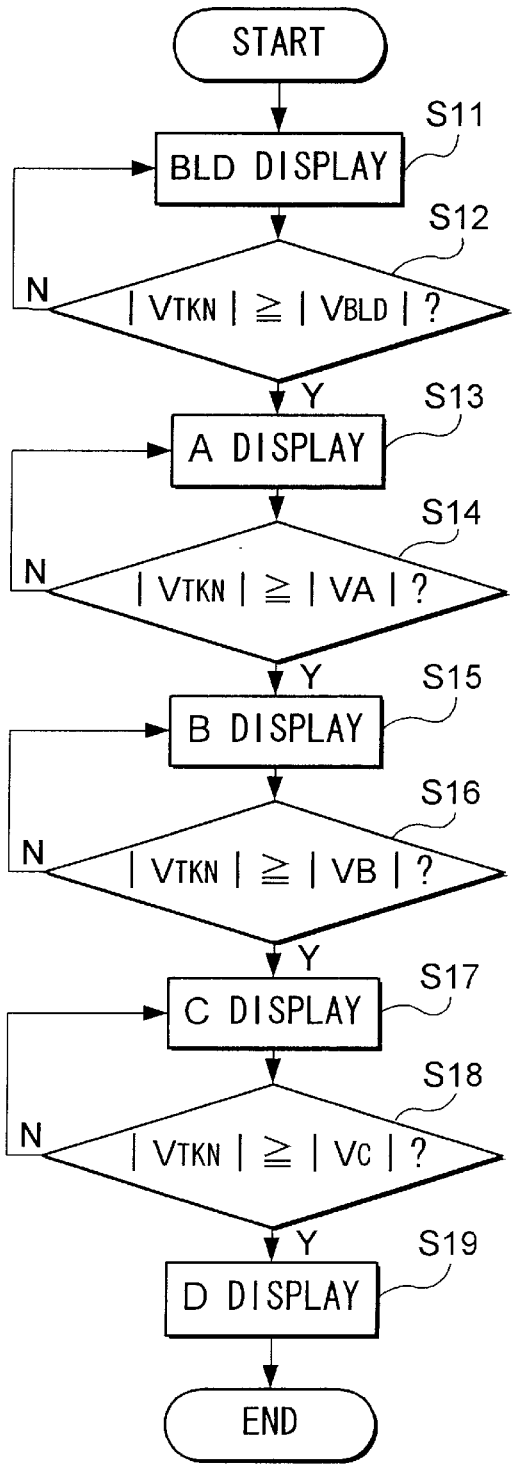
FIG. 11*b* is a flow chart illustrating the operation during a normal charging mode.

Next, the operation in a normal charging mode during which the voltage of the large-capacity capacitor 48 increases due to the power generation from carrying around the timepiece (hereinafter, "carry-around power generation" ) will be described with reference to FIG. 11*b*.

Figure 13:
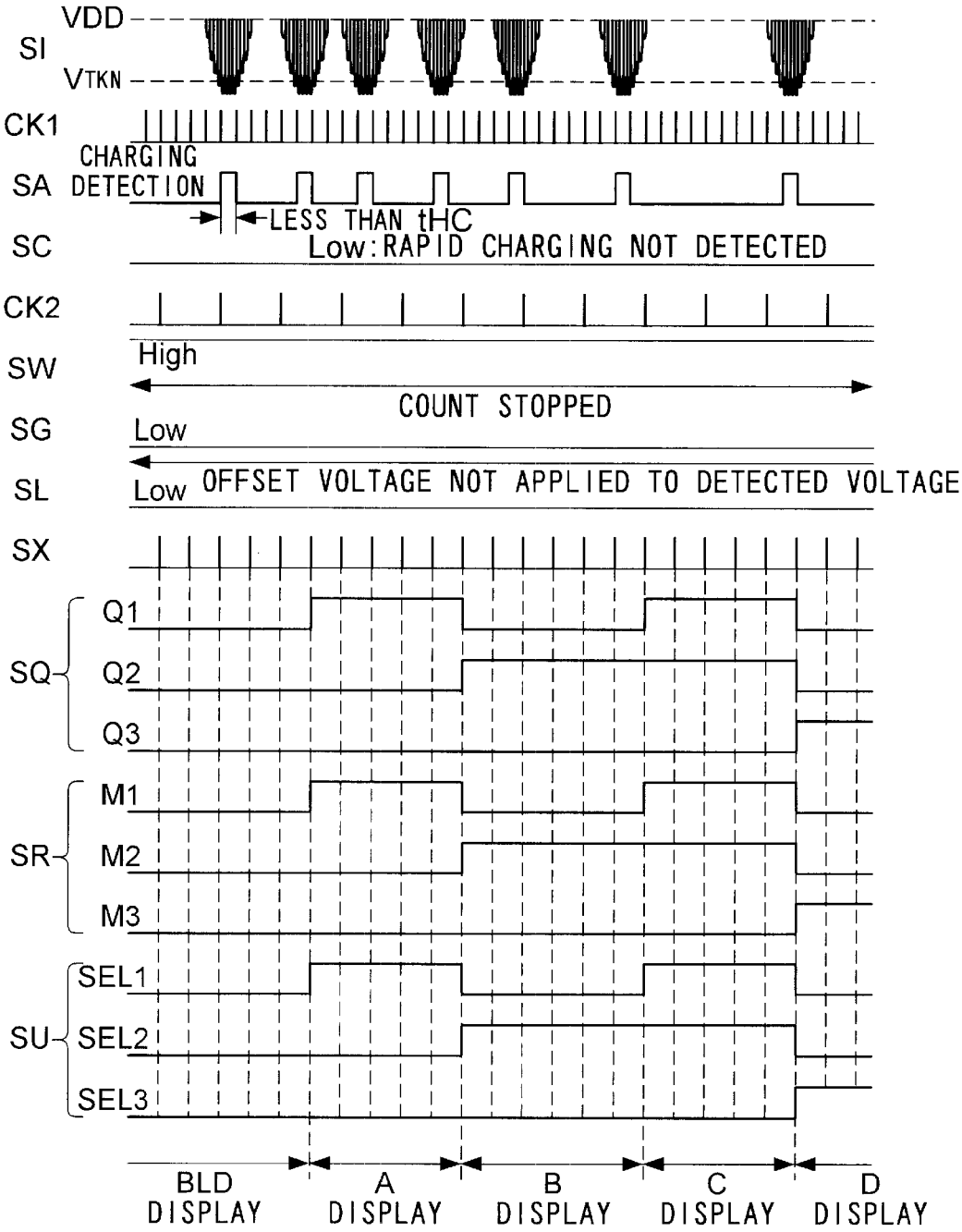
FIG. 13 is a diagram illustrating the operation during the normal charging mode.

During the carrying-around power generation mode, the period during which the charging detection signal SA is at the "H" level, i.e., the period during which the power generation voltage SI exceeds the battery voltage VTKN, is less than a time tHC, as illustrated in FIG. 13, and the rapid charging detection signal SC is always at the "L" level. The non-rapid charging time measurement completion signal SW is always at the "H" level, and the count operation is stopped.

Moreover, the voltage detection correction signal SG is always at the "L" level, whereby the offset voltage is never added to the detected voltage.

The remaining voltage display rank-up inhibition signal SL is always at the "L" level, whereby the remaining voltage display rank-up operation is never inhibited.

As can be seen from FIG. 13, the state of each of the first remaining voltage display detection signal SQ, the second remaining voltage display detection signal SR and the remaining voltage display result signal SU changes at the transition timing of the voltage detection timing signal SX.

In the initial state, if the absolute value of the battery voltage VTKN corresponding to the output of the first remaining voltage detection unit 113 of the remaining voltage detection unit 118 (N: A, B, C) is smaller than the absolute value of the voltage=VBLD, i.e., if

|VTKN| |VBLD|, it is discriminated that this state is a state in which the BLD display operation, where the second hand is advanced by two steps (by two seconds) at once for every two seconds, rather than advancing the second hand by one step for every second, should be performed (step S11).

Therefore, in this state where the BLD display operation should be performed, the remaining voltage display signal ST is output from the remaining voltage display unit 116 to the motor driving unit E, and the motor driving unit E drives the stepping motor by the motor driving signal SF, so as to advance the second hand by two steps (by two seconds) at once for every two seconds, rather than advancing the second hand by one step for every second (=BLD display operation).

More specifically, as illustrated in FIG. 13, the output terminal Q1 of the up/down counter of the first remaining voltage detection unit 113 is at the "L" level, the output terminal Q2 thereof is at the "L" level and the output terminal Q3 thereof is at the "L" level (the first remaining voltage display detection signal SQ), while the output terminal M1 of the flip-flop circuit 210 of the second remaining voltage detection unit 114 is at the "L" level, the output terminal M2 of the flip-flop circuit 211 thereof is at the "L" level and the output terminal M3 of the flip-flop circuit 212 thereof is at the "L" level (the second remaining voltage display detection signal SR).

As a result,

N=n, whereby the resultant first remaining voltage display detection signal SQ is output from the output terminals SEL1 to SEL3 of the selection circuit 115B of the comparison unit 115, where the output terminal SEL1="L" level, the output terminal SEL2="L" level and the output terminal SEL3="L" level. Thus, in response to the remaining voltage display result signal SU corresponding to the state of the output terminals SEL1 to SEL3, the remaining voltage display unit 116 performs the BLD display operation.

When the result of the comparison (step S12) between the absolute value of the battery voltage VTKN corresponding to the output of the first remaining voltage detection unit 113 of the remaining voltage detection unit 118 (N: A, B, C) and the absolute value of the voltage=VBLD is

|VTKN|<|VBLD|

(No at step S12), it is discriminated that this state is a state in which the BLD display operation as described above should be performed (step S11).

In the discrimination at step S12, if

|VTKN| |VBLD|

(Yes at step S12), the BLD display operation, where the second hand is advanced by two steps (by two seconds) at once for every two seconds, is switched to the normal hand moving mode, where the second hand is advanced by one step (by one second) for every second, and it is discriminated that this state is a state in which the A display operation, where the second hand is advanced from the current display position by 5 seconds in 8 [Hz] hand moving steps, should be performed (step S13).

Therefore, in this state where the A display operation should be performed, if the second external input unit G is operated, thereby inputting a remaining voltage display input signal to the remaining voltage display unit 116 and instructing a transition to a remaining battery voltage display mode, then the remaining voltage display signal ST is output from the remaining voltage display unit 116 to the motor driving unit E, and the motor driving unit E drives the stepping motor by the motor driving signal SF, so as to advance the second hand from the current display position by 5 seconds in 8 [Hz] hand moving steps (=A display operation).

More specifically, as illustrated in FIG. 13, the output terminal Q1 of the up/down counter of the first remaining voltage detection unit 113 is at the "H" level, the output terminal Q2 thereof is at the "L" level and the output terminal Q3 thereof is at the "L" level (the first remaining voltage display detection signal SQ), while the output terminal M1 of the flip-flop circuit 210 of the second remaining voltage detection unit 114 is at the "H" level, the output terminal M2 of the flip-flop circuit 211 thereof is at the "L" level and the output terminal M3 of the flip-flop circuit 212 thereof is at the "L" level (the second remaining voltage display detection signal SR).

As a result,

N=n, whereby the resultant first remaining voltage display detection signal SQ is output from the output terminals SEL1 to SEL3 of the selection circuit 115B of the comparison unit 115, where the output terminal SEL1="H" level, the output terminal SEL2="L" level and the output terminal SEL3="L" level. Thus, in response to the remaining voltage display result signal SU corresponding to the state of the output terminals SEL1 to SEL3, the remaining voltage display unit 116 performs the A display operation.

When the result of the comparison (step S14) between the absolute value of the battery voltage VTKN corresponding to the output of the first remaining voltage detection unit 113 of the remaining voltage detection unit 118 (N: A, B, C) and the absolute value of the voltage=VA is

|VTKN|<|VA|

(No at step S14), it is discriminated that this state is a state in which the A display operation as described above should be performed (step S13).

In the discrimination at step S14, if

|VTKN| |VA|

(Yes at step S14), it is discriminated that this state is a state in which the B display operation, where the second hand is advanced from the current display position by 10 seconds in 8 [Hz] hand moving steps, should be performed (step S15).

Therefore, in this state where the B display operation should be performed, if the second external input unit G is operated, thereby inputting a remaining voltage display input signal to the remaining voltage display unit 116 and instructing a transition to a remaining battery voltage display mode, then the remaining voltage display signal ST is output from the remaining voltage display unit 116 to the motor driving unit E, and the motor driving unit E drives the stepping motor by the motor driving signal SF, so as to advance the second hand from the current display position by 10 seconds in 8 [Hz] hand moving steps (=B display operation).

More specifically, as illustrated in FIG. 13, the output terminal Q1 of the up/down counter of the first remaining voltage detection unit 113 is at the "L" level, the output terminal Q2 thereof is at the "H" level and the output terminal Q3 thereof is at the "L" level (the first remaining voltage display detection signal SQ), while the output terminal M1 of the flip-flop circuit 210 of the second remaining voltage detection unit 114 is at the "L" level, the output terminal M2 of the flip-flop circuit 211 thereof is at the "H" level and the output terminal M3 of the flip-flop circuit 212 thereof is at the "L" level (the second remaining voltage display detection signal SR).

As a result,

N=n, whereby the resultant first remaining voltage display detection signal SQ is output from the output terminals SEL1 to SEL3 of the selection circuit 115B of the comparison unit 115, where the output terminal SEL1="L" level, the output terminal SEL2="H" level and the output terminal SEL3="L" level. Thus, in response to the remaining voltage display result signal SU corresponding to the state of the output terminals SEL1 to SEL3, the remaining voltage display unit 116 performs the B display operation.

When the result of the comparison (step S16) between the absolute value of the battery voltage VTKN corresponding to the output of the first remaining voltage detection unit 113 of the remaining voltage detection unit 118 (N: A, B, C) and the absolute value of the voltage=VB is

|VTKN|<|VB|

(No at step S16), it is discriminated that this state is a state in which the B display operation as described above should be performed (step S15).

In the discrimination at step S16, if

|VTKN| |VB|

(Yes at step S16), it is discriminated that this state is a state in which the C display operation, where the second hand is advanced from the current display position by 20 seconds in 16 [Hz] hand moving steps, should be performed (step S17).

Therefore, in this state where the C display operation should be performed, if the second external input unit G is operated, thereby inputting a remaining voltage display input signal to the remaining voltage display unit 116 and instructing a transition to a remaining battery voltage display mode, then the remaining voltage display signal ST is output from the remaining voltage display unit 116 to the motor driving unit E, and the motor driving unit E drives the stepping motor by the motor driving signal SF, so as to advance the second hand from the current display position by 20 seconds in 16 [Hz] hand moving steps (=C display operation).

More specifically, as illustrated in FIG. 13, the output terminal Q1 of the up/down counter of the first remaining voltage detection unit 113 is at the "H" level, the output terminal Q2 thereof is at the "H" level and the output terminal Q3 thereof is at the "L" level (the first remaining voltage display detection signal SQ), while the output terminal M1 of the flip-flop circuit 210 of the second remaining voltage detection unit 114 is at the "H" level, the output terminal M2 of the flip-flop circuit 211 thereof is at the "H" level and the output terminal M3 of the flip-flop circuit 212 thereof is at the "L" level (the second remaining voltage display detection signal SR).

As a result,

N=n, whereby the resultant first remaining voltage display detection signal SQ is output from the output terminals SEL1 to SEL3 of the selection circuit 115B of the comparison unit 115, where the output terminal SEL1="H" level, the output terminal SEL2="H" level and the output terminal SEL3="L" level. Thus, in response to the remaining voltage display result signal SU corresponding to the state of the output terminals SEL1 to SEL3, the remaining voltage display unit 116 performs the C display operation.

When the result of the comparison (step S18) between the absolute value of the battery voltage VTKN corresponding to the output of the first remaining voltage detection unit 113 of the remaining voltage detection unit 118 (N: A, B, C) and the absolute value of the voltage=VC is

|VTKN|<|VC|

(No at step S18), it is discriminated that this state is a state in which the C display operation as described above should be performed (step S17).

In the discrimination at step S18, if

|VTKN| |VC|

(Yes at step S18), it is discriminated that this state is a state in which the D display operation, where the second hand is advanced from the current display position by 30 seconds in 16 [Hz] hand moving steps, should be performed (step S19).

Therefore, in this state where the D display operation should be performed, if the second external input unit G is operated, thereby inputting a remaining voltage display input signal to the remaining voltage display unit 116 and instructing a transition to a remaining battery voltage display mode, then the remaining voltage display signal ST is output from the remaining voltage display unit 116 to the motor driving unit E, and the motor driving unit E drives the stepping motor by the motor driving signal SF, so as to perform the D display operation of advancing the second hand from the current display position by 30 seconds in 16 [Hz] hand moving steps (step S19).

More specifically, as illustrated in FIG. 13, the output terminal Q1 of the up/down counter of the first remaining voltage detection unit 113 is at the "L" level, the output terminal Q2 thereof is at the "L" level and the output terminal Q3 thereof is at the "H" level (the first remaining voltage display detection signal SQ), while the output terminal M1 of the flip-flop circuit 210 of the second remaining voltage detection unit 114 is at the "L" level, the output terminal M2 of the flip-flop circuit 211 thereof is at the "L" level and the output terminal M3 of the flip-flop circuit 212 thereof is at the "H" level (the second remaining voltage display detection signal SR).

As a result,

N=n, whereby the resultant first remaining voltage display detection signal SQ is output from the output terminals SEL1 to SEL3 of the selection circuit 115B of the comparison unit 115, where the output terminal SEL1="L" level, the output terminal SEL2="L" level and the output terminal SEL3="H" level. Thus, in response to the remaining voltage display result signal SU corresponding to the state of the output terminals SEL1 to SEL3, the remaining voltage display unit 116 performs the D display operation.

[1.3.2] Operation During Rapid Charging Mode

Next, the remaining voltage display operation of the large-capacity capacitor 48 (=secondary power source) during a rapid charging mode (a mode during which the battery is being charged by the user deliberately shaking the time-keeping device; hereinafter, "shake-charge operation") will be described.

First, before the detailed description of the remaining voltage display operation, the influence of the apparent voltage increase during the rapid charging mode will be described.

The apparent voltage increase in the large-capacity capacitor 48 is due to the internal resistance of the large-capacity capacitor 48.

The range of the amount of the apparent voltage increase in the large-capacity capacitor 48 is a generally fixed range dependent upon the type of the large-capacity capacitor 48 used. By obtaining the amount of the apparent voltage increase as an offset voltage VO/S in advance, the influence thereof can be reduced.

Now, a calculation of the amount of the apparent voltage increase will be described with reference to FIG. 14.

Figure 14:
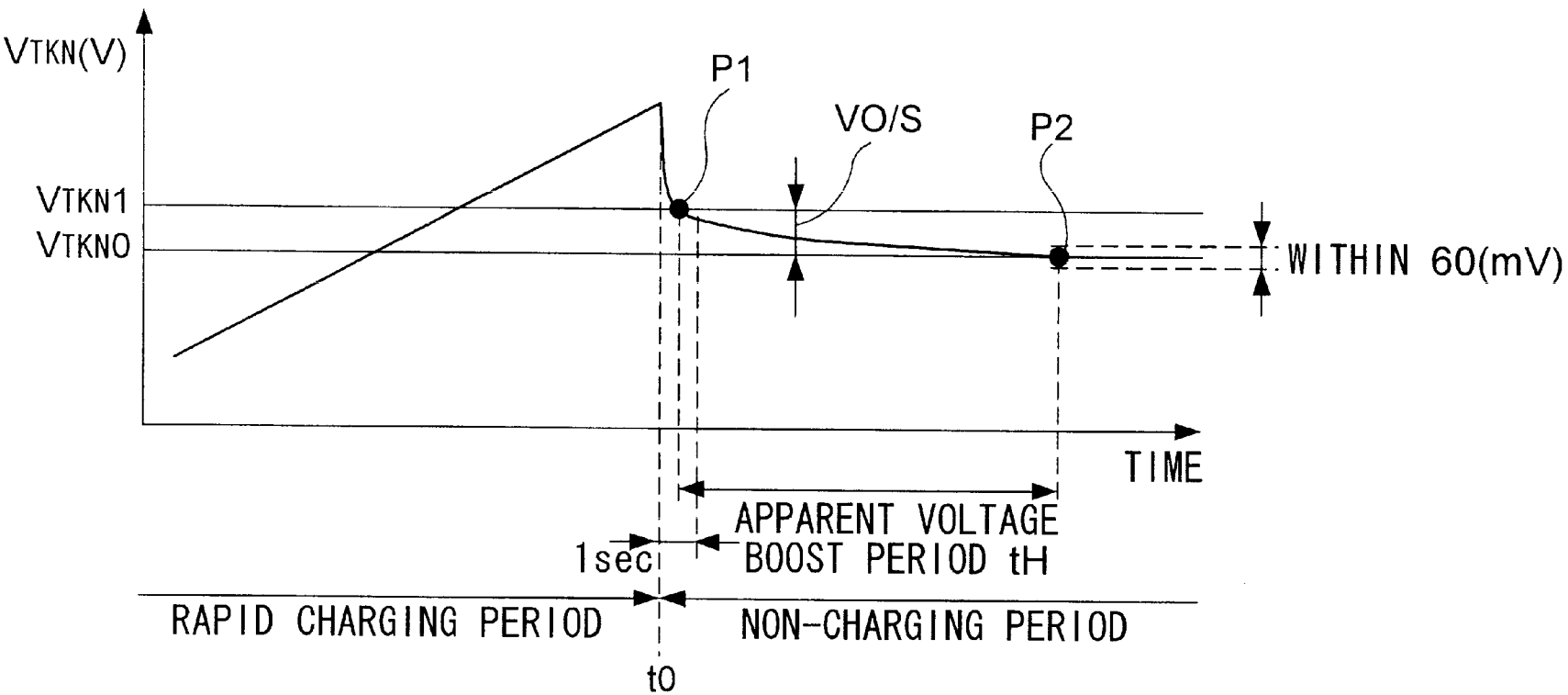
FIG. 14 is a diagram illustrating the calculation of an amount of an apparent voltage increase.
Figure 16:
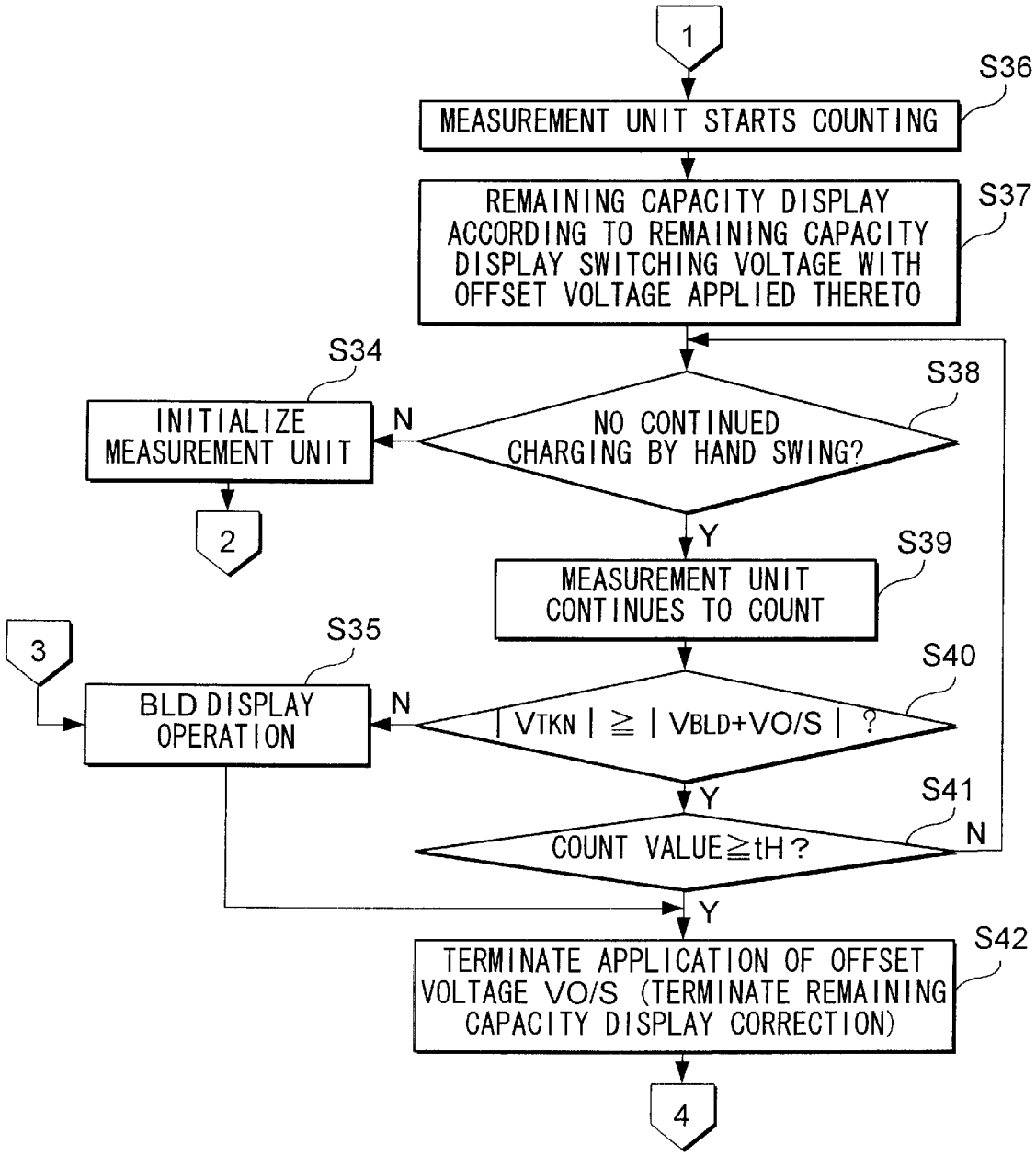
FIG. 16 is a flow chart (part 2) illustrating the operation during the rapid charging mode.
Figure 17:
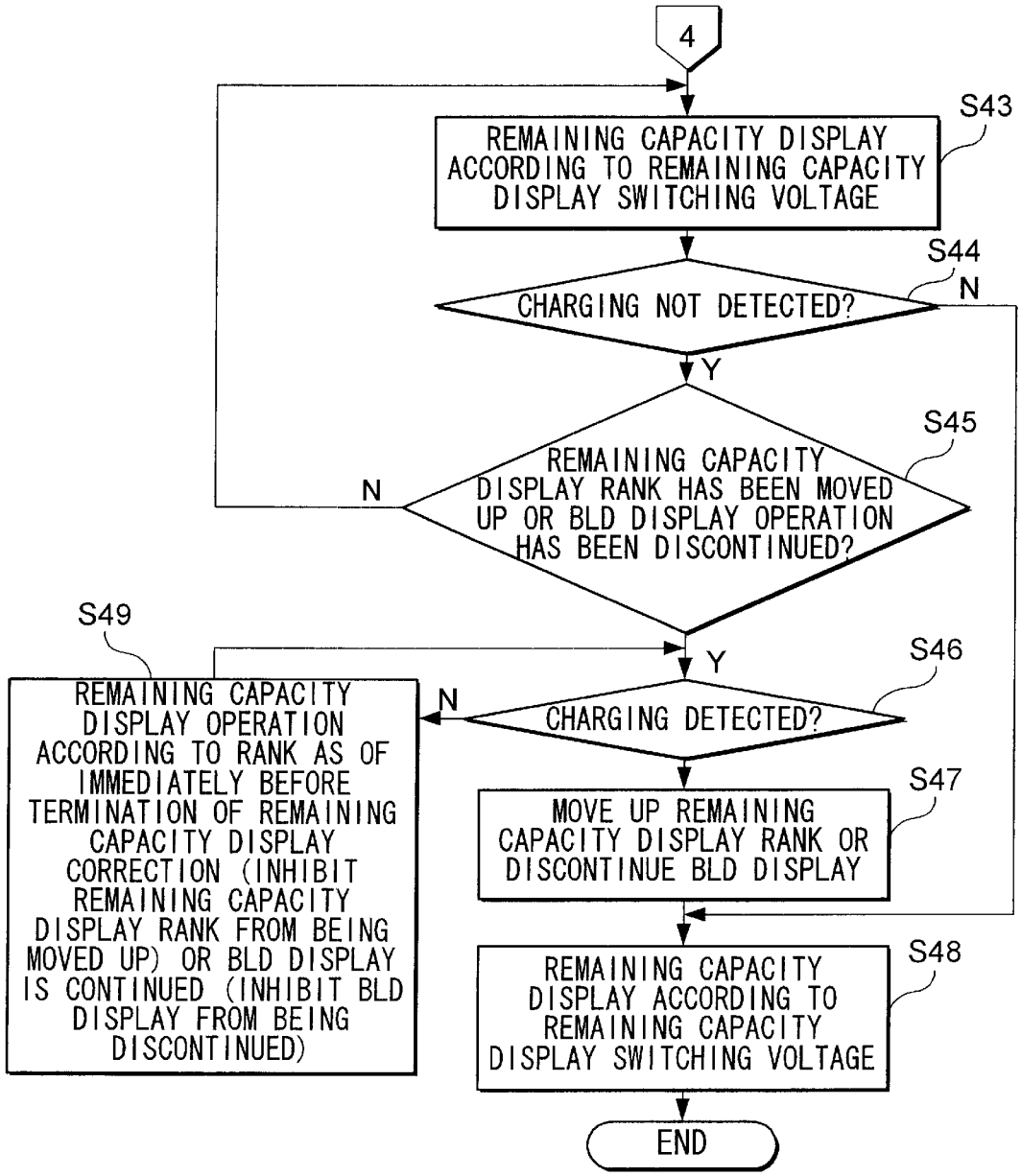
FIG. 17 is a flow chart (part 3) illustrating the operation during the rapid charging mode.

As illustrated in FIG. 14, a desired timing within one second from time t0, at which the rapid charging period ends, is assumed as a start timing P1 at which the apparent voltage increase starts.

Then, a battery voltage VTKN1 is measured as the battery voltage at the start timing P1.

Next, during the following non-charging period, the battery voltage VTKN is measured for a sufficiently long time, and a true battery voltage VTKN0 is measured as the battery voltage VTKN of the large-capacity capacitor 48 at an end timing P2 at which the fluctuation thereof is within 60 [mV].

Then, the offset voltage VO/S, or the amount of the apparent voltage increase, is calculated as the voltage difference between the obtained battery voltages VTKN1 and VTK0 as follows:

VO/S=VTKN1−VTKN0

Next, the operation in a period during which the voltage of the large-capacity capacitor 48 increases by the shake-charge operation, i.e., the rapid charging mode, will be described with reference to FIGS. 15 to 19.

Figure 19:
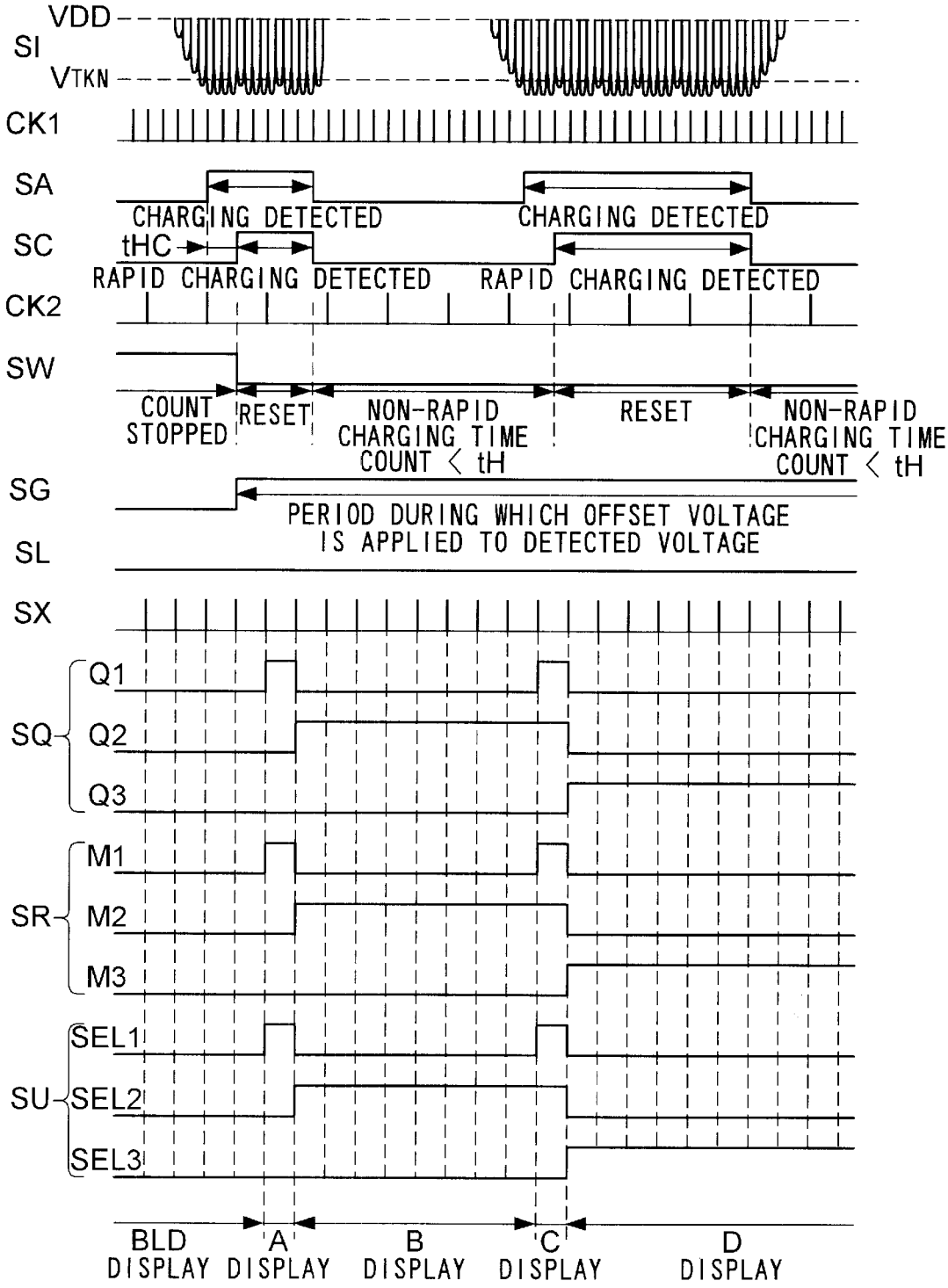
FIG. 19 is a flow chart (part 5) illustrating the operation during the rapid charging mode.

As illustrated in FIG. 19, in the rapid charging mode, the period of time during which the charging detection signal SA is at the "H" level, i.e., the period of time during which the power generation voltage SI exceeds the battery voltage VTKN, is equal to or greater than the time tHC. The rapid charging detection signal SC is at the "H" level within a period of time during which the charging detection signal SA is at the "H" level and which is after the passage of the time tHC since the transition of the charging detection signal SA to the "H" level.

At the timing the rapid charging detection signal SC transitions to the "H" level, the non-rapid charging time measurement completion signal SW transitions to the "L" level. Thus, while the rapid charging detection signal SC is at the "H" level, the non-rapid charging time count value is reset.

When the rapid charging detection signal SC transitions to the "L" level while the non-rapid charging time measurement completion signal SW is at the "L" level, the non-rapid charging time count is started. During and after the period of time in which the rapid charging detection signal SC is at the "H" level, and while the non-rapid charging time is less than the predetermined apparent voltage increase period tH (see FIG. 14), the voltage detection correction signal SG is the "H" level so that the offset voltage SH is added to the detected voltage SK.

In the initial state, if the absolute value of the battery voltage VTKN corresponding to the output of the first remaining voltage detection unit 113 of the remaining voltage detection unit 118 (N: A, B, C) is smaller than the absolute value of the voltage=VBLD, i.e., if

|VTKN| |VBLD|, then the remaining voltage display signal ST is output from the remaining voltage display unit 116 to the motor driving unit E, and the motor driving unit E drives the stepping motor by the motor driving signal SF, so as to perform the BLD display operation of advancing the second hand by two steps (by two seconds) at once for every two seconds (step S21).

More specifically, as illustrated in FIG. 19, the output terminal Q1 of the up/down counter of the first remaining voltage detection unit 113 is at the "L" level, the output terminal Q2 thereof is at the "L" level and the output terminal Q3 thereof is at the "L" level (the first remaining voltage display detection signal SQ), while the output terminal M1 of the flip-flop circuit 210 of the second remaining voltage detection unit 114 is at the "L" level, the output terminal M2 of the flip-flop circuit 211 thereof is at the "L" level and the output terminal M3 of the flip-flop circuit 212 thereof is at the "L" level (the second remaining voltage display detection signal SR).

As a result,

N=n, whereby the resultant first remaining voltage display detection signal SQ is output from the output terminals SEL1 to SEL3 of the selection circuit 115B of the comparison unit 115, where the output terminal SEL1="L" level, the output terminal SEL2="L" level and the output terminal SEL3="L" level. Thus, in response to the remaining voltage display result signal SU corresponding to the state of the output terminals SEL1 to SEL3, the remaining voltage display unit 116 performs the BLD display operation.

Then, it is discriminated whether the shake-charge operation is being performed (step S22). Specifically, it is discriminated whether the period of time during which the charging detection signal SA is at the "H" level, i.e., the period of time during which the power generation voltage SI exceeds the battery voltage VTKN, is equal to or greater than the time tHc.

In the discrimination at step S22, if it is discriminated that the shake-charge operation is not being performed (No at step S22), the BLD display is continued (step S35). Then, the process proceeds to step S42, which is to be described later.

In the discrimination at step S22, if it is discriminated that the shake-charge operation is being performed (Yes at step S22), the offset voltage VO/S (offset voltage SH) is added to the remaining voltage display switching voltages VBLD, VA, VB and VC (detected voltage SK) so as to effect the remaining voltage display correction (step S23).

Figure 18:
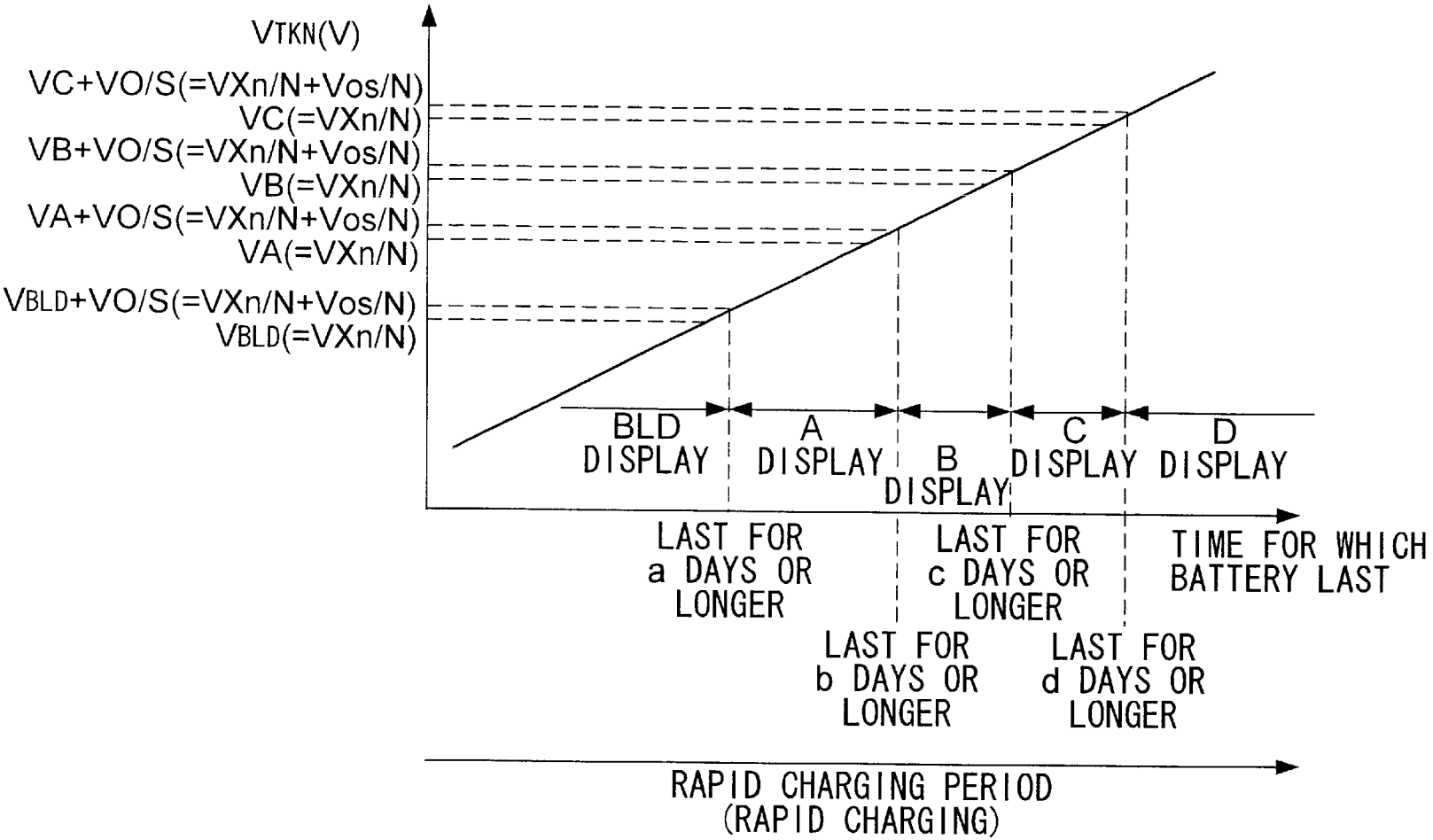
FIG. 18 is a flow chart (part 4) illustrating the operation during the rapid charging mode.

Then, the BLD display operation is continued as illustrated in FIG. 18 (step S24).

When the result of the comparison (step S25) between the absolute value of the battery voltage VTKN corresponding to the output of the first remaining voltage detection unit 113 of the remaining voltage detection unit 118 (N: A, B, C) and the absolute value of the voltage=VBLD+VO/S is

|VTKN|<|VBLD+VO/S|

(No at step S25), the process proceeds step S22 to continue the process as described above.

In the discrimination at step S25, if

|VTKN| |VBLD+VO/S|

(Yes at step S25), first, the BLD display operation is discontinued, and the hand moving mode is switched to the normal hand moving mode. Then, as illustrated in FIG. 18, it is discriminated that the A display operation, where the second hand is advanced from the current display position by 5 seconds in 8 [Hz] hand moving steps, should be performed (step S26).

Therefore, in this state where the A display operation should be performed, if the second external input unit G is operated, thereby inputting a remaining voltage display input signal to the remaining voltage display unit 116 and instructing a transition to a remaining battery voltage display mode, then the remaining voltage display signal ST is output from the remaining voltage display unit 116 to the motor driving unit E, and the motor driving unit E drives the stepping motor by the motor driving signal SF, so as to advance the second hand from the current display position by 5 seconds in 8 [Hz] hand moving steps (=A display operation).

More specifically, as illustrated in FIG. 19, the output terminal Q1 of the up/down counter of the first remaining voltage detection unit 113 is at the "H" level, the output terminal Q2 thereof is at the "L" level and the output terminal Q3 thereof is at the "L" level (the first remaining voltage display detection signal SQ), while the output terminal M of the flip-flop circuit 210 of the second remaining voltage detection unit 114 is at the "H" level, the output terminal M2 of the flip-flop circuit 211 thereof is at the "L" level and the output terminal M3 of the flip-flop circuit 212 thereof is at the "L" level (the second remaining voltage display detection signal SR).

As a result,

N=n, whereby the resultant first remaining voltage display detection signal SQ is output from the output terminals SEL1 to SEL3 of the selection circuit 115B of the comparison unit 115, where the output terminal SEL1="H" level, the output terminal SEL2="L" level and the output terminal SEL3="L" level. Thus, in to response to the remaining voltage display result signal SU corresponding to the state of the output terminals SEL1 to SEL3, the remaining voltage display unit 116 performs the A display operation.

Then, it is discriminated whether the shake-charge operation is being continued (step S27).

In the discrimination at step S27, if it is discriminated that the shake-charge operation is not being continued, the non-rapid charging time count by the measurement unit is started (step S36).

Then, the remaining voltage display operation is performed based on the remaining voltage display switching voltage (detected voltage SK) with the offset voltage VO/S (offset voltage SH) added thereto (step S37).

Then, it is discriminated whether the shake-charge operation has not been performed for a continuous period of time equal to or greater than the predetermined period tH (step S38).

In the discrimination at step S38, if it is discriminated that the shake-charge operation has been performed within the predetermined period tH (No at step S38), the measurement unit is initialized (step S34) and the process proceeds to step S28.

In the discrimination at step S38, if it is discriminated that the shake-charge operation has not been performed for a continuous period of time equal to or greater than the predetermined period tH (Yes at step S38), the count operation by the measurement unit is continued (step S39).

Then, the absolute value of the battery voltage VTKN corresponding to the output of the first remaining voltage detection unit 113 of the remaining voltage detection unit 118 (N: A, B, C) is compared with the absolute value of the voltage=VBLD+VO/S (step S40).

In the discrimination at step S40, if

|VTKN|<|VBLD+VO/S|

(No at step S40), the BLD display operation is performed (step S35), and the addition of the offset voltage VO/S (offset voltage SH) to the remaining voltage display switching voltage (detected voltage SK) is forcibly terminated, thereby forcibly terminating the remaining voltage display correction (step S42). Then, the process proceeds to step S43.

In the discrimination at step S40, if

|VTKN| |VBLD+VO/S|

(Yes at step S40), it is discriminated whether the non-rapid charging time, which is the count value of the measurement unit, is equal to or greater than the predetermined period tH (step S41).

In the discrimination at step S41, if it is discriminated that the non-rapid charging time, which is the count value of the measurement unit, is less than the predetermined period tH (No at step S41), the process proceeds to step S38 again.

In the discrimination at step S41, if it is discriminated that the non-rapid charging time, which is the count value of the measurement unit, is equal to or greater than the predetermined period tH (Yes at step S41), the addition of the offset voltage VO/S (offset voltage SH) to the remaining voltage display switching voltage (detected voltage SK) is terminated, thereby terminating the remaining voltage display correction (step S42).

Then, the remaining voltage display operation is performed based on the remaining voltage display switching voltage (detected voltage SK) (step S43).

Then, it is discriminated whether charging is not being detected based on the charging detection signal SA (step S44).

In the discrimination at step S44, if it is discriminated that charging is being detected (No at step S44), the remaining voltage display operation is performed based on the remaining voltage display switching voltage (detected voltage SK), and the process is terminated (step S48).

In the discrimination at step S44, if it is discriminated that charging is not being detected (Yes at step S44), it is discriminated whether the remaining voltage display rank has been moved up (e.g., from the A display operation to the B display operation) or the BLD display operation has been discontinued (step S45).

In the discrimination at step S45, if it is discriminated that the remaining voltage display rank has not been moved up and the BLD display operation has not been discontinued (No at step S45), the process proceeds to step S43 again to repeat the process as described above.

In the discrimination at step S45, if it is discriminated that the remaining voltage display rank has been moved up or the BLD display operation has been discontinued (Yes at step S45), it is discriminated whether charging is being detected based on the charging detection signal SA again (step S46).

In the discrimination at step S46, if it is discriminated that charging is not being detected (No at step S46), the remaining voltage display operation according to the remaining voltage display rank as of immediately before the termination of the remaining voltage display correction or the BLD display operation is continued without discontinuing the BLD display operation (step S49), and the process proceeds to step S46 again.

In the discrimination at step S46, if it is discriminated that charging is being detected, the remaining voltage display rank is moved up or the BLD display operation is discontinued (step S47), and the remaining voltage display operation is performed based on the remaining voltage display switching voltage (detected voltage SK). Then, the process is terminated (step S48).

In the discrimination at step S27, if it is discriminated that the shake-charge operation is being continued, the absolute value of the battery voltage VTKN corresponding to the output of the first remaining voltage detection unit 113 of the remaining voltage detection unit 118 (N: A, B, C) is compared with the absolute value of the voltage=VA+VO/S (step S28).

In the discrimination at step S28, if

|VTKN|<|VA+VO/S|

(No at step S28), the process proceeds to step S26 to perform the process as described above.

In the discrimination at step S28, if

|VTKN| |VA+VO/S|

(Yes at step S28), then as illustrated in FIG. 18, it is discriminated that the B display operation can be performed (step S29), where the remaining voltage display signal ST is output from the remaining voltage display unit 116 to the motor driving unit E, and the motor driving unit E drives the stepping motor by the motor driving signal SF, so as to advance the second hand from the current display position by 10 seconds in 8 [Hz] hand moving steps. (Step S29)

More specifically, as illustrated in FIG. 19, the output terminal Q1 of the up/down counter of the first remaining voltage detection unit 113 is at the "L" level, the output terminal Q2 thereof is at the "H" level and the output terminal Q3 thereof is at the "L" level (the first remaining voltage display detection signal SQ), while the output terminal M1 of the flip-flop circuit 210 of the second remaining voltage detection unit 114 is at the "L" level, the output terminal M2 of the flip-flop circuit 211 thereof is at the "H" level and the output terminal M3 of the flip-flop circuit 212 thereof is at the "L" level (the second remaining voltage display detection signal SR).

As a result,

N=n, whereby the resultant first remaining voltage display detection signal SQ is output from the output terminals SEL1 to SEL3 of the selection circuit 115B of NO the comparison unit 115, where the output terminal SEL1="L" level, the output terminal SEL2="H" level and the output terminal SEL3="L" level. Thus, in response to the remaining voltage display result signal SU corresponding to the state of the output terminals SEL1 to SEL3, the remaining voltage display unit 116 performs the B display operation.

Then, it is discriminated whether the shake-charge operation is being continued (step S30).

In the discrimination at step S30, if it is discriminated that the shake-charge operation is not being continued (No at step S30), the process proceeds to step S36 to perform the process as described above.

In the discrimination at step S30, if it is discriminated that the shake-charge operation is being continued, the absolute value of the battery voltage VTKN corresponding to the output of the first remaining voltage detection unit 113 of the remaining voltage detection unit 118 (N: A, B, C) is compared with the absolute value of the voltage=VB+VO/S (step S31).

In the discrimination at step S31, if

|VTKN|<|VB+VO/S|

(No at step S31), the process proceeds to step S29 to perform the process as described above.

In the discrimination at step S31, if

|VTKN| |VB+VO/S|

(Yes at step S31), then as illustrated in FIG. 18, it is discriminated that the C display operation can be performed (step S32), where the remaining voltage display signal ST is output from the remaining voltage display unit 116 to the motor driving unit E, and the motor driving unit E drives the stepping motor by the motor driving signal SF, so as to advance the second hand from the current display position by 20 seconds in 16 [Hz] hand moving steps. (Step S32)

More specifically, as illustrated in FIG. 19, the output terminal Q1 of the up/down counter of the first remaining voltage detection unit 113 is at the "H" level, the output terminal Q2 thereof is at the "H" level and the output terminal Q3 thereof is at the "L" level (the first remaining voltage display detection signal SQ), while the output terminal M1 of the flip-flop circuit 210 of the second remaining voltage detection unit 114 is at the "H" level, the output terminal M2 of the flip-flop circuit 211 thereof is at the "H" level and the output terminal M3 of the flip-flop circuit 212 thereof is at the "L" level (the second remaining voltage display detection signal SR).

As a result,

N=n, whereby the resultant first remaining voltage display detection signal SQ is output from the output terminals SEL1 to SEL3 of the selection circuit 115B of the comparison unit 115, where the output terminal SEL1="H" level, the output terminal SEL2="H" level and the output terminal SEL3="L" level. Thus, in response to the remaining voltage display result signal SU corresponding to the state of the output terminals SEL1 to SEL3, the remaining voltage display unit 116 performs the C display operation.

Thereafter, the process further proceeds in a manner as described above;

if it is discriminated that the shake-charge operation is being continued (step S33), the remaining voltage display is performed based on the voltage (detected voltage SK+offset voltage SH), i.e., the remaining voltage display switching voltage (detected voltage SK) with the offset voltage VO/S (offset voltage SH) being added thereto.

In this way, it is possible to perform a remaining voltage display operation with an improved accuracy by reducing the influence of the apparent voltage increase which occurs when the rapid charging operation is being performed due to the internal resistance of the large-capacity capacitor 48.

Figure 20:
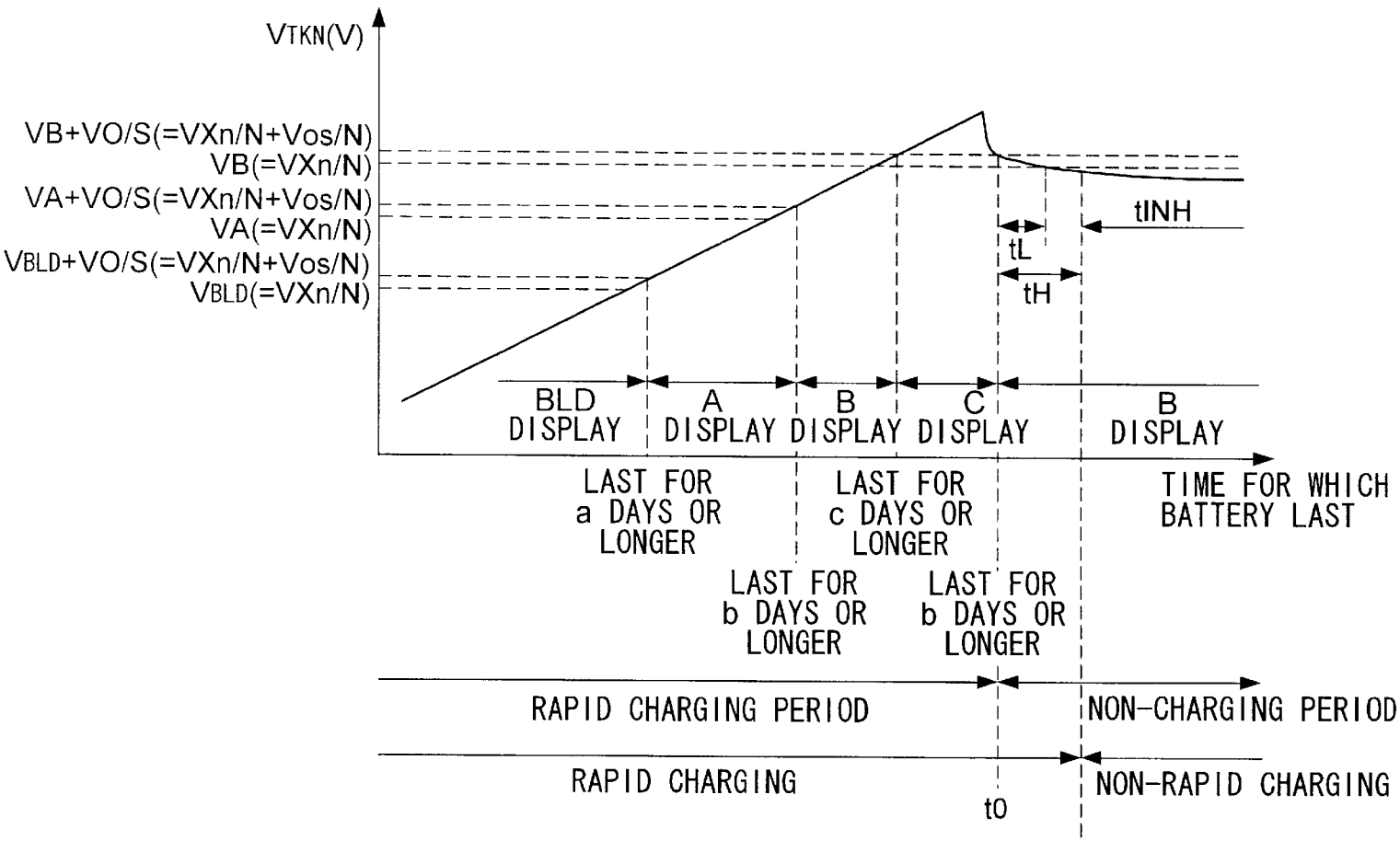
FIG. 20 is a diagram illustrating the operation of transitioning from the rapid charging period to the non-charging period.
Figure 21:
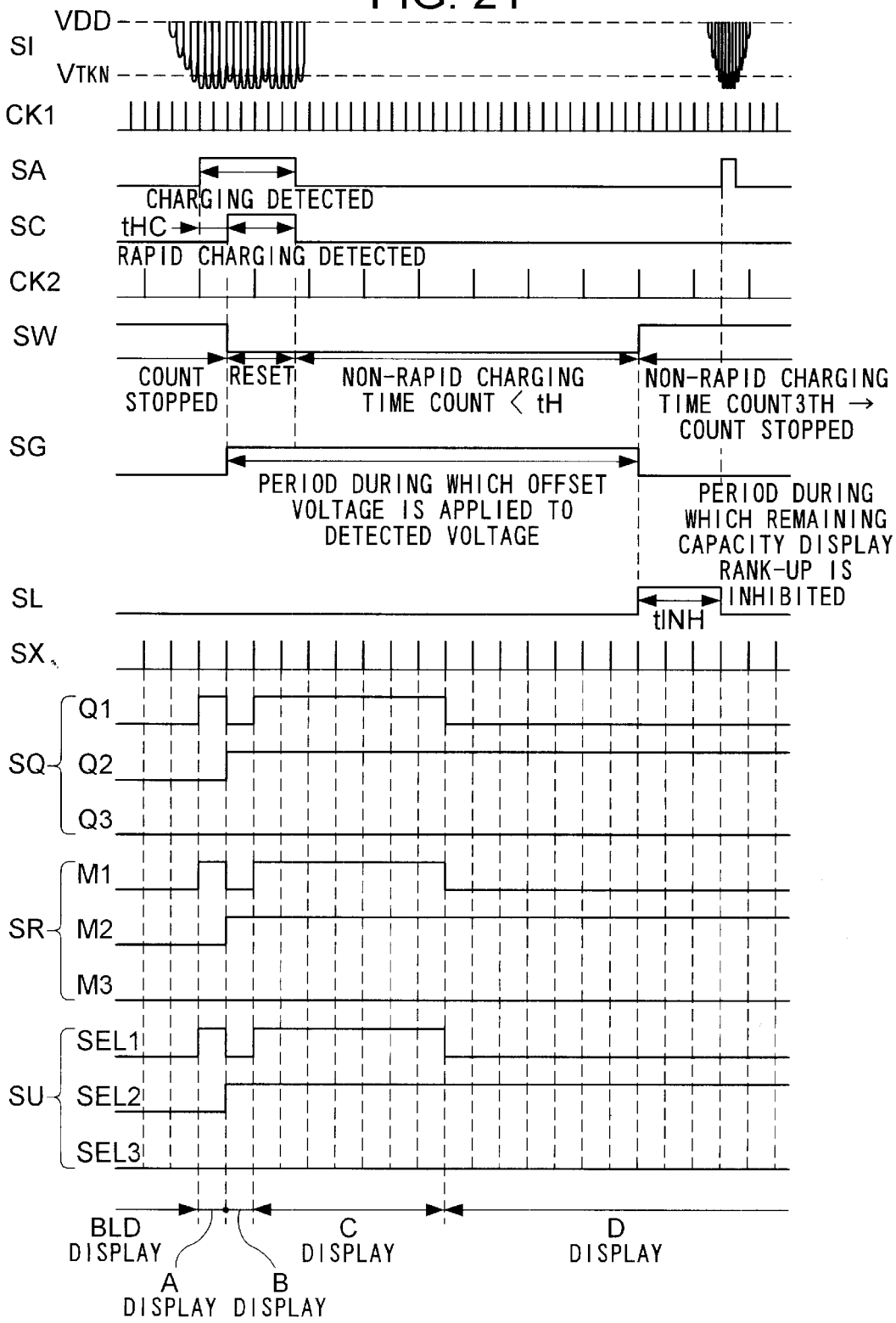
FIG. 21 is a timing chart for the operation of transitioning from the rapid charging period to the non-charging period.

[1.3.3] Operation of Transitioning From Rapid Charging Period to Non-charging Period FIG. 20 illustrates the operation of transitioning from the rapid charging period to the non-charging period, and FIG. 21 illustrates a timing chart for the operation of transitioning from the rapid charging period to the non-charging period.

When transitioning from the rapid charging period to the non-charging period, there is an influence of the apparent voltage increase due to the internal resistance of the large-capacity capacitor 48.

In view of this, the voltage detection correction signal SG is held at the "H" level continuously from the rapid charging detection period so that the offset voltage SH (offset voltage VO/S) continues to be added to the detected voltage SK (remaining voltage display switching voltage) until the non-rapid charging time count value exceeds the time tH, in either of the following situations: when transitioning from the rapid charging period to the noncharging period at time t0, as illustrated in FIG. 20; or when the rapid charging detection signal SC first transitions to the "H" level by detecting rapid charging, thereafter transitioning to the "L" level by not detecting rapid charging any more, as illustrated in FIG. 21.

In such a case, because the first remaining voltage display detection signal SQ, the second remaining voltage display detection signal SR and the remaining voltage display result signal SU change in synchronism with the voltage detection timing signal SX, and because the remaining voltage display rank-up inhibition signal SL is at the "L" level, the first remaining voltage display detection signal SQ and the second remaining voltage display detection signal SR are identical to each other, whereby the remaining voltage display result signal SU which is output from the selection circuit 115B is equal to the first remaining voltage display detection signal SQ.

As a result, even though there is an erroneous remaining voltage display period tL, as illustrated in FIG. 20, during which the remaining voltage display is erroneous if the discrimination is made by using the remaining voltage display switching voltage (detected voltage SK) without the offset voltage VO/S (offset voltage SH) added thereto, the erroneous remaining voltage display period tL is included in the remaining voltage display correction period tH, thereby eliminating the occurrence of any erroneous remaining voltage display.

Figure 22:
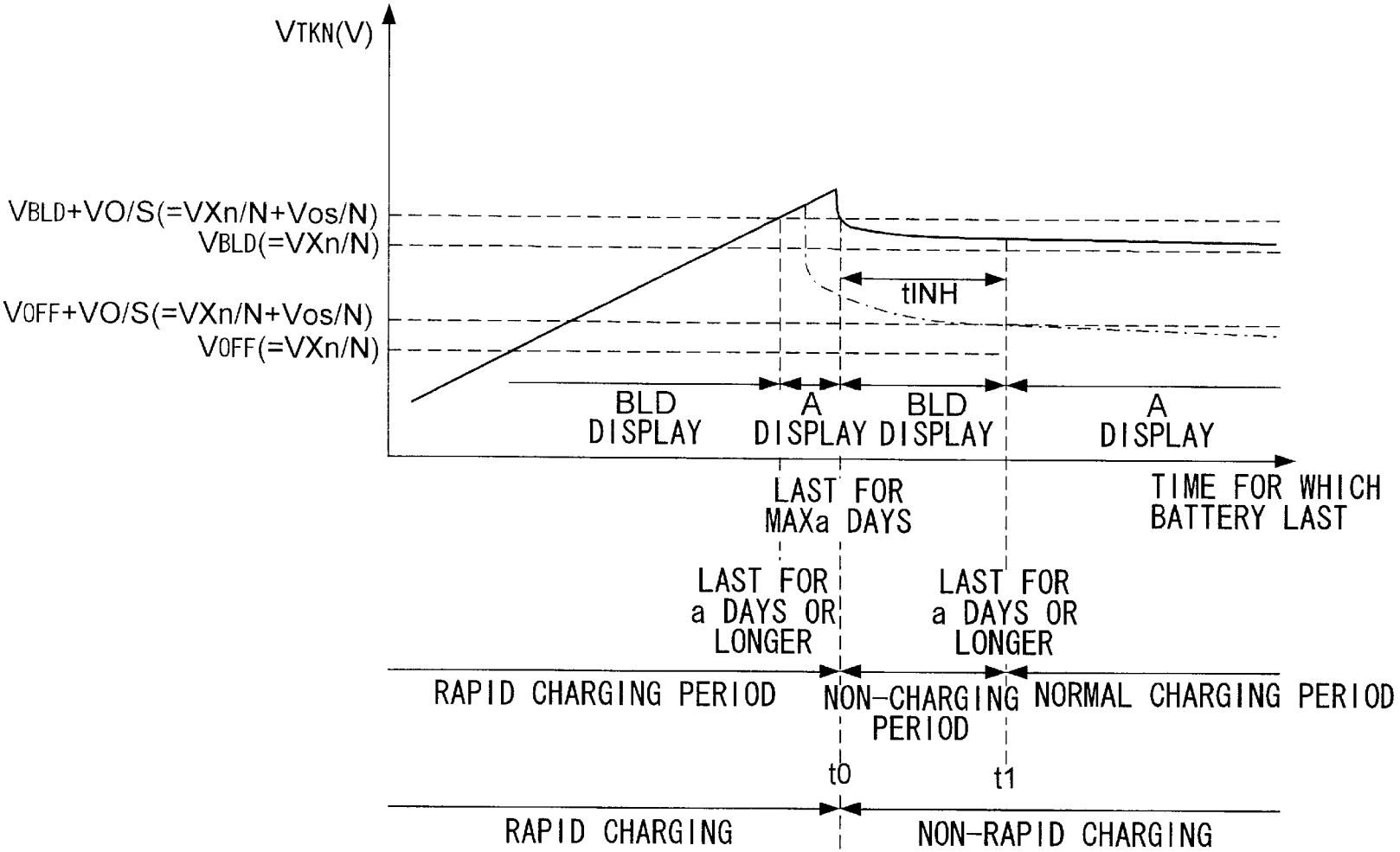
FIG. 22 is a diagram illustrating the operation of transitioning from the rapid charging period→the non-charging period→the normal charging period.
Figure 23:
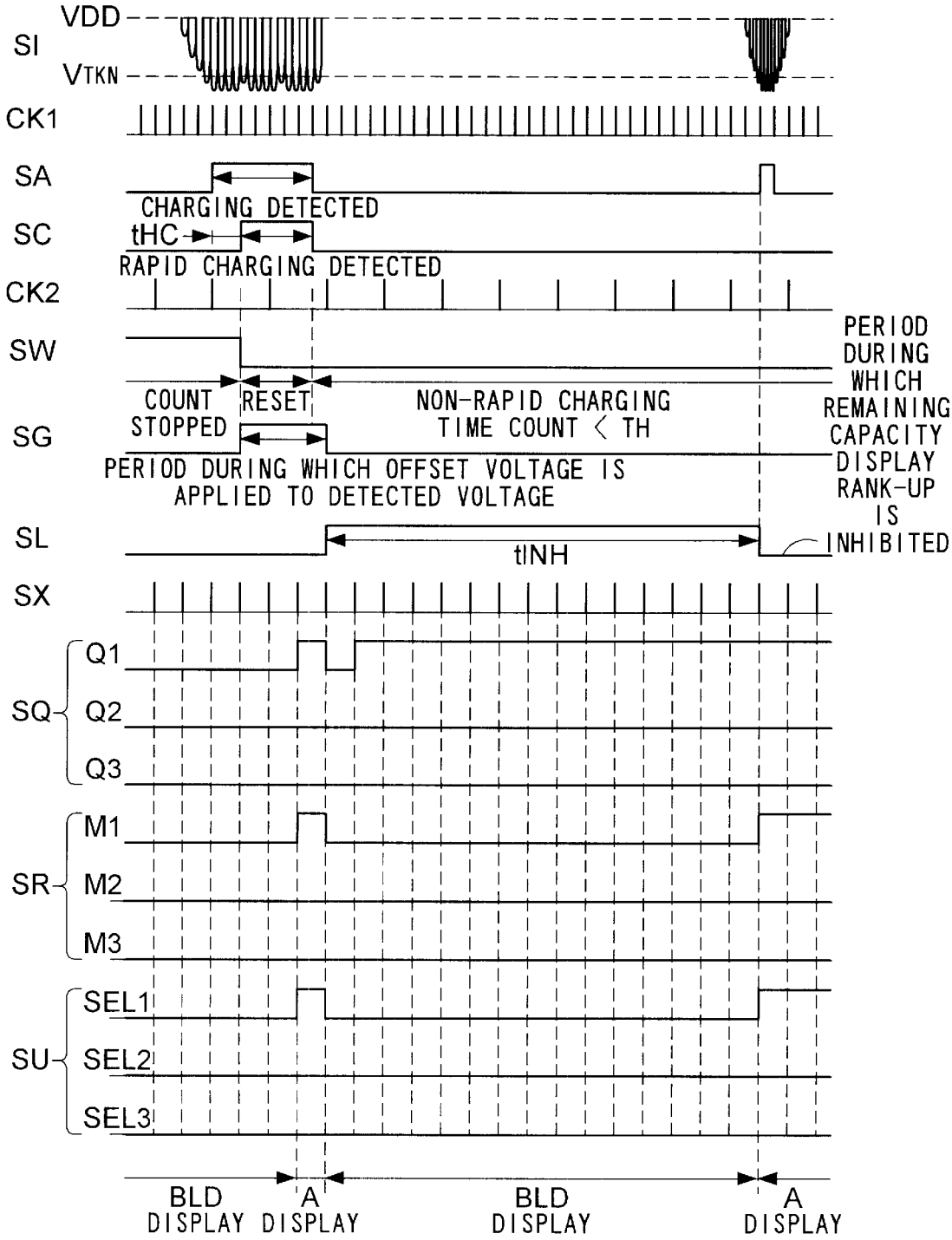
FIG. 23 is a timing chart illustrating the operation of transitioning from the rapid charging period→the non-charging period→the normal charging period.

[1.3.4] Operation of Transitioning From Rapid Charging Period Non-charging Period→Normal Charging Period FIG. 22 illustrates the operation of transitioning from the rapid charging period→the non-charging period→the normal charging period, and FIG. 23 illustrates a timing chart for the operation of transitioning from the rapid charging period→the non-charging period→the normal charging period.

FIGS. 22 and 23 illustrate an operation of forcibly terminating the correction operation; if the secondary power source remaining voltage display operation transitions to the BLD display operation while the non-rapid charging time is being measured during the non-charging period, then the addition of the offset voltage VO/S (offset voltage SH) to the remaining voltage display switching voltage (detected voltage SK) is terminated even when the non-rapid charging time count value has not exceeded the remaining voltage display correction period tH.

The figures also illustrate the control which is provided in order to avoid an irregular or odd transition in the display from being viewed by the user when transitioning from the rapid charging period→the non-charging period→the normal charging period.

When transitioning from the rapid charging period to the non-rapid charging period, there is an influence of the apparent voltage increase due to the internal resistance of the large-capacity capacitor 48.

In view of this, as illustrated in FIG. 22, when transitioning from the rapid charging period to the non-rapid charging period at time t0, i.e., when the non-rapid charging time measurement completion signal SW is at the "L" level and the voltage detection correction signal SG is held at the "H" level continuously from the rapid charging detection period so that the offset voltage VO/S (offset voltage SH) continues to be added to the remaining voltage display switching voltage (detected voltage SK), the first remaining voltage display detection signals SQ and the second remaining voltage display detection signals SR all transition to the "L" level (BLD display operation) at the timing of the voltage detection timing signal SX as illustrated in FIG. 23.

Therefore, the voltage detection correction signal SG is forcibly brought to the "L" level even if the non-rapid charging time count value has not exceeded the remaining voltage display correction period tH, thereby forcibly terminating the correction operation.

At the same time, the remaining voltage display rank-up inhibition signal SL transitions to the "H" level, thereby providing a remaining voltage display rank-up inhibition period tINH which corresponds to the non-charging period, which extends between time t0 and time t1, as illustrated in FIG. 22.

In FIG. 22, during the remaining voltage display rank-up inhibition period tINH after forcibly terminating the correction operation, the remaining voltage display is discriminated based on the remaining voltage display switching voltage (detected voltage SK) without the offset voltage VO/S added thereto.

Therefore, during the remaining voltage display rank-up inhibition period illustrated in FIG. 23, the first remaining voltage display detection signal SQ is such that Q1="H" , Q2="L" and Q3="L", at the timing of the voltage detection timing signal SX, whereby the A display operation is selected as the remaining voltage display.

However, since the remaining voltage display rank-up inhibition signal SL is at the "H" level, the second remaining voltage display detection signal SR is such that M1="L", M2="L" and M3="L", thereby keeping the remaining voltage display to be the BLD display operation.

Specifically, the relationship between the first remaining voltage display detection signal SQ (=N) and the second remaining voltage display detection signal SR (n) is as follows:

N>n

Thus, the remaining voltage display result signal SU output from the selection circuit 115B is equal to the second remaining voltage display detection signal SR, thereby keeping the remaining voltage display to accord with the previous detection result.

In this way, when transitioning from the rapid charging period to the non-rapid charging period at time t0, as indicated by a solid line in FIG. 22, it is possible to prevent the remaining voltage display rank from being moved to the next rank of greater remaining voltage (e.g., from the BLD display operation to the A display operation) even though no charging is being performed, thereby avoiding an irregular or odd transition in the display from being viewed by the user.

Then, when transitioning to the normal charging period, as illustrated in FIGS. 22 and 23, the remaining voltage display rank-up inhibition signal SL is brought to the "L" level.

Simultaneously with the transition of the remaining voltage display rankup inhibition signal SL to the "L" level, the values of the first remaining voltage display detection signal SQ are transferred to the second remaining voltage display detection signal SR, whereby M1="H", M2="L" and M3="L".

Thus, the first remaining voltage display detection signal SQ (=N) becomes equal to the second remaining voltage display detection signal SR (=n), i.e.:

N=n

Therefore, the remaining voltage display result signal SU output from the selection circuit 115B of the comparison unit 115 becomes equal to the first remaining voltage display detection signal SQ, whereby the remaining voltage display rank is moved up from the BLD display operation to the A display operation, thus removing the remaining voltage display rank-up inhibition.

The above-described operation of removing the remaining voltage display rank-up inhibition can similarly be used for the remaining voltage display rank-up inhibition period tINH in FIGS. 20 and 21.

Moreover, even where the non-rapid charging time count value has not exceeded the remaining voltage display correction period tH after transitioning from the rapid charging period to the non-rapid charging period, if the battery voltage VTKN is less than the voltage=VBLD+VO/S (BLD display operation), the correction operation is forcibly discontinued so that the discrimination is made by using the remaining voltage display switching voltage (detected voltage SK) without the offset voltage VO/S (offset voltage SH) added thereto.

In contrast, if the discrimination is made by using the remaining voltage display switching voltage (detected voltage SK) with the offset voltage VO/S (offset voltage SH) added thereto, the offset voltage VO/S (offset voltage SH) would also be included in the timepiece operation stop voltage VOFF, as illustrated in FIG. 22, whereby if the remaining voltage of the secondary power source changes as indicated by a one-dot-chain line in FIG. 22, the operation of the timepiece is forcibly terminated at time t1 even though the secondary power source has a sufficient remaining voltage.

Therefore, the correction operation with the offset voltage SH added to the detected voltage is forcibly terminated so as to avoid the above-described problem and to allow the timepiece to continue to operate.

1.4 Variation of the First Embodiment

[1.4.1] The First Variation

Figure 26:
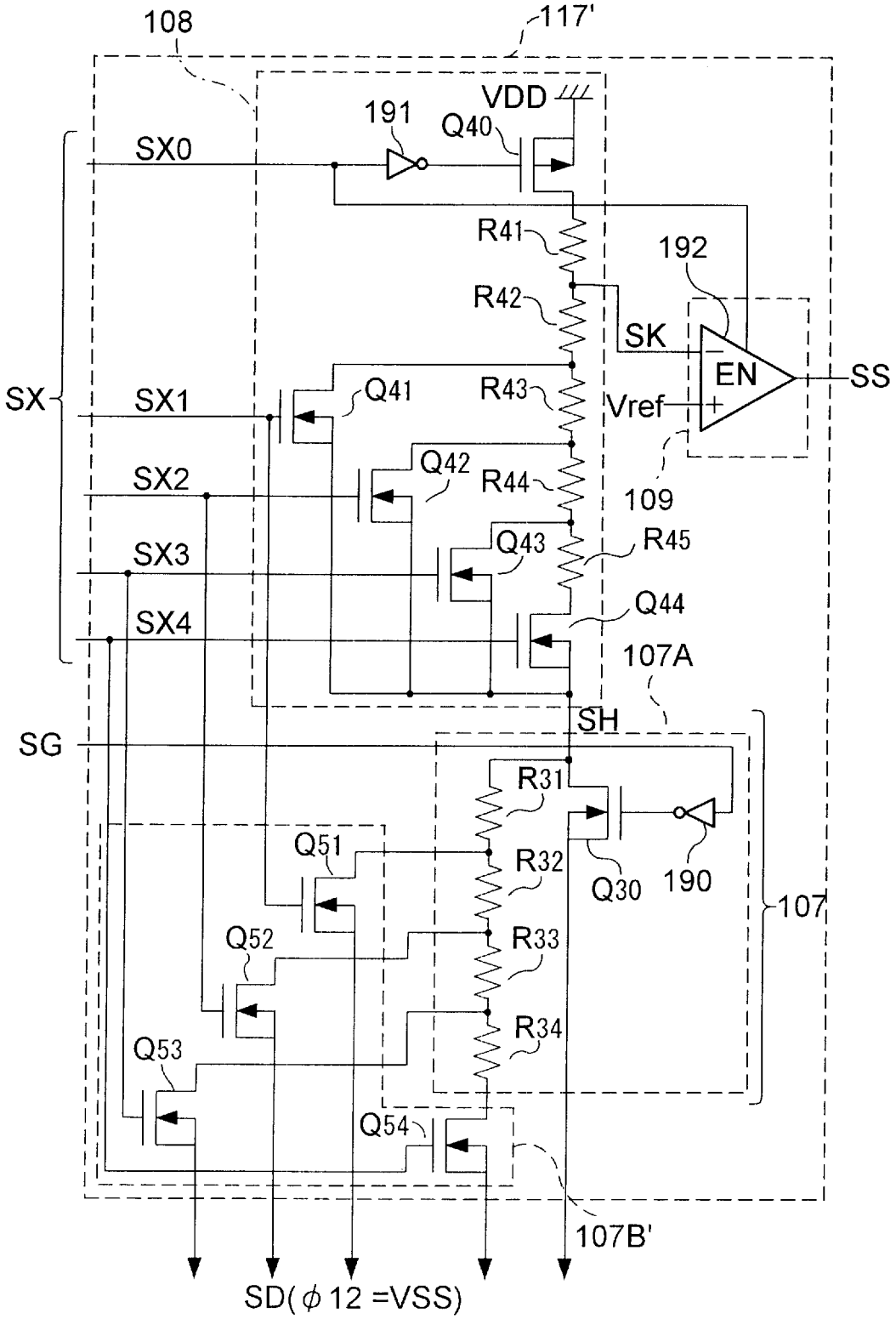
FIG. 26 is a detailed diagram illustrating a voltage detection unit according to the first variation of the first embodiment of the present invention.

FIG. 26 is a detailed diagram illustrating a voltage detection unit 117' according to the first variation of the first embodiment of the present invention. The voltage detection unit 117' illustrated in FIG. 26 is different from the voltage detection unit 117 illustrated in FIG. 8 in that the former uses the voltage detection timing signal SX in place of the power source discrimination signal SN.

More specifically, the voltage detection unit 117' includes an offset voltage selection unit 107B' including an N-channel MOS transistor Q51, an N20 channel MOS transistor Q52, an N-channel MOS transistor Q53 and an N-channel MOS transistor Q54 in place of the offset voltage selection unit 107B of the voltage detection unit 117 of FIG. 8 including the N-channel MOS transistor Q31, the N-channel MOS transistor Q32, the N-channel MOS transistor Q33 and the N-channel MOS transistor Q34.

The configuration of the offset voltage selection unit 107B' will now be described.

The offset voltage selection unit 107B' includes: the N-channel MOS transistor Q51 whose drain is connected to the node between the resistor R31 and the resistor R32 of the offset voltage generation unit 107A, with the source thereof connected to the low potential side power source VSS and the gate thereof receiving as its input the 1-bit signal SX1 which forms a part of the voltage detection timing signal SX so as to turn ON/OFF the N-channel MOS transistor Q51; an N-channel MOS transistor Q52 whose drain is connected to the node between the resistor R32 and the resistor R33 of the offset voltage generation unit 107A, with the source thereof connected to the low potential side power source VSS and the gate thereof receiving as its input the 1-bit signal SX2 which forms a part of the voltage detection timing signal SX so as to turn ON/OFF the N-channel MOS transistor Q52; an N-channel MOS transistor Q53 whose drain is connected to the node between the resistor R33 and the resistor R34 of the offset voltage generation unit 107A, with the source thereof connected to the low potential side power source VSS and the gate thereof receiving as its input the 1-bit signal SX3 which forms a part of the voltage detection timing signal SX so as to turn ON/OFF the N-channel MOS transistor Q53; and an N-channel MOS transistor Q54 whose drain is connected to the resistor R34 of the offset voltage generation unit 107A, with the source thereof connected to the low potential side power source VSS and the gate thereof receiving as its input the 1-bit signal SX4 which forms a part of the voltage detection timing signal SX so as to turn ON/OFF the N-channel MOS transistor Q54.

As a result, the voltage detection unit 117' according to the first variation can address situations where the apparent voltage increase of the secondary power source varies for different voltage regions of the secondary power source. Thus, when such a secondary power source is used, it is possible to provide an even more accurate voltage detection.

[1.4.2] The Second Variation

Figure 27:
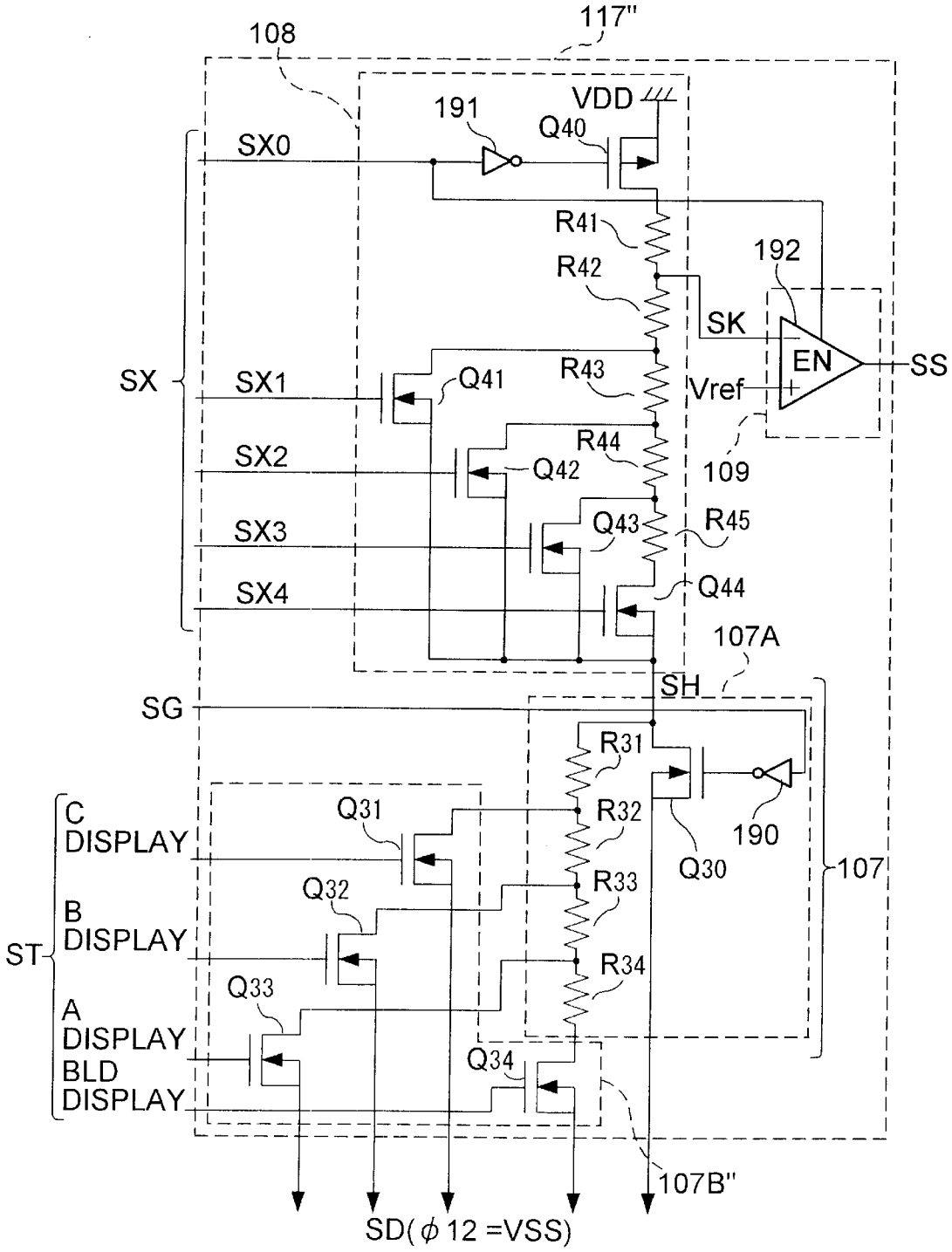
FIG. 27 is a detailed diagram illustrating a voltage detection unit according to the second variation of the first embodiment of the present invention.

FIG. 27 is a detailed diagram illustrating a voltage detection unit 117" according to the second variation of the first embodiment of the present invention. The voltage detection unit 117" illustrated in FIG. 27 is different from the voltage detection unit 117 illustrated in FIG. 8 in that the former inputs the remaining voltage display signals ST from the remaining voltage display unit 116 (the C display signal, the B display signal, the A display signal and the BLD display signal), in place of the power source discrimination signals SN (SN1 to SN4), to the respective circuits of the N-channel MOS transistor Q31, the N-channel MOS transistor Q32, the N-channel MOS transistor Q33 and the N-channel MOS transistor Q34, respectively, in the offset voltage selection unit 107B of the voltage detection unit 117 of FIG. 8.

As a result, in the voltage detection unit 117" of the second variation, it is possible to select the offset voltage SH to be added to the detected voltage SK based on the remaining battery voltage. Thus, in addition to the effects as those provided by the first embodiment, a more appropriate offset voltage SH can be superimposed so as to provide an even more accurate remaining voltage detection.

[2] The Second Embodiment

In the first embodiment described above, the voltage detection is performed by using the detected voltage SK with the offset voltage SH added thereto while rapid charging is being detected. In the second embodiment, the detected voltage SK without the offset voltage SH added thereto is used while non-rapid charging is being detected, and a corrected detected voltage, in place of the detected voltage SK, is used while rapid charging is being detected.

Figure 28:
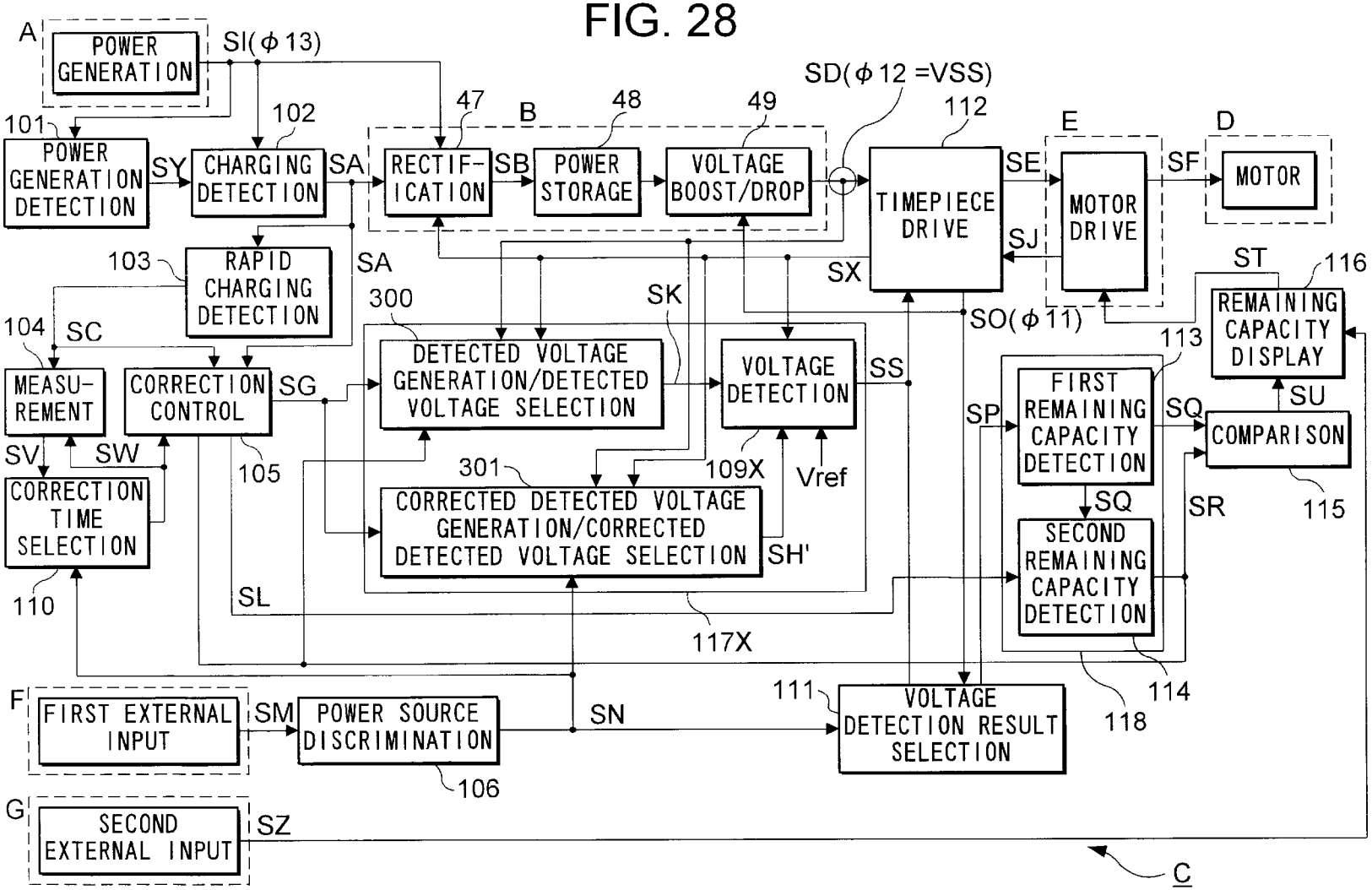
FIG. 28 is a functional block diagram illustrating a control unit C and periphery components thereof according to the second embodiment of the present invention.

FIG. 28 is a functional block diagram illustrating a control unit C of a time-keeping device and periphery components thereof according to the second embodiment of the present invention. This embodiment shown in FIG. 28 is different from the first embodiment of FIG. 2 in that the former includes a detected voltage generation/detected voltage selection unit 300 and a corrected detected voltage generation/corrected detected voltage selection unit 301, in place of the detected voltage generation unit 108 and the offset voltage generation/offset voltage selection unit 107.

Figure 29:
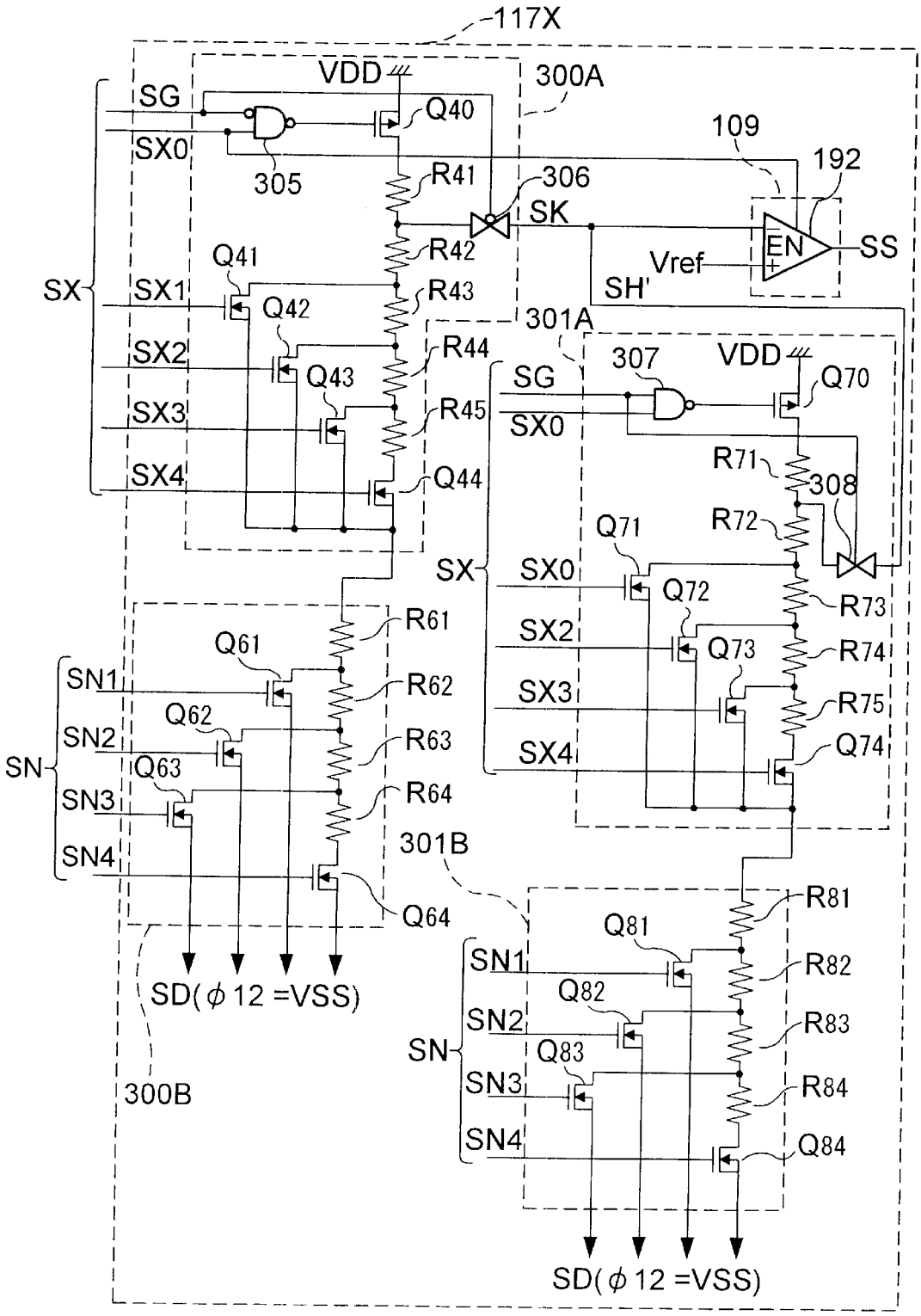
FIG. 29 is a detailed diagram illustrating a voltage detection unit according to the second embodiment of the present invention.

FIG. 29 is a detailed diagram illustrating the detected voltage generation/detected voltage selection unit, the corrected detected voltage generation/corrected detected voltage selection unit, and the voltage detection unit.

The detected voltage generation/detected voltage selection unit 300 of a voltage detection unit 117X is generally divided into a detected voltage generation unit 300A and a detected voltage selection unit 300B.

The detected voltage generation unit 300A includes: an NAND circuit 305 one input terminal of which receives as its input the inverted version of the voltage detection correction signal SG, with the other input terminal thereof receiving as its input the signal SX0 which forms a part of the voltage detection timing signal SX, so as to obtain the negated logical product of the input signals and output the obtained negated logical product; the P-channel MOS transistor Q40 which is turned ON during the detected voltage generation based on the output signal from the NAND circuit 305; the resistors R41 to R45 which are connected in series with the P-channel MOS transistor Q40; the N-channel MOS transistor Q41 whose drain is connected to the node between the resistor R42 and the resistor R43, with the source thereof connected to a resistor R61 of the detected voltage selection unit 300B and the gate thereof receiving as its input the 1-bit signal SX1 which forms a part of the voltage detection timing signal SX; the N-channel MOS transistor Q42 whose drain is connected to the node between the resistor R43 and the resistor R44, with the source thereof connected to the resistor R61 of the detected voltage selection unit 300B and the gate thereof receiving as its input the 1-bit signal SX2 which forms a part of the voltage detection timing signal SX; the N-channel MOS transistor Q43 whose drain is connected to the node between the resistor R44 and the resistor R45, with the source thereof connected to the resistor R61 of the detected voltage selection unit 300B and the gate thereof receiving as its input the 1-bit signal SX3 which forms a part of the voltage detection timing signal SX; the N-channel MOS transistor Q44 whose drain is connected to the resistor R45, with the source thereof connected to the resistor R61 of the detected voltage selection unit 300B and the gate thereof receiving as its input the 1-bit signal SX4 which forms a part of the voltage detection timing signal SX; and a transfer gate 306 one input/output terminal of which is connected to the node between the resistor R41 and the resistor R42, with the other input/output terminal thereof connected to the input terminal of the comparator 192 and the control terminal thereof receiving as its input the inverted version of the voltage detection correction signal SG.

The detected voltage selection unit 300B includes: resistors R61 to R64 which are serially connected with each other; an N-channel MOS transistor Q61 whose drain is connected to the node between the resistor R61 and the resistor R62, with the source thereof connected to the low potential side power source VSS and the gate thereof receiving as its input the 1-bit signal SN1 which forms a part of the power source discrimination signal SN so as to turn ON/OFF the N-channel MOS transistor Q61; an N-channel MOS transistor Q62 whose drain is connected to the node between the resistor R62 and the resistor R63, with the source thereof connected to the low potential side power source VSS and the gate thereof receiving as its input the 1-bit signal SN2 which forms a part of the power source discrimination signal SN so as to turn ON/OFF the N-channel MOS transistor Q62; an N-channel MOS transistor Q63 whose drain is connected to the node between the resistor R63 and the resistor R64, with the source thereof connected to the low potential side power source VSS and the gate thereof receiving as its input the 1-bit signal SN3 which forms a part of the power source discrimination signal SN so as to turn ON/OFF the N-channel MOS transistor Q63; and an N-channel MOS transistor Q64 whose drain is connected to the resistor R64, with the source thereof connected to the low potential side power source VSS and the gate thereof receiving as its input the 1-bit signal SN4 which forms a part of the power source discrimination signal SN so as to turn ON/OFF the N-channel MOS transistor Q64.

A corrected detected voltage generation unit 301A includes: an NAND circuit 307 one input terminal of which receives as its input the voltage detection correction signal SG, with the other terminal thereof receiving as its input and the signal SX0 which forms a part of the voltage detection timing signal SX, so as to obtain the negated logical product of the input signals and output the obtained negated logical product; a P-channel MOS transistor Q70 which is turned ON during the corrected detected voltage generation based on the output signal from the NAND circuit 307; resistors R71 to R75 which are connected in series with the P-channel MOS transistor Q70; an N-channel MOS transistor Q71 whose drain is connected to the node between the resistor R72 and the resistor R73, with the source thereof connected to a resistor R81 of a corrected detected voltage selection unit 301B and the gate thereof receiving as its input the 1-bit signal SX1 which forms a part of the voltage detection timing signal SX; an N-channel MOS transistor Q72 whose drain is connected to the node between the resistor R73 and the resistor R74, with the source thereof connected to the resistor R81 of the corrected detected voltage selection unit 301B and the gate thereof receiving as its input the 1-bit signal SX2 which forms a part of the voltage detection timing signal SX; an N-channel MOS transistor Q73 whose drain is connected to the node between the resistor R74 and the resistor R75, with the source thereof connected to the resistor R81 of the corrected detected voltage selection unit 301B and the gate thereof receiving as its input the 1-bit signal SX3 which forms a part of the voltage detection timing signal SX; an N-channel MOS transistor Q74 whose drain is connected to the resistor R75, with the source thereof connected to the resistor R81 of the corrected detected voltage selection unit 301B and the gate thereof receiving as its input the 1-bit signal SX4 which forms a part of the voltage detection timing signal SX; and a transfer circuit 308 one input/output terminal of which is connected to the node between the resistor R71 and the resistor R72, with the other input/output terminal thereof connected to the input terminal of the comparator 192 and the control terminal thereof receiving as its input the voltage detection correction signal SG.

The corrected detected voltage selection unit 301B includes: resistors R81 to R84 which are serially connected with each other; an N-channel MOS transistor Q81 whose drain is connected to the node between the resistor R81 and the resistor R82, with the source thereof connected to the low potential side power source VSS and the gate thereof receiving as its input the 1-bit signal SN1 which forms a part of the power source discrimination signal SN so as to turn ON/OFF the N-channel MOS transistor Q81; an N-channel MOS transistor Q82 whose drain is connected to the node between the resistor R82 and the io resistor R83, with the source thereof connected to the low potential side power source VSS and the gate thereof receiving as its input the 1-bit signal SN2 which forms a part of the power source discrimination signal SN so as to turn ON/OFF the N-channel MOS transistor Q82; an N-channel MOS transistor Q83 whose drain is connected to the node between the resistor R83 and the resistor R84, with the source thereof connected to the low potential side power source VSS and the gate thereof receiving as its input the 1-bit signal SN3 which forms a part of the power source discrimination signal SN so as to turn ON/OFF the N-channel MOS transistor Q83; and an N-channel MOS transistor Q84 whose drain is connected to the resistor R84, with the source thereof connected to the low potential side power source VSS and the gate thereof receiving as its input the 1-bit signal SN4 which forms a part of the power source discrimination signal SN so as to turn ON/OFF the N-channel MOS transistor Q84.

The operation of the second embodiment is substantially the same as that of the first embodiment except that the detected voltage generation unit 108 of the first embodiment outputs the detected voltage SK with the offset voltage SH superimposed thereon while rapid charging is being detected, whereas in the second embodiment, the detected voltage SK output from the detected voltage generation/detected voltage selection unit 300 is used while non-rapid charging is being detected and a corrected detected voltage SH' output from the correction detected voltage generation/correction detected voltage selection unit 301 is used while rapid charging is being detected.

3 VARIATION OF THE ABOVE-DESCRIBED EMBODIMENTS

3.1 The First Variation

Although each of the above-described embodiments has been described in connection with an example of a time-keeping device which produces a time display by using the stepping motor 10, the present invention can of course be applied to any other type of time-keeping device which produces a time display by using an LCD, or the like.

3.2 The Second Variation

Although each of the above-described embodiments has been described in connection with examples where a voltage detection device and a remaining battery voltage detection device are used in a time-keeping device, the present invention is not limited to these examples and can be applied to various other types of electronic devices, particularly portable electronic devices, which include a secondary power source and a driven circuit (corresponding to the driven means) which is powered by the secondary power source.

These electronic devices include players/recorders using cassette tapes, disk-shaped recording media or semiconductor recording media, calculators, personal computers, portable information devices (e.g., an electronic organizer), portable radios, portable TVRs, etc.

3.3 The Third Variation

In each of the above-described embodiments, the reference voltage Vref has been described as being fixed in the comparator of the voltage discrimination unit. Alternatively, the reference Vref may be variable or selected from a plurality of reference voltages, instead of using a detected voltage with an offset voltage added thereto or using a corrected detected voltage.

3.4 The Fourth Variation

The above-described embodiments employ, as the power generator 40, an electromagnetic power generator in which the rotational movement of the revolving weight 45 is transferred to the rotor 43 so as to generate an electromotive force in the output coil 44 by the rotation of the rotor 43. However, the present invention is not limited to this. For example, the present invention may alternatively be used with a power generator in which a rotational movement is caused by a restoring force of a spring so as to generate an electromotive force by the rotational movement, or a power generator which generates an electric power based on a piezoelectric effect by applying an externally-induced or self-induced vibration or displacement to a piezoelectric material.

Alternatively, the present invention may be used with a power generator using a solar battery which generates an electric power based on a photoelectric conversion using the sunlight, or a thermoelectric power generator which utilizes the thermocouple principle.

3.5 The Fifth Variation

Although the reference potential (GND) is set to the Vdd (high potential side) in each of the above-described embodiments, it is of course possible to set the reference potential (GND) to Vss (low potential side).

According to the present invention, it is possible to reliably detect the voltage of the secondary power source and to provide a more accurate detection of the remaining capacity, so that the accurately detected remaining capacity can be notified to the user.

As a result, it is possible to prevent an electronic timepiece or an electronic device using a secondary power source from being stopped operating suddenly due to shortage of the power source capacity. Thus, the present invention can improve the usability of these devices.

What is claimed is:

1. A voltage detecting device for detecting a voltage of a secondary power source including:

a rapid charging detecting unit for detecting whether rapid charging to said secondary power source is performed or not;

a voltage generating unit for outputting as a detection voltage, when said rapid charging is not detected, a detected voltage having a correlation to an amount of stored electricity of said secondary power source, and outputting as said detection voltage, when said rapid charging is detected, a corrected voltage in which a correction voltage corresponding to an apparent boosted voltage generated in said secondary power source due to said rapid charging is cancelled from said detected voltage; and a voltage detection result output unit for outputting a voltage detection result signal, based on said detection voltage.

2. The voltage detecting device as claimed in claim 1, wherein said voltage detection result output unit compares said detection voltage with a predetermined reference voltage to obtain a comparative result and outputs said result as said voltage detection result signal.

3. The voltage detecting device as claimed in claim 1, wherein said rapid charging detecting unit includes:

a charging condition detecting unit for detecting charging to said secondary power source; and a rapid charging condition discrimination unit for discriminating a transition to a rapid charging condition in which said rapid charging is performed, upon detecting that said charging to said secondary power source remains during a time longer than a predetermined charging reference time.

4. The voltage detecting device as claimed in claim 3, wherein said secondary power source is charged by a power generating device; and said charging condition detecting unit includes a power generation current discriminating unit for discriminating whether a power generation current volume output from said power generating device exceeds a predetermined power generation current volume or not.

5. The voltage detecting device as claimed in claim 3, wherein said secondary power source is charged by a power generating device; and said charging condition detecting unit includes a stored power voltage discriminating unit for calculating a stored power voltage of said secondary power source based on a power generation current output from said power generating device to discriminate whether said stored power voltage exceeds a predetermined reference stored power voltage or not.

6. The voltage detecting device as claimed in claim 3, wherein said secondary power source is charged by a power generating device; and said charging condition detecting unit includes:

a comparing unit for comparing a voltage of an output terminal in said power generating device with a prescribed voltage corresponding to a terminal voltage in said secondary power source; and a charging condition discriminating unit for discriminating as being in a charging condition a case in which said voltage of said output terminal exceeds said terminal voltage of said secondary power source, based on a comparative result of said comparing unit.

7. The voltage detecting device as claimed in claim 3, wherein said charging condition detecting unit discriminates whether or not charging to said secondary power source is performed by monitoring a route different from a charging route of said charging.

8. The voltage detecting device as claimed in claim 1, wherein said secondary power source is charged by a power generating device; and said rapid charging detecting unit includes:

a power generating condition detecting unit for detecting a power generating condition in said power generating device; and a rapid charging condition discriminating unit for discriminating as being in a rapid charging condition upon detecting that said power generating condition is remains during a time longer than a predetermined power generating reference time.

9. The voltage detecting device as claimed in claim 8, wherein said power generating condition detecting unit includes:

an output voltage comparing unit for comparing an output voltage of said power generating device with a predetermined reference power generating voltage; and a power generating condition discriminating unit for discriminating, based on a comparative result of said output voltage comparing unit, whether a power generating condition is present or not.

10. The voltage detecting device as claimed in claim 1, wherein said secondary power source is charged by a power generating device; said rapid charging detecting unit includes:

a charging condition detecting unit for detecting a condition of charging to said secondary power source;

a power generating condition detecting unit for detecting a power generating condition of said power generating device; and a rapid charging condition discriminating unit for discriminating as being in a rapid charging condition a case in which detection of said charging is continuously repeated during a time longer than a predetermined charging reference time, or a case in which detection of said power generating condition is continuously repeated during a time longer than a predetermined power generating reference time; and said power generating reference time is set longer than said charging reference time.

11. The voltage detecting device as claimed in claim 8, wherein said power generating condition detecting unit discriminates whether or not a power generation is implemented by monitoring a route different route from a charging route of said secondary power source.

12. The voltage detecting device as claimed in claim 1, wherein said voltage generating unit comprises:

a detectedd voltage output unit for outputting a detected voltage having a correlation to an amount of a stored electricity of said secondary power source; and a voltage correction unit for canceling from said detected voltage, when said rapid charging is detected, a correction voltage corresponding to an apparent boosted voltage generated in said secondary power source due to said rapid charging.

13. The voltage detecting device as claimed in claim 12, wherein said detected voltage output unit produces a plurality of different detected voltages; and said voltage correction unit produces said correction voltage in a manner to correspond to a respective one of said plurality different detected voltages.

14. The voltage detecting device as claimed in claim 1, wherein said correction voltage is a predetermined offset voltage.

15. The voltage detecting device as claimed in claim 1, further including:

a power source kind discriminating unit for discriminating a kind of said secondary power source; and a discriminating result selecting unit for selecting any one of a plurality of voltage detecting result signal corresponding to said plurality of detected voltages, based on a discriminating result of said power source kind discriminating unit to output said selected voltage detecting result signal.

16. The voltage detected device as claimed in claim 1, wherein said voltage detection result output unit discriminates a voltage of said secondary power source into a plurality of stages having predetermined voltage ranges; and any one of said correction voltage or said detected voltage is set in a respective one of said stages.

17. The voltage detected device as claimed in claim 15, wherein at least said correction voltage in a group of said correction voltage and said detected voltage output from said detected voltage output unit is set in a manner to correspond to a kind of said secondary power source; and said voltage correction unit includes:

a correction voltage producing unit for producing a plurality of correction voltages corresponding to a kind of said secondary power source; and a correction voltage selecting unit for selecting a correction voltage corresponding to a discriminating result in said power source kind discriminating unit to output said selected correction voltage.

18. The voltage detecting device as claimed in claim 15, wherein said correction voltage and said detection voltage output from said detection voltage output unit are respectively set in a manner to correspond to a kind of said secondary power source; and said detection voltage output unit includes:

a detected voltage producing unit for producing a plurality of detected voltages corresponding to a kind of said secondary power source;

a detected voltage selecting unit for selecting a detected voltage corresponding to a discriminating result in said power source kind discriminating unit to output said selected detected voltage; and said voltage correction unit includes: a correction voltage producing unit for producing a plurality of correction voltages corresponding to a kind of said secondary power source; and a correction voltage selecting unit for selecting a correction voltage corresponding to a discriminating result in said power source kind discriminating unit to output said selected correction voltage.

19. The voltage detecting device as claimed in claim 15, wherein said power source kind discriminating unit discriminates a kind of said secondary power source, based on a kind designating signal from outside.

20. The voltage detecting device as claimed in claim 19, wherein said kind designating signal is input through an external input terminal or input from a memory.

21. The voltage detecting device as claimed in claim 3, wherein said rapid charging condition discriminating unit discriminates a period of time when said rapid charging continues being detected by said rapid charging detecting unit and a period of time when a prescribed waiting time is passed after said rapid charging is not continuously detected as said rapid charging condition.

22. The voltage detecting device as claimed in claim 3, wherein said rapid charging condition discriminating unit discriminates a period of time when said rapid charging continues being detected by said rapid charging detecting unit and a period of time when a prescribed waiting time is passed after said rapid charging stops being detected, as said rapid charging condition.

23. The voltage detecting device as claimed in claim 21, wherein said waiting time is set as a period of time when an apparent voltage boost generated in a rapid charging in said secondary power source becomes almost zero and stable.

24. The voltage detecting device as claimed in claim 21, further including: a power source kind discriminating unit for discriminating a kind of said secondary power source; a waiting time storage unit for storing a plurality of waiting times; and a waiting time selecting unit for selecting anyone of said waiting times stored in said waiting time storage unit, based on a discriminating result in said power source kind discriminating unit to output said selected waiting time.

25. The voltage detecting device as claimed in claim 21, wherein a measurement of said waiting time is initialized when said rapid charging is detected again before said waiting time is passed.

26. The voltage detecting device as claimed in claim 1, wherein said detected voltage is a voltage after a voltage boost and drop is implemented at a prescribed voltage boost and drop multiplying factor; and further including: a discriminating result selecting unit for selecting any one of a plurality of voltage detection results corresponding to a plurality of said detected voltages, based on said voltage boost and drop multiplying factor to output said selected voltage detection result.

27. The voltage detecting device as claimed in claim 16, further including: a discriminating result selecting unit for selecting any one of a plurality of voltage detection results corresponding to a plurality of said detected voltages, based on said stage to output said selected voltage detection result.

28. A battery remaining capacity detecting device including:

a voltage detecting device as claimed in claim 1; and a remaining capacity discriminating unit for discriminating a remaining capacity which is an amount of electricity which can be output from said secondary power source, based on a voltage detecting result output from said voltage detecting device.

29. A battery remaining capacity detecting device including:

a voltage detecting device as claimed in claim 21; and a remaining capacity discriminating unit for discriminating a remaining capacity which is an amount of an electricity which can be output from said secondary power source, based on a voltage detecting result output from said voltage detecting device; and said remaining capacity discriminating unit discriminates a remaining capacity of said secondary power source in such manner that when a predetermined condition is satisfied during a period of time when said waiting time is passed after said rapid charging is not continuously detected as said rapid charging condition, a transition to other conditions except said rapid charging condition is effected.

30. The battery remaining capacity detecting device as claimed in claim 29, wherein said predetermined condition is a case in which a voltage of said secondary power source is below a predetermined lower limit voltage.

31. The battery remaining capacity detecting device as claimed in claim 29, wherein said predetermined condition is a case in which a remaining capacity of said secondary power source discriminated by said remaining capacity discriminating unit becomes a predetermined remaining capacity.

32. The battery remaining capacity detecting device as claimed in claim 28, wherein said battery remaining capacity detecting device includes a remaining capacity comparing unit for comparing a remaining capacity of said secondary power source immediately before said rapid charging condition is over with a remaining capacity of said secondary power source immediately after transitioning to said non-rapid charging condition, when a transition from said rapid charging condition to said non-rapid charging condition is effected; and said voltage detection result output unit discriminates a voltage of said secondary power source into a plurality of stages having predetermined voltage ranges based on a comparative result in said remaining capacity comparing unit, and when a stage corresponding to a remaining capacity of said secondary power source immediately after transition to said non-rapid charging condition is lower than a stage corresponding to a remaining capacity of said secondary power source immediately before said rapid charging is over, said voltage detection result output unit discriminates said stage corresponding to said remaining capacity of said secondary power source immediately after transition to said non-rapid charging condition as a stage corresponding to a present remaining capacity.

33. The battery remaining capacity detecting device as claimed in claim 28, wherein said voltage detection result output unit discriminates a voltage of said secondary power source into a plurality of stages having predetermined voltage ranges and said battery remaining capacity detecting device further includes:

a remaining capacity comparing unit for comparing a stage of a remaining capacity of said secondary power source immediately before said rapid charging condition is over with a stage of a remaining capacity of said secondary power source immediately after transitioning to said non-rapid charging condition, when a transition from said rapid charging condition to said non-rapid charging condition is effected; and a rank-up inhibiting control unit for inhibiting rank-up of said stage based on a comparative result in said remaining capacity comparing unit in a way that until a predetermined rank-up inhibiting cancellation condition is satisfied, a rank-up of stage is inhibited when a stage corresponding to a remaining capacity of said secondary power source immediately after transition to said non-rapid charging condition is higher than a stage corresponding to a remaining capacity of said secondary power source immediately before said rapid charging is over.

34. The battery remaining capacity detecting device as claimed in claim 33, wherein said rapid charging detecting unit includes a charging condition detecting unit for detecting a charging condition to said secondary power source; and said rank-up inhibiting cancellation condition is a case in which a charging condition is detected by said charging detecting unit.

35. The battery remaining capacity detecting device as claimed in claim 28, wherein said battery remaining capacity detecting device includes a charging cut-off unit for forcefully cutting off a charging of said secondary power source, when detecting a voltage having a correlation to a remaining capacity of said secondary power source.

36. An electronic timepiece including:

a secondary power source supplying a power source for driving;

a time keeping unit driven by said secondary power source; and a voltage detecting device according to claim 1.

37. An electronic timepiece including:

a secondary power source supplying a power source for driving;

a time keeping unit driven by said secondary power source; and a battery remaining amount detecting device according to claim 28.

38. An electronic device including:

a secondary power source supplying a power source for driving;

a driven unit driven by said secondary power source; and a voltage detecting device according to claim 1.

39. An electronic device including:

a secondary power source supplying a power source for driving;

a driven unit driven by said secondary power source; and a battery remaining amount detecting device according to claim 28.

40. A method for detecting a voltage of a secondary power source comprising steps of:

detecting whether a rapid charging is effected in said secondary power source or not;

outputting as a detection voltage, when said rapid charging is not detected, a detected voltage having a correlation to an amount of a stored electricity of said secondary power source, and outputting as said detection voltage, when said rapid charging is detected, a corrected voltage in which a correction voltage corresponding to an apparent boosted voltage generated in said secondary power source due to said rapid charging is cancelled from said detected voltage; and outputting a voltage detection result signal, based on said detection voltage.

41. The method as claimed in claim 40, wherein said method further comprises a step of comparing said detection object voltage obtained in said outputting a detection voltage step with a predetermined reference voltage to discriminate a remaining capacity of said secondary power source.

* * * * *

UNITED STATES PATENT AND TRADEMARK OFFICE

CERTIFICATE OF CORRECTION

PATENT NO. : 6,563,766 B1
DATED : May 13, 2003
INVENTOR(S) : Shinji Nakamiya

It is certified that error appears in the above-identified patent and that said Letters Patent is hereby corrected as shown below:

Column 51,
Line 31, please delete “is”.

Column 52,
Line 5, please change “detectedd” to -- detected --
Line 23, please change “claim 1” to -- claim 13 -- and Column 56,
Line 29, please delete “object”.

Signed and Sealed this

Tenth Day of August, 2004

JON W. DUDAS
*Acting Director of the United States Patent and Trademark Office*